US010597944B2

(12) United States Patent
Randall

(10) Patent No.: US 10,597,944 B2
(45) Date of Patent: Mar. 24, 2020

(54) GUIDANCE SYSTEM FOR A DOWNHOLE BORING DEVICE

(71) Applicant: Coiled Tubing Specialties, LLC, Tulsa, OK (US)

(72) Inventor: Bruce L. Randall, Tulsa, OK (US)

(73) Assignee: COILED TUBING SPECIALTIES, LLC, Tulsa, OK (US)

( * ) Notice: Subject to any disclaimer, the term of this patent is extended or adjusted under 35 U.S.C. 154(b) by 31 days.

(21) Appl. No.: 16/147,825

(22) Filed: Sep. 30, 2018

(65) Prior Publication Data

US 2019/0032405 A1 Jan. 31, 2019

Related U.S. Application Data

(60) Division of application No. 15/010,650, filed on Jan. 29, 2016, now Pat. No. 10,227,825, which is a (Continued)

(51) Int. Cl.
*E21B 7/18* (2006.01)
*E21B 7/06* (2006.01)
(Continued)

(52) U.S. Cl.
CPC ..... *E21B 7/18* (2013.01); *E21B 7/046* (2013.01); *E21B 7/061* (2013.01); *E21B 7/064* (2013.01);
(Continued)

(58) Field of Classification Search
CPC ..... E21B 7/04–7/10; E21B 7/18
See application file for complete search history.

(56) References Cited

U.S. PATENT DOCUMENTS 4,753,223 A * 6/1988 Bremer ..... A61B 1/0058 600/140
5,325,845 A * 7/1994 Adair ..... A61B 1/0055 600/114
(Continued)

OTHER PUBLICATIONS

Screenshot of "Flexinol" web page by "Dynalloy, Inc.", accessed Dec. 23, 2019 via www.dynalloy.com.*
(Continued)

*Primary Examiner* — Blake E Michener
(74) *Attorney, Agent, or Firm* — Peter L. Brewer; Thrive IP

(57) ABSTRACT

A hydraulic jetting assembly is provided herein. The jetting assembly includes a jetting hose, with a jetting nozzle at its distal end. The jetting nozzle comprises a tubular stator body having a fluid discharge slot, and a tubular rotor body residing within a bore of the stator body. The jetting nozzle has one or more bearings residing between the rotor body and the surrounding stator body to accommodate relative rotational movement. The jetting nozzle includes a proximal end configured to sealingly connect to an end of a jetting hose, and to receive a high pressure jetting fluid. Preferably, the nozzle has an outer diameter that is equivalent to or slightly larger than an outer diameter of the jetting hose. Preferably, the jetting assembly has at least three actuator wires configured to induce a controlled bending moment at its distal end, thereby providing for a steerable downhole tool.

5 Claims, 30 Drawing Sheets

Related U.S. Application Data continuation-in-part of application No. 14/612,538, filed on Feb. 3, 2015, now Pat. No. 9,856,700, which is a division of application No. 13/198,802, filed on Aug. 5, 2011, now Pat. No. 8,991,522.

(60) Provisional application No. 62/120,212, filed on Feb. 24, 2015, provisional application No. 62/198,575, filed on Jul. 29, 2015.

(51) Int. Cl.

| | |
|---|---|
| ***E21B 23/14*** | (2006.01) |
| ***E21B 41/00*** | (2006.01) |
| ***E21B 43/26*** | (2006.01) |
| ***E21B 43/114*** | (2006.01) |
| ***E21B 43/119*** | (2006.01) |
| ***E21B 7/04*** | (2006.01) |
| *E21B 23/00* | (2006.01) |

(52) U.S. Cl.

CPC ..... *E21B 23/14* (2013.01); *E21B 41/0078* (2013.01); *E21B 43/114* (2013.01); *E21B 43/119* (2013.01); *E21B 43/26* (2013.01); *E21B 2023/008* (2013.01)

(56) References Cited

U.S. PATENT DOCUMENTS

| | | | | |
|---|---|---|---|---|
| 10,227,825 | B2 * | 3/2019 | Randall | E21B 7/061 |
| 10,260,299 | B2 * | 4/2019 | Randall | E21B 7/061 |
| 2004/0140726 | A1 | 7/2004 | Spring | |
| 2005/0250990 | A1 * | 11/2005 | Le | A61B 1/00135 600/114 |
| 2010/0032212 | A1 * | 2/2010 | Van Steenwyk | E21B 7/067 175/61 |
| 2012/0228033 | A1 | 9/2012 | Mazarac | |
| 2014/0054092 | A1 | 2/2014 | Buckman, Sr. | |
| 2014/0180323 | A1 * | 6/2014 | Shriver | A61M 25/09025 606/185 |
| 2014/0228876 | A1 * | 8/2014 | Copeta | A61M 25/0194 606/194 |
| 2016/0153239 | A1 * | 6/2016 | Randall | E21B 7/061 175/4.57 |
| 2016/0258218 | A1 * | 9/2016 | Lange | E21B 7/067 |
| 2017/0009531 | A1 * | 1/2017 | Lange | E21B 47/024 |
| 2017/0016277 | A1 * | 1/2017 | Lange | E21B 7/067 |
| 2019/0032406 | A1 * | 1/2019 | Randall | E21B 7/061 |
| 2019/0153841 | A1 * | 5/2019 | Randall | E21B 43/26 |

OTHER PUBLICATIONS

English Translation of CN 102667047 A; Published Sep. 12, 2012; Shell Int Research; 21 Pages.

English Translation of CN 201276969 Y; Published Jul. 22, 2009; Ren Jun; 5 Pages.

SIPO Search Report for 2016800187388; dated Sep. 10, 2018; 2 pages.

English Translation of SIPO Office Action in Application No. 201680018738; dated Sep. 10, 2018; 8 pages.

* cited by examiner

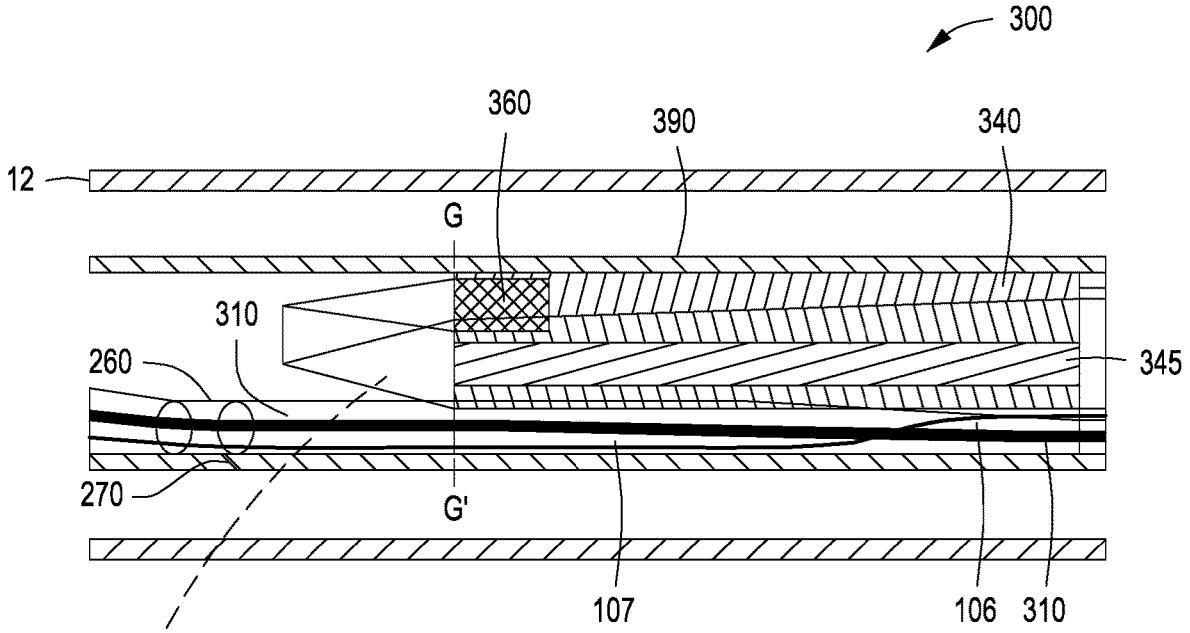
FIG. 4C-1
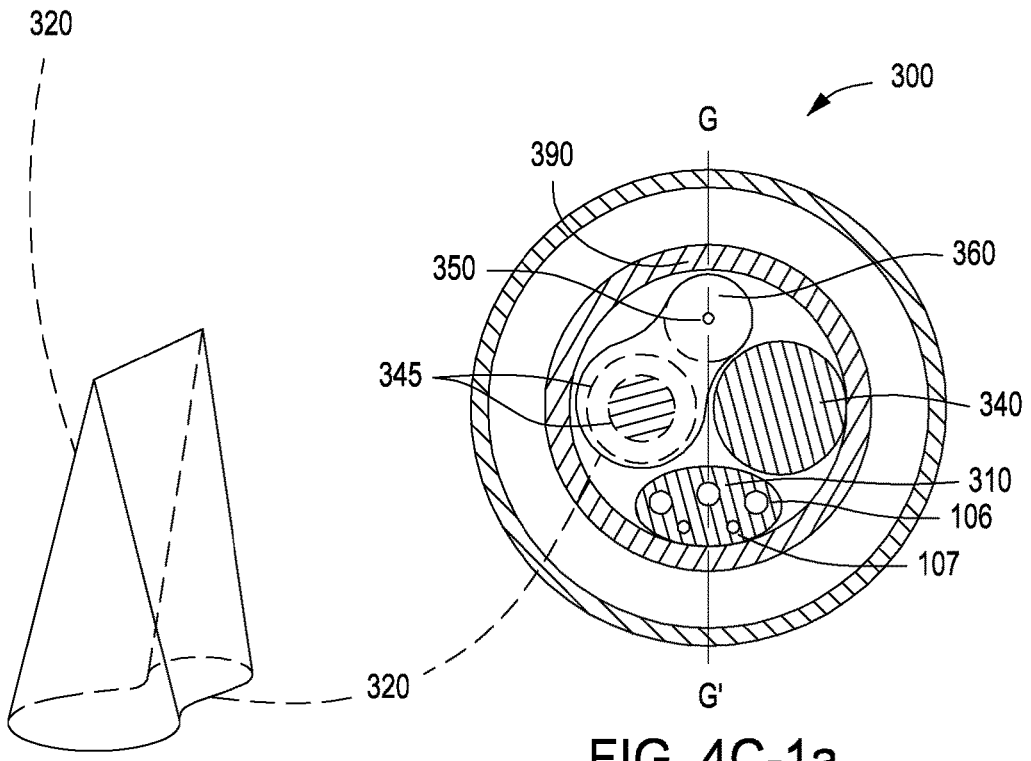
FIG. 4C-1a
FIG. 4C-1b

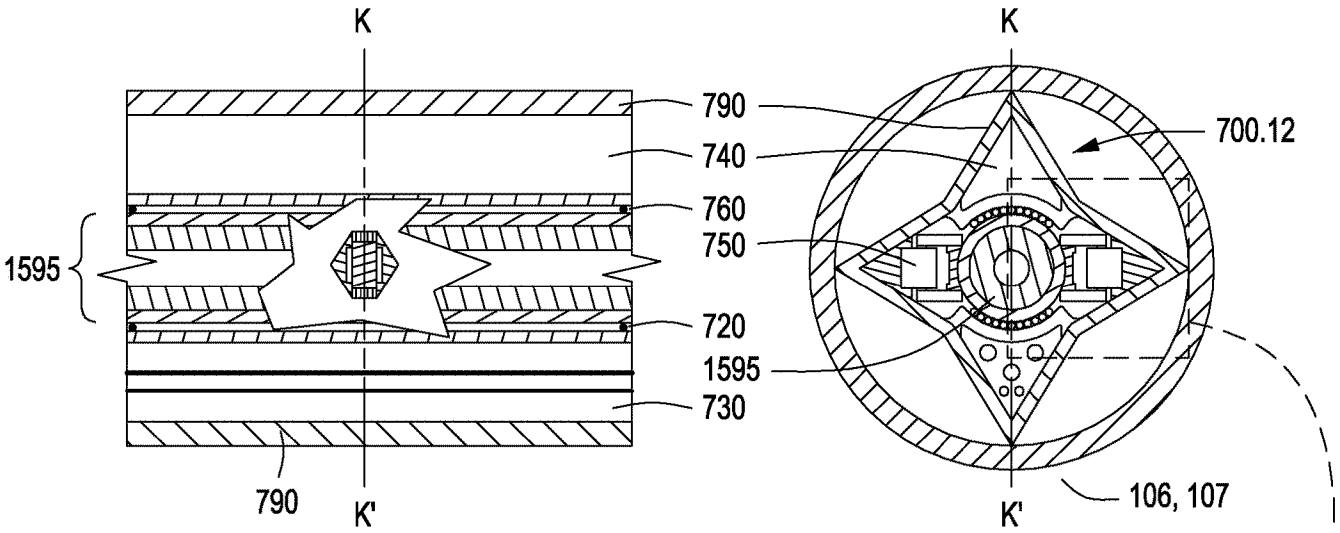
FIG. 4F-2
FIG. 4F-2a
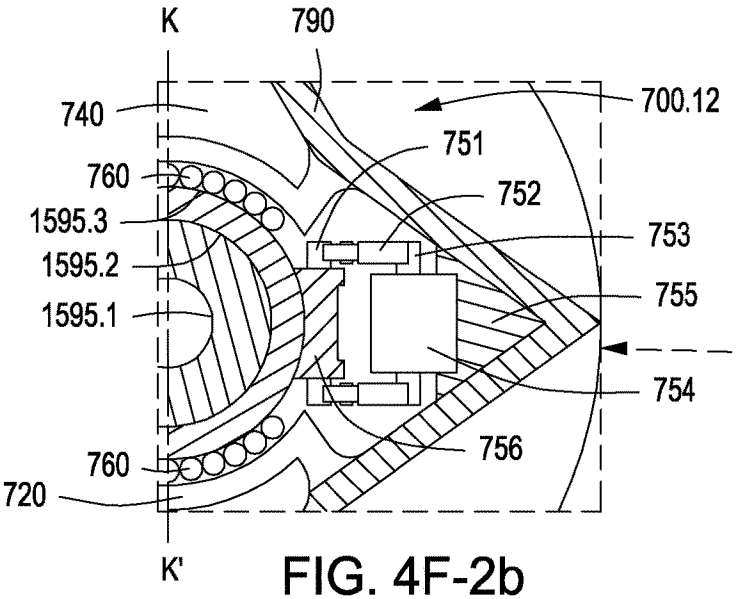
FIG. 4F-2b

GUIDANCE SYSTEM FOR A DOWNHOLE BORING DEVICE

STATEMENT OF RELATED APPLICATIONS

This application claims the benefit of U.S. Provisional Patent Appl. No. 62/198,575 filed Jul. 29, 2015. That application is entitled "Downhole Hydraulic Jetting Assembly, and Method for Forming Mini-Lateral Boreholes." This application also claims the benefit of U.S. Provisional Patent Appl. No. 62/120,212 filed Feb. 24, 2015 of the same title.

This application is also filed as a continuation-in-part of U.S. patent application Ser. No. 14/612,538 filed Feb. 3, 2015. That application is entitled "Method of Testing a Subsurface Formation for the Presence of Hydrocarbon Fluids." That application, in turn, is a Divisional of U.S. Pat. No. 8,991,522 issued Mar. 31, 2015.

These applications are all incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completion. More specifically, the present disclosure relates to the completion and stimulation of a hydrocarbon-producing formation by the generation of small-diameter boreholes from an existing wellbore using a hydraulic jetting assembly. The present disclosure further relates to the controlled generation of multiple lateral boreholes that extend many feet into a subsurface formation, in one trip.

Discussion of Technology

In the drilling of an oil and gas well, a near-vertical wellbore is formed through the earth using a drill bit urged downwardly at a lower end of a drill string. After drilling to a predetermined bottomhole location, the drill string and bit are removed and the wellbore is lined with a string of casing. An annular area is thus formed between the string of casing and the formation penetrated by the wellbore. Particularly in a vertical wellbore, or the vertical section of a horizontal well, a cementing operation is conducted in order to fill or "squeeze" the entire annular volume with cement along part or all of the length of the wellbore. The combination of cement and casing strengthens the wellbore and facilitates the zonal isolation, and subsequent completion, of certain sections of potentially hydrocarbon-producing pay zones behind the casing.

Within the last two decades, advances in drilling technology have enabled oil and gas operators to economically "kick-off" and steer wellbore trajectories from a generally vertical orientation to a generally horizontal orientation. The horizontal "leg" of each of these wellbores now often exceeds a length of one mile. This significantly multiplies the wellbore exposure to a target hydrocarbon-bearing formation (or "pay zone"). For example, for a given target pay zone having a (vertical) thickness of 100 feet, a one mile horizontal leg exposes 52.8 times as much pay zone to a horizontal wellbore as compared to the 100-foot exposure of a conventional vertical wellbore.

FIG. 1A provides a cross-sectional view of a wellbore 4 having been completed in a horizontal orientation. It can be seen that a wellbore 4 has been formed from the earth surface 1, through numerous earth strata 2*a*, 2*b*, . . . 2*h* and down to a hydrocarbon-producing formation 3. The subsurface formation 3 represents a "pay zone" for the oil and gas operator. The wellbore 4 includes a vertical section 4*a* above the pay zone, and a horizontal section 4*c*. The horizontal section 4*c* defines a heel 4*b* and a toe 4*d* and an elongated leg there between that extends through the pay zone 3.

In connection with the completion of the wellbore 4, several strings of casing having progressively smaller outer diameters have been cemented into the wellbore 4. These include a string of surface casing 6, and may include one or more strings of intermediate casing 9, and finally, a production casing 12. (Not shown is the shallowest and largest diameter casing referred to as conductor pipe, which is a short section of pipe separate from and immediately above the surface casing.) One of the main functions of the surface casing 6 is to isolate and protect the shallower, fresh water bearing aquifers from contamination by any wellbore fluids. Accordingly, the conductor pipe and the surface casing 6 are almost always cemented 7 entirely back to the surface 1.

The process of drilling and then cementing progressively smaller strings of casing is repeated several times until the well has reached total depth. In some instances, the final string of casing 12 is a liner, that is, a string of casing that is not tied back to the surface 1. The final string of casing 12, referred to as a production casing, is also typically cemented 13 into place. In the case of a horizontal completion, the production casing 12 may be cemented, or may provide zonal isolation using external casing packers ("ECP's), swell packers, or some combination thereof.

Additional tubular bodies may be included in a well completion. These include one or more strings of production tubing placed within the production casing or liner (not shown in FIG. 1A). In a vertical well completion, each tubing string extends from the surface 1 to a designated depth proximate the production interval 3, and may be attached to a packer (not shown). The packer serves to seal off the annular space between the production tubing string and the surrounding casing 12. In a horizontal well completion, the production tubing is typically landed (with or without a packer) at or near the heel 4*b* of the wellbore 4.

In some instances, the pay zone 3 is incapable of flowing fluids to the surface 1 efficiently. When this occurs, the operator may install artificial lift equipment (not shown in FIG. 1A) as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. Gas lift valves, hydraulic jet pumps, plunger lift systems, or various other types of artificial lift equipment and techniques may also be employed to assist fluid flow to the surface 1.

As part of the completion process, a wellhead 5 is installed at the surface 1. The wellhead 5 serves to contain wellbore pressures and direct the flow of production fluids at the surface 1. Fluid gathering and processing equipment (not shown in FIG. 1A) such as pipes, valves, separators, dehydrators, gas sweetening units, and oil and water stock tanks may also be provided. Subsequent to completion of the pay zone(s) followed by installation of any requisite downhole tubulars, artificial lift equipment, and the wellhead 5, production operations may commence. Wellbore pressures are held under control, and produced wellbore fluids are segregated and distributed appropriately.

Within the United States, many wells are now drilled principally to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, "low permeability" typically refers to a rock interval having permeability less than 0.1 millidarcies.

In order to enhance the recovery of hydrocarbons, particularly in low-permeability formations, subsequent (i.e., after perforating the production casing or liner) stimulation techniques may be employed in the completion of pay zones. Such techniques include hydraulic fracturing and/or acidizing. In addition, "kick-off" wellbores may be formed from a primary wellbore in order to create one or more new directionally or horizontally completed boreholes. This allows a well to penetrate along the plane of a subsurface formation to increase exposure to the pay zone. Where the natural or hydraulically-induced fracture plane(s) of a formation is vertical, a horizontally completed wellbore allows the production casing to intersect, or "source," multiple fracture planes. Accordingly, whereas vertically oriented wellbores are typically constrained to a single hydraulically-induced fracture plane per pay zone, horizontal wellbores may be perforated and hydraulically fractured in multiple locations, or "stages," along the horizontal leg 4*c*.

FIG. 1A demonstrates a series of fracture half-planes 16 along the horizontal section 4*c* of the wellbore 4. The fracture half-planes 16 represent the orientation of fractures that will form in connection with a perforating/fracturing operation. According to principles of geo-mechanics, fracture planes will generally form in a direction that is perpendicular to the plane of least principal stress in a rock matrix. Stated more simply, in most wellbores, the rock matrix will part along vertical lines when the horizontal section of a wellbore resides below 3,000 feet, and sometimes as shallow as 1,500 feet, below the surface. In this instance, hydraulic fractures will tend to propagate from the wellbore's perforations 15 in a vertical, elliptical plane perpendicular to the plane of least principle stress. If the orientation of the least principle stress plane is known, the longitudinal axis of the leg 4*c* of a horizontal wellbore 4 is ideally oriented parallel to it such that the multiple fracture planes 16 will intersect the wellbore at-or-near orthogonal to the horizontal leg 4*c* of the wellbore, as depicted in FIG. 1A.

The desired density of perforated and fractured intervals within the pay zone 3 along the horizontal leg 4*c* is optimized by calculating:

- the estimated ultimate recovery ("EUR") of hydrocarbons each fracture will drain, which requires a computation of the Stimulated Reservoir Volume ("SRV") that each fracture treatment will connect to the wellbore via its respective perforations; less
- any overlap with the respective SRV's of bounding fracture intervals; coupled with
- the anticipated time-distribution of hydrocarbon recovery from each fracture; versus
- the incremental cost of adding another perforated/fractured interval.

The ability to replicate multiple vertical completions along a single horizontal wellbore is what has made the pursuit of hydrocarbon reserves from unconventional reservoirs, and particularly shales, economically viable within relatively recent times. This revolutionary technology has had such a profound impact that currently Baker Hughes Rig Count information for the United States indicates only about one-fourth (26%) of wells being drilled in the U.S. are classified as "Vertical", whereas the other three-fourths are classified as either "Horizontal" or "Directional" (62% and 12%, respectively). That is, horizontal wells currently comprise approximately two out of every three wells being drilled in the United States.

The additional costs in drilling and completing horizontal wells as opposed to vertical wells is not insignificant. In fact, it is not at all uncommon to see horizontal well drilling and completion ("D & C") costs top multiples (double, triple, or greater) of their vertical counterparts. Depending on the geologic basin, and particularly the geologic characteristics that govern such criteria as drilling penetration rates, required drilling mud rheology, casings design and cementation, etc., significant additional costs for drilling and completing horizontal wells include those involved in controlling the radius of curvature of the kick-off, and guidance of the bit and drilling assembly (including MWD and LWD technologies) in initially obtaining, then maintaining the preferred at-or-near horizontal trajectory of the wellbore 4 within the pay zone 3, and the overall length of the horizontal section 4*c*. The critical process of obtaining wellbore isolation between frac stages, as with additional cementing and/or ECP's, are often significant additions to the increased completion expenses, as are costs for "plug-and-perf" or sleeve or port (typically ball-drop actuated) completion systems.

In many cases, however, the greatest single cost in drilling and completing horizontal wells is the cost associated with pumping the multiple hydraulic fracture treatments themselves. It is not uncommon for the sum of the costs of a given horizontal well's hydraulic fracturing treatments to approach, or even exceed, 50% of its total drilling and completion cost.

Crucial to the economic success of any horizontal well is the achievement of satisfactory hydraulic fracture geometries within the pay zone being completed. Many factors can contribute to the success or failure in achieving the desired geometries. These include the rock properties of the pay zone, pumping constraints imposed by the wellbore's construction and/or surface pumping equipment, and characteristics of the fracturing fluids. In addition, proppants of various mesh (sieve) sizes are typically added to the fracturing mixture to maintain the hydraulic pressure-induced fracture width in a "propped open" state, thereby increasing the fracture's conductive capacity for producing hydrocarbon fluids.

Often, in order to achieve desired fracture characteristics (fracture width, fracture conductivity, and particularly, fracture half-length) within the pay zone, an overall fracture height must be created that considerably exceeds the boundaries of the pay zone. Fortunately, vertical out-of-zone fracture height growth is usually confined to a few multiples of the overall pay formation's thickness (i.e., ten's or hundreds' of feet), and thereby cannot pose a threat to contamination of much shallower fresh water sources, almost always separated from the pay zone by multiple thousands of feet of rock formations. See K. Fisher and N. Warpinski, "*Hydraulic Fracture-Height Growth: Real Data*," SPE Paper No. 145,949, SPE Annual Technical Conference and Exhibit, Denver Colo. (Oct. 30-Nov. 2, 2012).

Nevertheless, this increases the amount of fracturing fluid and proppant needed at the various "frac" stages, and further increases the required pumping horsepower. It is known that for a typical fracturing job, significant volumes of fracturing fluids, fluid additives, proppants, hydraulic ("pumping") horsepower (or, "HHP"), and their correlative costs are expended on non-productive portions of the fractures. This represents a multi-billion dollar problem each year within the U.S. alone.

Further complicating the planning of a horizontal wellbore are the uncertainties associated with fracture geometries within unconventional reservoirs. Many experts believe, based on analyses of real-time data from both tilt meter and micro-seismic surveys, that fracture geometries in less permeable, and particularly, more brittle, unconventional reservoirs can yield highly complex fracture geometries. That is, as opposed to the relatively simplistic bi-wing elliptical model perceived to fit most conventional reservoirs (and as shown in the idealistic rendition in FIG. 1A), fracture geometries in unconventional reservoirs can be frustratingly unpredictable.

In most cases, far-field fracture length and complexity is deemed detrimental (rather than beneficial) due to excessive fluid leak-off and/or reduced fracture width that can cause early screen-outs. Hence, whether fracture complexity (or, the lack thereof) enhances or reduces the SRV that the fracture network will enable the wellbore to drain is typically determined on a case-by-case (e.g., reservoir-by-reservoir) basis.

Thus, it is desirable, particularly in horizontal wellbore completions for tight reservoirs, to obtain greater control over the geometric growth of the primary fracture network extending perpendicularly outward from the horizontal leg 4*c*. It is further desirable to extend the length of the fracture network azimuth without significantly trespassing the horizontal pay zone 3 boundaries. Further, it is desirable to decrease the well density required to drain a given reservoir volume by increasing the effectiveness of the fracture network between wellbores through the use of two or more hydraulically-jetted mini-laterals along a horizontal leg. Still further, it is desirable to provide this guidance, constraint, and enhancement of SRV's by the creation of one or more mini-lateral boreholes as a replacement of conventional casing portals provided by the use of conventional completion procedures requiring perforations, sliding sleeves, and the like.

Accordingly, a need exists for a downhole assembly having a jetting hose and a whipstock, whereby the assembly can be conveyed into any wellbore interval of any inclination, including an extended horizontal leg. A need further exists for a hydraulic jetting system that provides for substantially a 90° turn of the jetting hose opposite the point of a casing exit, preferably utilizing the entire casing inner diameter as the bend radius for the jetting hose, thereby providing for the maximum possible inner diameter of jetting hose, and thus providing the maximum possible hydraulic horsepower to the jetting nozzle.

Additional needs exist that, in certain embodiments, are addressed herein. A need exists for improved methods of forming lateral wellbores using hydraulically directed forces, wherein the desired length of jetting hose can be conveyed even from a horizontal wellbore. Further, a need exists for a method of forming mini-lateral boreholes off of a horizontal leg that assist in confining subsequent SRV's up to, but not significantly beyond, pay zone boundaries. Still further, a need exists for a method by which a whipstock and jetting hose can be conveyed and operated with hydraulic and/or mechanical push forces that enable movement of the jetting nozzle and connected hose into the formation, retrieved, re-oriented and re-deployed and re-operated multiple times at as many parent wellbore depths and lateral azimuth orientations as desired, to generate multiple mini-lateral bore holes within not only vertical, but highly directional and even horizontal portions of wellbores in a single trip. A need further exists to be able to convey the jetting hose in an uncoiled state, such that the bend radius within the production casing and along the whipstock is the tightest bending constraint the hose must satisfy.

A need further exists for a method of hydraulically fracturing lateral boreholes jetted off of the horizontal leg of a wellbore immediately following lateral borehole formation, in stages, and without the need of pulling the jetting hose, whipstock, and conveyance system out of the parent wellbore. Finally, a need exists for a method of remotely controlling the erosional excavation path of the jetting nozzle and connected hydraulic hose, such that a lateral borehole, or multiple lateral boreholes can be contoured as a designed "cluster," to best control the SRV geometry resulting from stimulation treatments.

SUMMARY OF THE INVENTION

The systems and methods described herein have various benefits in the conducting of oil and gas well completion activities. A hydraulic jetting nozzle is first provided herein. In one aspect, the jetting nozzle comprises a tubular stator body forming a bore along a longitudinal axis of the nozzle, and a tubular rotor body residing within the bore of the stator body, and also forming a bore along the longitudinal axis of the nozzle. The jetting nozzle has one or more bearings residing between the rotor body and the surrounding stator body to accommodate relative rotational movement between the rotor body and the stator body. In one aspect, the nozzle is between one and three inches in length.

The jetting nozzle includes a proximal end configured to sealingly connect to an end of a jetting hose, and to receive a jetting fluid. The jetting hose is welded to or, alternatively, threadedly connected to the stator body. In this instance, the rotor body is configured to rotate, while the stator body is fixedly connected to the jetting hose. Preferably, the nozzle has an outer diameter that is equivalent to or slightly larger than an outer diameter of the jetting hose.

In addition, the jetting nozzle includes electro-magnetic coils. The coils are designed to induce the relative rotational movement between the rotor body and the stator body in response to an electrical current. Electrical wires may be provided down the jetting hose to deliver electrical power to induce the relative rotational movement.

The nozzle further comprises a discharge slot at the end of the rotor body. The discharge slot is configured to deliver the high pressure jetting fluid at a designated spray angle for erosion of a rock matrix. In one aspect, the discharge slot is a single forward slot aligned with a centerline of the rotor body. Preferably, the slot distributes the jetting fluid in a fan-shaped plane, and creates a substantially cylindrical borehole in response to the relative rotation during spraying. In another aspect, the discharge slot defines at least three slots equi-radially disposed about a centerline of the rotor body.

In one embodiment, the nozzle further includes a first set of rearward thrust jets residing within the stator body. The rearward thrust jets are configured to receive jetting fluid, and direct the jetting fluid at an angle offset from the proximal end of the stator body, thereby providing a forward propulsion force during operation. In an alternate embodiment, the nozzle also includes a second set of rearward thrust jets. The second set of rearward thrust jets resides within the rotor body and extends into the stator body. These second rearward thrust jets are also configured to receive jetting fluid, and direct the jetting fluid at an angle offset from the proximal end of the stator body, thereby providing additional forward propulsion force. The second set of rearward thrust jets is positioned such that when rotation of the rotor body brings the second set of thrust jets into momentary alignment with the first set of rearward thrust jets, a continuous thrust jet passageway is established for conducting jetting fluid from within the bore of the stator body and discharging from an exterior of the stator body. This momentary alignment thereby produces a pulsating flow through the rearward thrust jets, and thus a partially pulsating forward flow through the discharge slot.

In a preferred embodiment, the hydraulic nozzle further comprises a sleeve and a collar. The sleeve resides along the bore of the rotor body, and is configured to slide between a first position wherein the first set of rearward thrust jets (through the rotor body) is closed, and a second position wherein the first set of rearward thrust jets is open. In this embodiment, the nozzle also includes a biasing mechanism for biasing the sleeve in its closed position, with the biasing force being transferred to the sleeve by a slideable collar. The biasing mechanism may comprise a spring, a magnet, an electro-magnetic force, or combinations thereof. In one particular embodiment, the biasing mechanism comprises a spring and a collar that biases the slideable sleeve in a closed position to seal the rearward thrust jets from the flow of hydraulic jetting fluid, thereby forcing a stream of jetting fluid to entirely exit the discharge slot during operation. The biasing force of the spring is overcome by application of hydraulic pressure against a shoulder associated with the collar, such as on the sleeve, providing for its forward displacement, which results in opening access to inlets of the rearward thrust jets for the flow of jetting fluid, thereby utilizing a portion of the jetting fluid to provide a rearward thrust force to the nozzle.

In other embodiments, the slideable sleeve is either omitted entirely or else is stationary relative to longitudinal movement along the nozzle throat. In these instances, jetting fluid access to the rearward thrust jets is governed by an electromagnetic force acting upon the slideable collar independent of hydraulic forces. In these particular embodiments, the biasing force of the spring is overcome by supply of (at least) a threshold amount of current to the stator poles, thereby providing sufficient magnetic pull on the collar to open the thrust jets.

In one embodiment, the hydraulic jetting assembly includes at least one geo-spatial integrated circuitry ("IC") chip residing along the distal end of the jetting assembly, such as along the stator body of the jetting nozzle. The chip is designed to (i) measure any of geo-location, azimuth, and orientation of the hydraulic nozzle as geo-positioning (or geo-location) data, and (ii) transmit the geo-positioning data to a processor in real-time. In this embodiment, the nozzle may be part of a guidance system that includes at least three actuator wires residing at a distal end of the jetting hose and, optionally, extending up to the stator body of the jetting nozzle. The actuator wires are fabricated from a material that contracts in response to an electrical current or stimulation. Contraction of one or more wires will induce a bending moment at the distal end of the jetting assembly, thereby changing an orientation of the nozzle. In this way, an operator may control (or "steer") a direction of jetting fluid passing through the discharge slot to create a desired geo-trajectory of a borehole.

The guidance system will preferably include a processor. The processor is configured to process the geo-spatial data received from the IC chip(s) and, thus, compute the present location and/or orientation of the distal end of the jetting assembly. The processor may also correlate a present geo-location and orientation with a desired, and perhaps pre-programmed, geo-trajectory of the nozzle in a reservoir. The system will further include one or more current regulators, and power wires connecting the current regulators to the actuator wires. The power wires deliver current to corresponding actuator wires in accordance with instructions from the processor and the control by the current regulator.

The processor and the one or more current regulators together control electrical current passing to the actuator wires to cause the actuator wires to contract proportional to the amount of electrical current passing through each and, thus, to control the bending moment of the distal end of the jetting assembly. In this way, the processor, the geo-spatial IC chip, current regulator, the power wires and the actuator wires provide a guidance system for the nozzle during operation.

A guidance system for a downhole boring device is separately provided herein. The boring device is configured to excavate rock to form an elongated borehole. The boring device may be, for example, a drill bit. Alternatively, the boring device may be a hydraulic nozzle in accordance with any of the embodiments described above. In this instance, the nozzle is placed at the downstream end of a jetting hose, which is preferably at least 25 feet in length.

In one embodiment, the guidance system comprises at least three longitudinally-oriented and electrically-conductive actuator wires. Each of the actuator wires is secured to a body of the boring device, with the actuator wires being spaced equi-distantly about a circumference of the boring device. In addition, each of the actuator wires is configured to contract in proportion to an amount of electrical current sent through the respective wires such that a differing amount of electrical current directed through one or more of the actuator wires will induce a bending moment at the body of the boring device. This bending moment re-orients a distal end of the boring device and thereby changes its geo-trajectory during operation downhole.

In one aspect, the boring device is a hydraulic nozzle having a forward discharge port. The body of the hydraulic nozzle comprises a tubular stator body, and a tubular rotor body residing within the bore of the stator body, and forming a bore along the longitudinal axis of the nozzle. The hydraulic nozzle further comprises one or more bearings residing between the rotor body and the surrounding stator body to accommodate relative rotational movement between the rotor body and the stator body. Magnetized stator poles spaced equi-distant about the stator body's axial cross-section, by the magnetic attraction to rotor poles (typically fewer in number than the stator poles) spaced equi-distant about the rotor's axial cross-section, encourage the relative rotation between the rotor and the stator, as in the configuration of a direct drive electric motor. The magnetic force emanating from the stator poles may in fact be an electro-magnetic force, provided by wrapping each stator pole with multiple rounds of an electrical wire. Thus, the nozzle may additionally include electro-magnetic coils designed to induce the relative rotational movement between the rotor body and the stator body in response to electrical current.

The hydraulic nozzle will have a proximal end configured to sealingly connect to an end of a jetting hose, and to receive a jetting fluid. The nozzle will also have at least one discharge slot at the end of the rotor body configured to deliver high pressure jetting fluid for erosion of a rock matrix.

The guidance system may include an electrical power wire associated with each of the at least three actuator wires. Each power wire is configured to deliver current to its associated actuator wire. Each of the power wires preferably resides along a chamber or sheath within the jetting hose, or may be interwoven within the matrix thereof. The distal end of each power wire is in electrical communication with, and may be affixedly connected, to the proximal end of a corresponding actuator wire. Likewise, each actuator wire resides along a chamber or sheath within the jetting hose, or may be interwoven within the matrix thereof, and may extend up to, or even partially within the jetting nozzle.

The guidance system may also include one or more fiber optic wires. Each fiber optic wire is configured to deliver data and/or command signals within the guidance system. Each of the fiber optic wires preferably resides along a chamber or sheath within the jetting hose, or may be interwoven within the matrix thereof. The distal end of a fiber optic wire may connect a geo-spatial IC chip with a micro-transmitter at its proximal end.

The guidance system may also include a battery pack for generating the electrical current downhole, and a micro-processor and current regulators for distributing the current according to a determined geo-trajectory for the borehole. The guidance system may also have a geo-location tool associated with one or more geo-spatial chips disposed on the body of the boring device. The geo-spatial chip is configured to transmit geo-location data signals back through the electrical or data wires.

Preferably, the guidance system is part of a hydraulic downhole jetting system that may be run into a parent wellbore, and then operated to form multiple lateral boreholes at different trajectories and at different locations in a single completion trip. As described below, the assembly will include a whipstock member having an arcuate face. The assembly is configured to (i) translate the jetting hose out of a jetting hose carrier and against the whipstock face by a translation force to a desired point of wellbore exit, (ii) upon reaching the desired point of wellbore exit, direct jetting fluid through the jetting hose and the connected jetting nozzle until an exit is formed, (iii) continue jetting along an operator's designed geo-trajectory forming a lateral borehole into the rock matrix within the pay zone, and then (iv) pull the jetting hose back into the jetting hose carrier after a lateral borehole has been formed.

A steerable borehole excavation apparatus is also provided herein. In one embodiment, the apparatus comprises a flexible tubular body that is dimensioned to transmit a jetting fluid along a bore. The body has a proximal (or upstream) end and a distal (or downstream) end. The apparatus also includes a boring device disposed at the distal end of the tubular body. The boring device is configured to excavate a rock matrix in an earth strata as a borehole in response to transmission of the jetting fluid. Preferably, the tubular body is a jetting hose and the boring device is a jetting nozzle in any of the embodiments described herein.

A geo-spatial IC chip resides along the tubular body. The geo-spatial chip provides geo-location data representing location, azimuth, orientation, or combinations thereof, of the longitudinal axis of the tubular body. A set of data wires or cables configured to transmit the geo-location data from the geo-spatial chip to (i) an operator at the surface, (ii) a micro-processer along a wellbore, or (iii) both is also provided.

The apparatus will also have a set of power (or electrical transmission) wires, and a set of actuator wires. Each actuator wire resides at a distal end of a corresponding power wire, and is secured along a body of the boring device. In addition, each actuator wire is configured to contract in proportion to an electrical current delivered through the corresponding power wire, imparting to the body of the boring device a bending moment in response to an unequal distribution of current through the power wires.

In one embodiment, the actuator wires comprise at least three wires fabricated from a material comprising nickel and titanium. The apparatus then further comprises current regulators configured to regulate current through each of the power wires to the actuator wires.

Preferably, the jetting hose is at least 25 feet in length. The jetting hose resides within an elongated tubular jetting hose carrier during run-in. The jetting hose carrier is dimensioned to slidably receive the jetting hose, and forms a micro-annulus between the jetting hose and the surrounding jetting hose carrier. The micro-annulus is sized to prevent buckling of the jetting hose as it slides within the jetting hose carrier during operation of the apparatus.

In this instance, the steerable borehole excavation apparatus further comprises:

- an upper seal assembly connected to the jetting hose at an upper end and sealing the micro-annulus;
- a jetting hose pack-off section connected to an inner diameter of the inner conduit and sealing the micro-annulus proximate a lower end of the inner conduit, and slidably receiving the jetting hose; and
- a main control valve being movable between a first position and a second position, wherein in the first position the main control valve directs jetting fluids pumped into the wellbore into the jetting hose, and in the second position the main control valve directs hydraulic fluid pumped into the wellbore into an annular region formed between the jetting hose carrier and a surrounding elongated outer conduit.

The steerable borehole excavation apparatus may further comprise a pressure regulator valve. The pressure regulator valve is placed along the micro-annulus, preferably near its distal end, and controls fluid pressure within the micro-annulus. In this instance, placement of the main control valve in its first position allows an operator to pump jetting fluids through the main control valve and against the upper seal assembly in the micro-annulus, thereby pistonly pushing the jetting hose and connected nozzle downhole in an uncoiled state while directing jetting fluids through the nozzle, and causing hydraulic fluids to exit from the micro-annulus and through the pressure regulator valve. In addition, placement of the main control valve in its second position allows an operator to pump hydraulic fluids through the main control valve, into the annular region between the jetting hose carrier and the surrounding outer conduit, through the pressure regulator valve and into the micro-annulus, thereby pulling the jetting hose back up into the inner conduit in its uncoiled state.

The steerable borehole excavation apparatus herein is able to generate lateral bore holes in excess of 10 feet, or in excess of 25 feet, and even in excess of 300 feet. The boreholes may have a diameter of about 1.0" or greater. The mini-laterals may be formed at penetration rates much higher than any of the systems that have preceded it that have in common completing a 90° turn of the jetting hose within the production casing. The present system will have access to generate mini-laterals from portions of horizontal and highly directional parent wellbores heretofore thought unreachable. Anywhere to which conventional coiled tubing can be tractored within a cased wellbore, mini-laterals can now be hydraulically jetted. Similarly, superior efficiencies will be captured as multiple intervals of lateral bore holes are formed from a single trip. The entire horizontal leg of a newly drilled well may be "perforated and fractured" without need of frac plugs, sliding sleeves or dropped balls.

Given the system's ability to controllably "steer" a jetting nozzle and thereby contour the path of a mini-lateral borehole (or, "clusters" of mini-lateral boreholes), subsequent stimulation treatments can be more optimally "guided" and constrained within a pay zone. Coupled with real-time feedback of actual stimulation (particularly, frac) stage geometry and resultant SRV (as from micro-seismic, tiltmeter, and/or ambient micro-seismic surveys), subsequent mini-lateral boreholes can be custom contoured to better direct each stimulation stage prior to pumping.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 3B-1.*a* is an axial, cross-sectional view of the internal system of FIG. 3 taken at the top of the bottom end cap of the battery pack section.

FIG. 3B-1.*b* is an axial, cross-sectional view of the internal system of FIG. 3 taken at the top of the jetting fluid inlet.

FIG. 3D-1 presents a cross-sectional view of a bundled jetting hose, with electrical wiring and data cabling, as may be used in the internal system of FIG. 3.

FIG. 3D-1*a* is an axial, cross-sectional view of the bundled jetting hose of FIG. 3D-1. Both electrical wires and fiber optical (or data) cables are seen.

FIGS. 3F-1*a* through 3G-1*c* present enlarged, cross-sectional views of the jetting nozzle of FIG. 3E, in various embodiments.

FIG. 3F-1*a* is an axial, cross-sectional view showing a basic nozzle body. The nozzle body includes a rotor and a surrounding stator.

FIG. 3F-1*b* is a longitudinal, cross-sectional view of a jetting nozzle, taken across line C-C' of FIG. 3F-1*a*. Here, the nozzle uses a single discharge slot at the tip of the rotor. The nozzle also includes bearings between the rotor and the surrounding stator.

FIG. 3F-1*c* is a longitudinal cross-sectional view of the jetting nozzle of FIG. 3F-1*b*, in a modified embodiment. Here, the jetting nozzle includes a geo-spatial chip, and is shown connected to a jetting hose.

FIG. 3F-1*d* is an axial-cross-sectional view of the jetting hose of FIG. 3F-1*c*, taken across line c-c'.

FIGS. 3F-2*a* and 3F-2*b* present longitudinal, cross-sectional views of the nozzle of FIG. 3E, in an alternate embodiment. Along with a single discharge slot at the tip of the rotor, five rearward thrust jets are placed in the body of the stator, actuated by forward displacement of a slideable nozzle throat sleeve against a slideable collar and biasing mechanism.

In FIG. 3F-2*a*, the sleeve and collar are in their closed position. In FIG. 3F-2*b*, the sleeve and collar are in their open position allowing fluid to flow through the rearward thrust jets. The jets are opened when a sufficient pumping pressure overcomes the resistance of a spring.

FIG. 3F-2*c* is an axial, cross-sectional view of the nozzle of FIG. 3F-2*a*. Five rearward thrust jets are shown for generating a rearward thrust force.

FIGS. 3F-3*a* and 3F-3*c* provide longitudinal, cross-sectional views of the jetting nozzle of FIG. 3E, in another alternate embodiment. Here, multiple rearward thrust jets residing in both the stator body and the rotor body are used. In this arrangement, an electromagnetic force pulling on a magnetic collar, biased by a spring, is used for opening/closing the rearward thrust jets.

In FIG. 3F-3*a*, the collar of the jetting nozzle is in its closed position. In FIG. 3F-2*b*, the collar is in its open position allowing fluid to flow through the rearward thrust jets.

FIGS. 3F-3*b* and 3F-3*d* show axial, cross-sectional views of the jetting nozzle correlative to FIGS. 3F-3*a* and 3F-3*c*, respectively. Eight rearward thrust jets are seen. This embodiment provides for intermittent alignment of the four jetting ports in the rotor with either of the two sets of four jetting ports in the stator to produce a pulsating rearward thrust flow.

FIG. 3G-1*a* is an axial, cross-sectional view showing a basic collar body for a jetting collar that can be placed within a length of jetting hose. The collar body again includes a rotor and a surrounding stator. The view is taken across line D-D' of FIG. 3G-1*b*.

FIG. 3G-1*b* is a longitudinal, cross-sectional view of the jetting collar of FIG. 3G-1*a*. As with the jetting nozzle of FIGS. 3F-3*a* through 3F-3*d*, two sets of four jetting ports in the stator intermittently align with the four jetting ports in the rotor to produce pulsating rearward thrust flow.

FIG. 3G-1*c* is an axial, cross-sectional view of the jetting nozzle of FIG. 3G-1*b*, taken across line d-d'.

FIG. 4A-1. is an enlarged, longitudinal cross-sectional view of a portion of a bundled coiled tubing conveyance medium which conveys the external system of FIG. 4 into and out of the wellbore.

FIG. 4A-1*a* is an axial, cross-sectional view of the coiled tubing conveyance medium of FIG. 4A-1. In this embodiment, an inner coiled tubing is "bundled" concentrically with both electrical wires and data cables within a protective outer layer.

FIGS. 4A-2 is another axial, cross-sectional view of the coiled tubing conveyance medium of FIG. 4A-1*a*, but in a different embodiment. Here, the inner coiled tubing is "bundled" eccentrically within the protective outer layer to provide more evenly-spaced protection of the electrical wires and data cables.

FIG. 4B-1 is a longitudinal, cross-sectional view of a crossover connection, which is the upper-most member of the external system of FIG. 4. The crossover section is configured to join the coiled tubing conveyance medium of FIG. 4A-1 to a main control valve.

FIG. 4B-1*a* is an enlarged, perspective view of the crossover connection of FIG. 4B-1, seen between cross-sections E-E' and F-F'. This view highlights the wiring chamber's general transition in cross-sectional shape from circular to elliptical.

FIG. 4C-1 is a longitudinal, cross-sectional view of the main control valve of the external system of FIG. 4.

FIG. 4C-1*a* is a cross-sectional view of the main control valve, taken across line G-G' of FIG. 4C-1.

FIG. 4C-1*b* is a perspective view of a sealing passage cover of the main control valve, shown exploded away from FIG. 4C-1*a*.

FIG. 4D-1 is a longitudinal, cross-sectional view of a jetting hose carrier section of the external system of FIG. 4. The jetting hose carrier section is attached downstream of the main control valve.

FIG. 4D-1*a* shows an axial, cross-sectional view of the main body of the jetting hose carrier section, taken along line H-H' of FIG. 4D-1.

FIG. 4D-1*b* is an enlarged view of a portion of the jetting hose carrier section of FIG. 4D.1. A docking station of the external system is more clearly seen.

FIG. 4D-2 is an enlarged, longitudinal, cross-sectional view of the external system's jetting hose carrier section of FIG. 4D-1, with inclusion of the jetting hose of the internal system from FIG. 3.

FIG. 4D-2*a* provides an axial, cross-sectional view of the jetting hose carrier section of FIG. 4D-1, with the jetting hose residing therein.

FIG. 4E-1 is a longitudinal, cross-sectional view of selected portions of the external system of FIG. 4. Visible are a jetting hose pack-off section, and an outer body transition from the preceding circular body (I-I') of the jetting hose carrier section to a star-shaped body (J-J') of the jetting hose pack-off section FIG. 4E-1*a* is an enlarged, perspective view of the transition between lines I-I' and J-J' of FIG. 4E-1.

FIG. 4E-2 shows an enlarged view of a portion of the jetting hose pack-off section. Internal seals of the pack-off section conform to the outer circumference of the jetting hose (FIG. 3) residing therein. A pressure regulator valve is shown schematically adjacent the pack-off section.

FIG. 4F-1 is a further downstream longitudinal, cross-sectional view of the external system of FIG. 4. The jetting hose pack-off section and the outer body transition from FIG. 4E-1 are again shown. Also visible here is an internal tractor system. Note each of the aforementioned components are shown with a longitudinal cross-sectional view of the jetting hose of FIG. 3 residing therein.

FIG. 4F-2 is an enlarged, longitudinal, cross-sectional view of a portion of the internal tractor system of FIG. 4-F1, again with a cross-section of the jetting hose residing therein. An internal motor, gear and gripper assembly is also shown.

FIG. 4F-2*a* is an axial, cross-sectional view of the internal tractor system of FIG. 4F-2, taken across line K-K' of FIGS. 4F-1 and 4F-2.

FIG. 4F-2*b* is an enlarged half-view of a portion of the internal tractor system of FIG. 4F-2*a*.

FIG. 4G-1 is still a further downstream longitudinal, cross-sectional view of the external system of FIG. 4. This view shows a transition from the internal tractor to an upper swivel, followed by the upper swivel of the external system.

FIG. 4G-1*a* depicts a perspective view of the outer body transition between the internal tractor system to the upper swivel. This is a star-shape (L-L') to a circle-shape (M-M') transition of the outer body.

FIG. 4G-1*b* provides an axial, cross-sectional view of the upper swivel of FIG. 4-G1, taken across line N-N'.

FIG. 4H-1 is a cross-sectional view of a whipstock member of the external system of FIG. 4, but shown vertically instead of horizontally. The jetting hose of the internal system (FIG. 3) is shown bending across the whipstock, and extending through a window in the production casing. The jetting nozzle of the internal system is shown affixed to the distal end of the jetting hose.

FIG. 4H-1*a* is an axial, cross-sectional view of the whipstock member, with a perspective view of sequential axial jetting hose cross-sections depicting its path downstream from the center of the whipstock member at line O-O' to the start of the jetting hose's bend radius as it approaches line P-P'.

FIG. 4H-1*b* depicts an axial, cross-sectional view of the whipstock member at line P-P'.

FIG. 4I-1 is a longitudinal, cross-sectional view of a bottom swivel within the external system of FIG. 4, residing just downstream of slips (shown engaging the surrounding production casing) near the base of the preceding whipstock member.

FIG. 4I-1*a* provides an axial, cross-sectional view of a portion of the bottom swivel of FIG. 4I-1, taken across line Q-Q'.

DETAILED DESCRIPTION OF CERTAIN EMBODIMENTS

Definitions

Figure 1A:
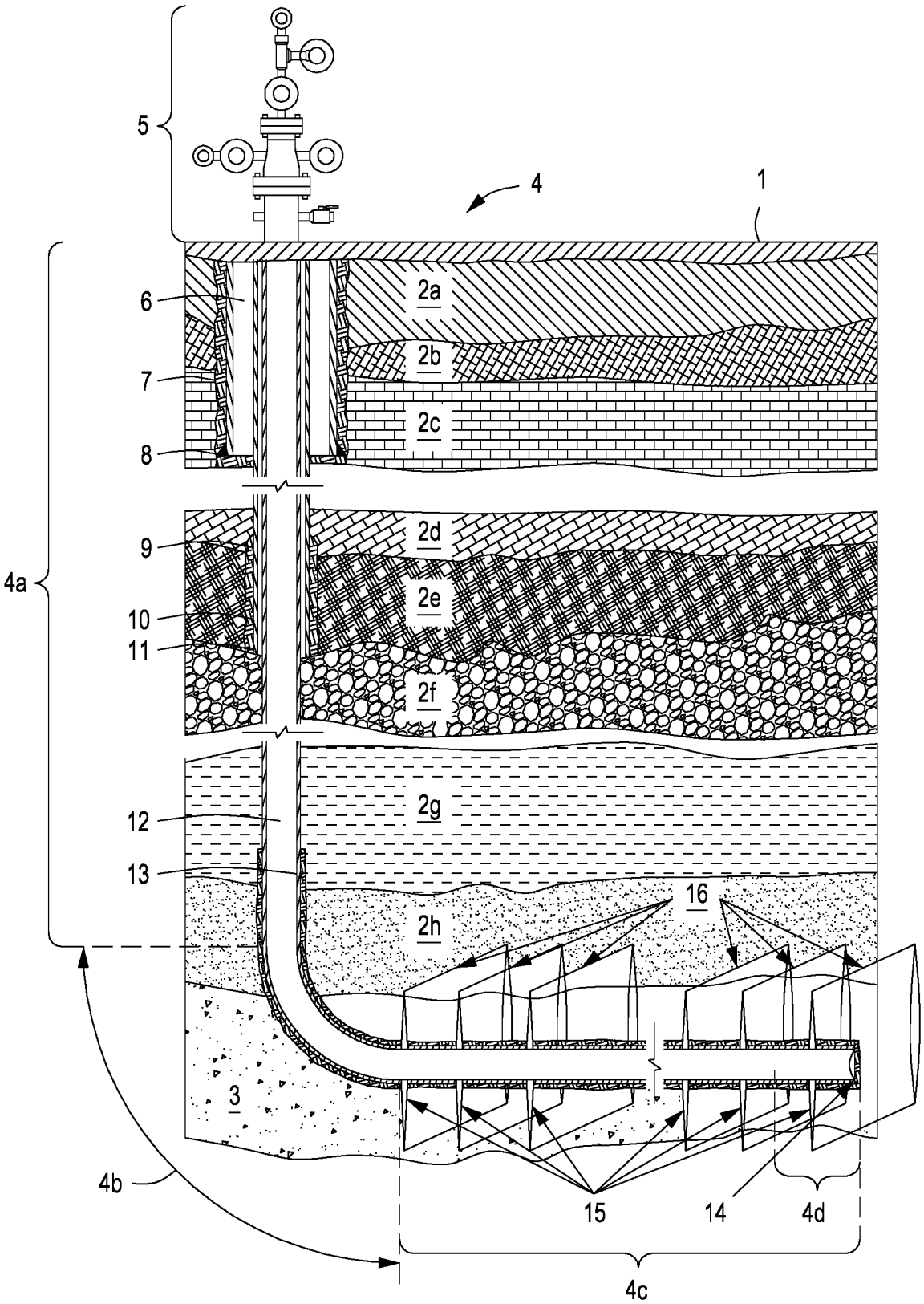
FIG. 1A is a cross-sectional view of an illustrative horizontal wellbore. Half-fracture planes are shown in 3-D along a horizontal leg of the wellbore to illustrate fracture stages and fracture orientation relative to a subsurface formation.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, condensate, coal bed methane, shale oil, shale gas, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The term "jetting fluid" refers to any fluid pumped through a jetting hose and nozzle assembly for the purpose of erosionally boring a lateral borehole from an existing parent wellbore. The jetting fluid may or may not contain an abrasive material.

The term "abrasive material" or "abrasives" refers to small, solid particles mixed with or suspended in the jetting fluid to enhance erosional penetration of: (1) the pay zone; and/or (2) the cement sheath between the production casing and pay zone; and/or (3) the wall of the production casing at the point of desired casing exit.

The terms "tubular" or "tubular member" refer to any pipe, such as a joint of casing, a portion of a liner, a joint of tubing, a pup joint, or coiled tubing.

The terms "lateral borehole" or "mini-lateral" or "ultra-deep perforation" ("UDP") refer to the resultant borehole in a subsurface formation, typically upon exiting a production casing and its surrounding cement sheath in a parent wellbore, with said borehole formed in a known or prospective pay zone. For the purposes herein, a UDP is formed as a result of hydraulic jetting forces erosionally boring through the pay zone with a jetting fluid directed through a jetting hose and out a jetting nozzle affixed to the terminal end of the jetting hose. Preferably, each UDP will have a substantially normal trajectory relative to the parent wellbore.

The terms "steerable" or "guidable", as applied to a hydraulic jetting assembly, refers to a portion of the jetting assembly (typically, the jetting nozzle and/or the portion of jetting hose immediately proximal the nozzle) for which an operator can direct and control its geo-spatial orientation while the jetting assembly is in operation. This ability to direct, and subsequently re-direct the orientation of the jetting assembly during the course of erosional excavation can yield UDP's with directional components in one, two, or three dimensions, as desired.

The terms "perforation cluster" or "UDP cluster" refer to a designed grouping of lateral boreholes off a parent well casing. These groupings are ideally designed to receive and transmit a specific "stage" of a stimulation treatment, usually in the course of completing or recompleting a horizontal well by hydraulic fracturing (or "fracking").

The term "stage" references a discreet portion of a stimulation treatment applied in completing or recompleting a specific pay zone, or specific portion of a pay zone. In the case of a cased horizontal parent wellbore, up to 10, 20, 50 or more stages may be applied to their respective perforation (or UDP) clusters. Typically, this requires some form of zonal isolation prior to pumping each stage.

The terms "contour" or "contouring" as applied to individual UDP's, or groupings of UDP's in a "cluster", refers to steerably excavating the UDP (or lateral borehole) so as to optimally receive, direct, and control stimulation fluids, or fluids and proppants, of a given stimulation (typically, fracking) stage. This ability to '. . . optimally receive, direct, and control . . . ' a given stage's stimulation fluids is designed to retain the resultant stimulation geometry "in zone", and/or concentrate the stimulation effects where desired. The result is to optimize, and typically maximize, the Stimulated Reservoir Volume ("SRV").

The terms "real time" or "real time analysis" of geophysical data (such as micro-seismic, tiltmeter, and or ambient micro-seismic data) that is obtained during the course of pumping a stage of a stimulation (such as fracking) treatment means that results of said data analysis can be applied to: (1) altering the remaining portion of the stimulation treatment (yet to be pumped) in its pump rates, treating pressures, fluid rheology, and proppant concentration in order to optimize the benefits therefrom; and, (2) optimizing the placement of perforations, or contouring the trajectories of UDP's, within the subsequent "cluster(s)" to optimize the SRV obtained from the subsequent stimulation stages.

DESCRIPTION OF SPECIFIC EMBODIMENTS

A downhole hydraulic jetting assembly is provided herein. The jetting assembly is designed to direct a jetting nozzle and connected hydraulic hose through a window formed along a string of production casing, and then "jet" one or more boreholes outwardly into a subsurface formation. The lateral boreholes essentially represent ultra-deep perforations that are formed by using hydraulic forces directed through a flexible, high pressure jetting hose, having affixed to its distal end a high pressure jetting nozzle. The subject assembly capitalizes on a single hose and nozzle apparatus to continuously jet, optionally, both a casing exit and the subsequent lateral borehole.

FIG. 1A is a schematic depiction of a horizontal well 4, with wellhead 5 located above the earth's surface 1, and penetrating several series of subsurface strata 2*a* through 2*h* before reaching a pay zone 3. The horizontal section 4*c* of the wellbore 4 is depicted between a "heel" 4*b* and a "toe" 4*d*. Surface casing 6 is shown as cemented 7 fully from the surface casing shoe 8 back to surface 1, while the intermediate casing string 9 is only partially cemented 10 from its shoe 11. Similarly, production casing string 12 is only partially cemented 13 from its casing shoe 14, though sufficiently isolating the pay zone 3. Note how in the FIG. 1A depiction of a typical horizontal wellbore, conventional perforations 15 within the production casing 12 are shown in up-and-down pairs, and are depicted with subsequent hydraulic fracture half-planes (or, "frac wings") 16.

Figure 1B:
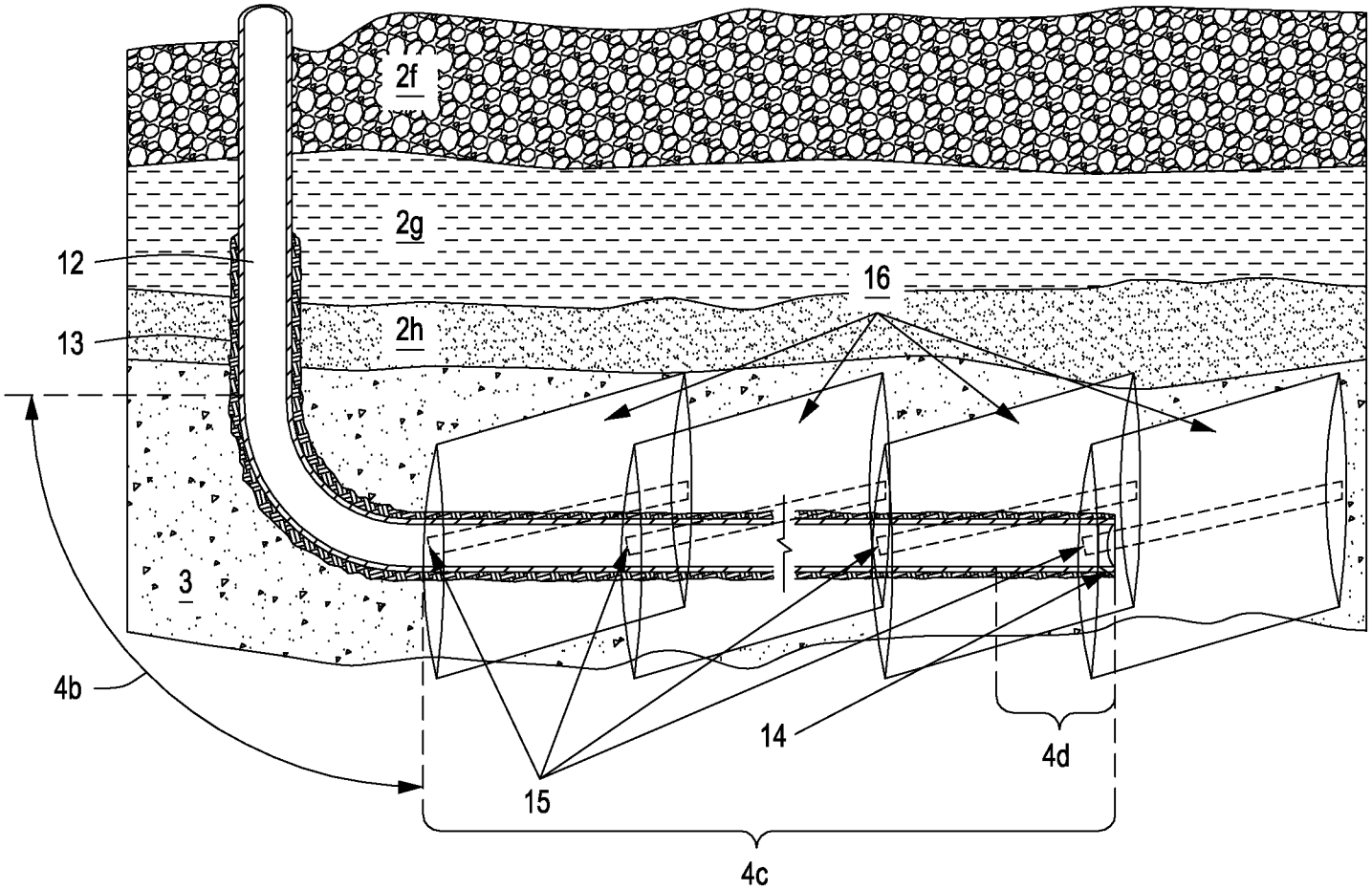
FIG. 1B is an enlarged view of the horizontal portion of the wellbore of FIG. 1A. Conventional perforations are replaced by ultra-deep perforations, or mini-lateral boreholes, to create fracture wings.

FIG. 1B is an enlarged view of the lower portion of the wellbore 4 of FIG. 1A. Here, the horizontal section 4*c* between the heel 4*b* and the toe 4*d* is more clearly seen. In this depiction, application of the subject apparati and methods herein replaces the conventional perforations (15 in FIG. 1A) with pairs of opposing horizontal UDP's 15 as depicted in FIG. 1B, again with subsequently generated fracture half-planes 16. Specifically depicted in FIG. 1B is how the frac wings 16 are now better confined within the pay zone 3, while reaching much further out from the horizontal wellbore 4*c* into the pay zone 3. Stated another way, in-zone fracture propagation is significantly enhanced by the pre-existence of the UDP's 15 as generated by the assembly and methods disclosed herein.

Figure 2:
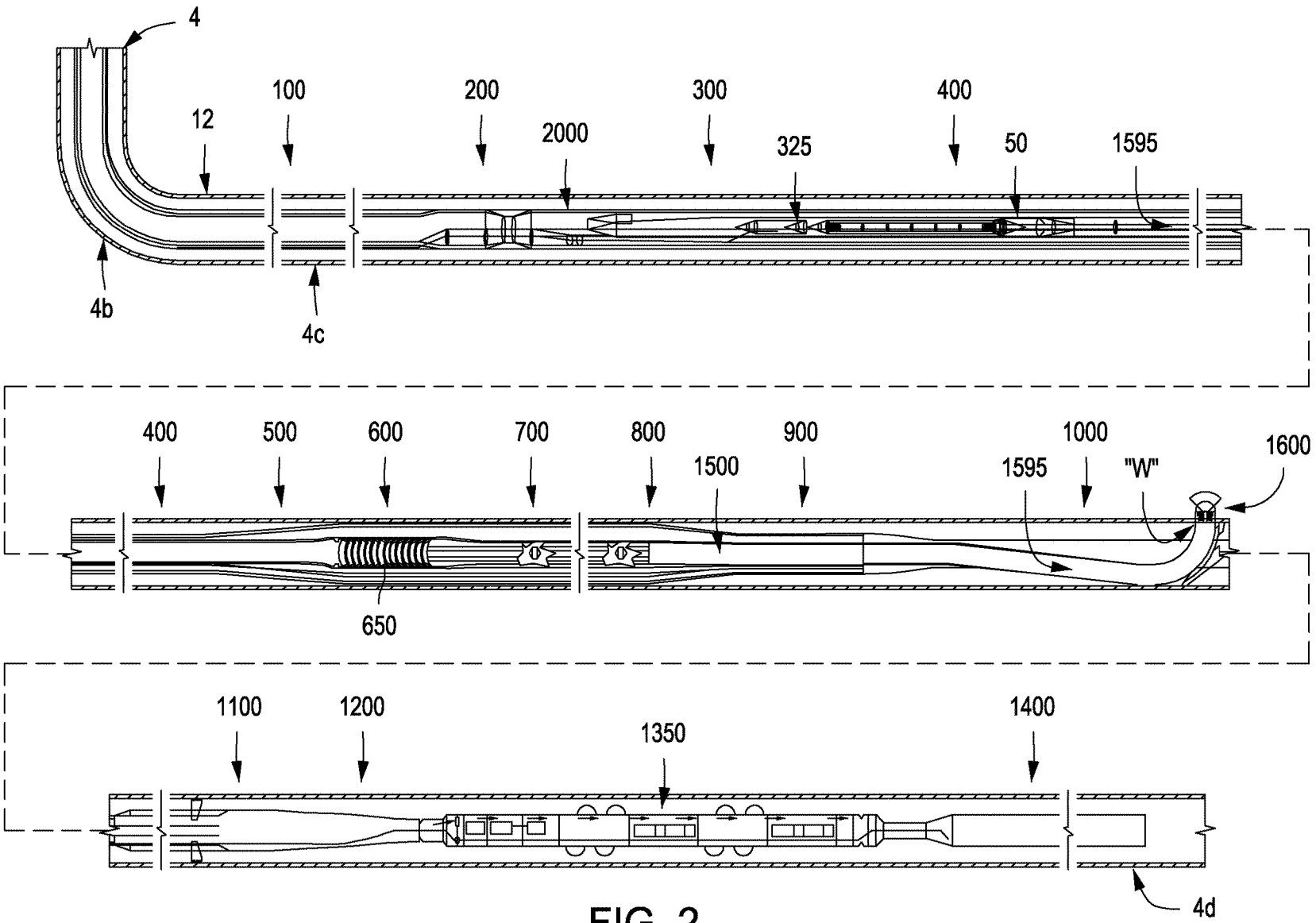
FIG. 2 is a longitudinal, cross-sectional view of a downhole hydraulic jetting assembly of the present invention, in one embodiment. The assembly is shown within a horizontal section of a production casing. The jetting assembly has an external system and an internal system.

FIG. 2 provides a longitudinal, cross-sectional view of a downhole hydraulic jetting assembly 50 of the present invention, in one embodiment. The jetting assembly 50 is shown residing within a string of production casing 12. The production casing 12 may have, for example, a 4.5-inch O.D. (4.0-inch I.D.). The production casing 12 is presented along a horizontal portion 4*c* of the wellbore 4. As noted in connection with FIGS. 1A and 1B, the horizontal portion 4*c* defines a heel 4*b* and a toe 4*d*.

The jetting assembly 50 generally includes an internal system 1500 and an external system 2000. The jetting assembly 50 is designed to be run into a wellbore 4 at the end of a working string, sometimes referred to herein as a "conveyance medium." Preferably, the working string is a string of coiled tubing 100. The conveyance medium 100 may be conventional coiled tubing. Alternatively, a "bundled" product that incorporates electrically conductive wiring and data conductive cables (such as fiber optic cables) around the coiled tubing core, protected by an erosion/abrasion resistant outer layer(s), such as PFE and/or Kevlar, or even another (outer) string of coiled tubing may be used. It is observed that fiber optic cables have a practically negligible diameter, and are oilfield-proven to be efficient in providing direct, real-time data transmission and communications with downhole tools. Other emerging transmission media such as carbon nanotube fibers may also be employed.

Other conveyance media may be used for the jetting assembly 50. These include, for example, a standard e-coil system, a customized FlatPAK® assembly, PUMPTEK's® Flexible Steel Polymer Tubing ("FSPT") or Flexible Tubing Cable ("FTC") tubing. Alternatively, tubing have PTFE (Polytetrafluorethylene) and Kevlar®-based materials, or Draka Cableteq USA, Inc.'s® Tubing Encapsulated Cable ("TEC") system may be used. In any instance, it is desirable that the conveyance medium 100 be flexible, somewhat malleable, non-conductive, pressure resistant (to withstand high pressure fracturing fluids optionally being pumped down the annulus), temperature resistant (to withstand bottom hole wellbore operating temperatures, often in excess of 200° F., and sometimes exceeding 300° F.), chemical resistant (at least in resistance to the additives included in the frac fluids), friction resistant (to minimize the downhole pressure loss due to friction while pumping the frac treatment), erosion resistant (to withstand the erosive effects of aforementioned annular fracturing fluids) and abrasion resistant (to withstand the abrasive effects of proppants suspended in the aforementioned annular fracturing fluids).

If a standard coiled tubing string is employed, communications and data transmission may be accomplished by hydro-pulse technology (or so-called mud-pulse telemetry), acoustic telemetry, EM telemetry, or some other remote transmission/reception system. Similarly, electricity for operating the apparatus may be generated downhole by a conventional mud motor(s), which would allow the electrical circuitry for the system to be confined below the end of the coiled tubing. The present hydraulic jetting assembly 50 is not limited by the data transmission system or the power transmission or the conveyance medium employed unless expressly so stated in the claims.

It is preferred to maintain an outer diameter of the coiled tubing 100 that leaves an annular area within the approximate 4.0" I.D. of the casing 12 that is greater than or equal to the cross-sectional area open to flow for a 3.5" O.D. frac (tubing) string. This is because, in the preferred method (after jetting one or more, preferably two opposing mini-laterals, or even specially contoured "clusters" of small-diameter lateral boreholes), fracture stimulation can immediately (after repositioning the tool string slightly uphole) take place down the annulus between the coiled tubing conveyance medium 100 plus the external system 2000, and the well casing 12. For 9.2#, 3.5" O.D. tubing (i.e., frac string equivalent), the I.D. is 2.992 inches, and the cross-sectional area open to flow is 7.0309 square inches. Back-calculating from this same 7.0309 $in^2$ equivalency yields a maximum O.D. available for both the coiled tubing conveyance medium 100 and the external system 2000 (having generally circular cross-sections) of 2.655". Of course, a smaller O.D. for either may be used provided such accommodate a jetting hose 1595.

In the view of FIG. 2, the assembly 50 is in an operating position, with a jetting hose 1595 being run through a whipstock 1000, and a jetting nozzle 1600 passing through a first window "W" of the production casing 12. At the end of the jetting assembly 50, and below the whipstock 1000, are several optional components. These include a conventional mud motor 1300, an external (conventional) tractor 1350 and a logging sonde 1400. These components are shown and described more fully below in connection with FIG. 4.

Figure 3:
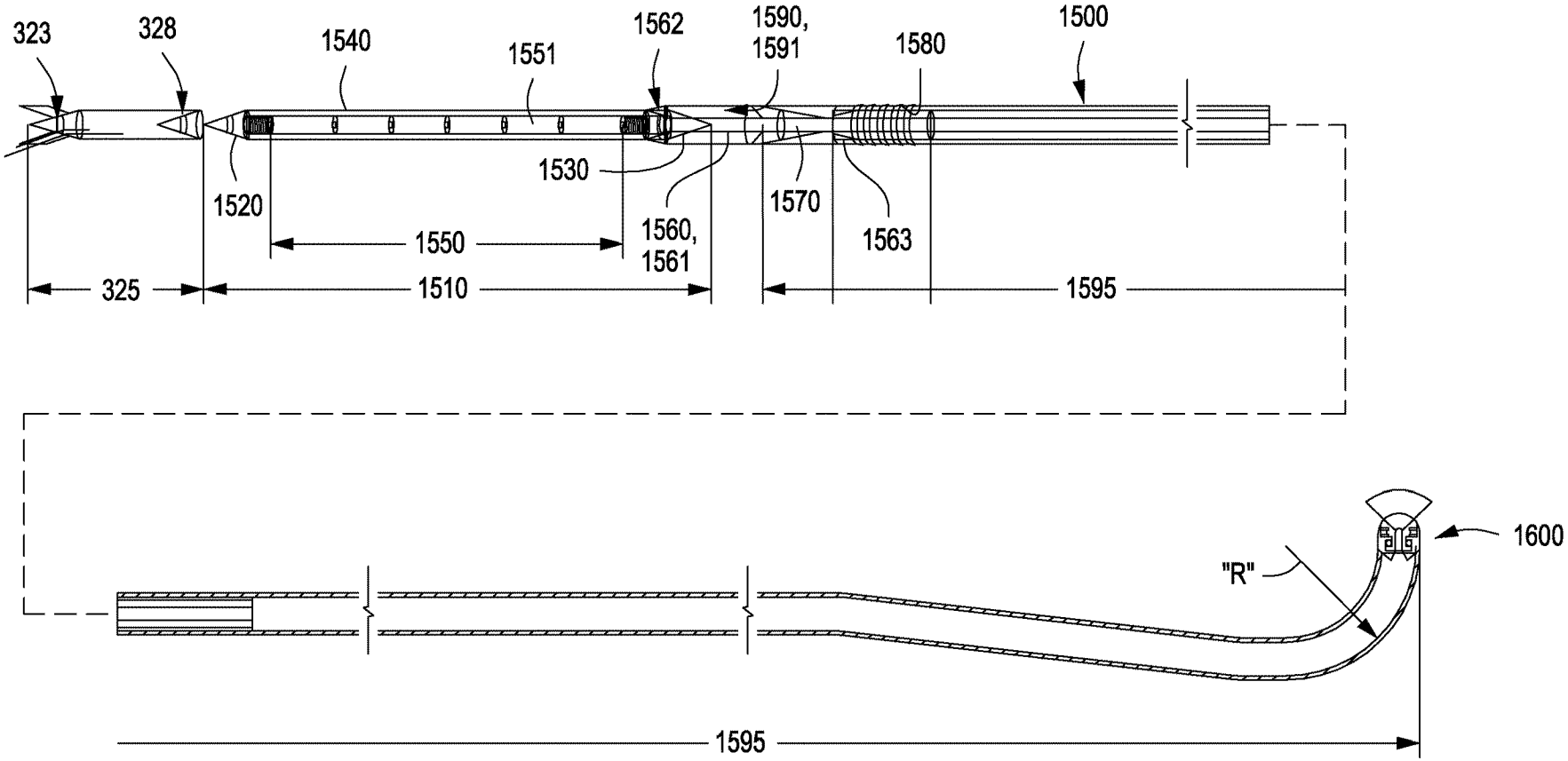
FIG. 3 is a longitudinal, cross-sectional view of the internal system of the hydraulic jetting assembly of FIG. 2. The internal system extends from an upstream battery pack end cap (that mates with the external system's docking station) at its proximal end to an elongated hose having a jetting nozzle at its distal end.

FIG. 3 is a longitudinal, cross-sectional view of the internal system 1500 of the hydraulic jetting assembly 50 of FIG. 2. The internal system 1500 is a steerable system that, when in operation, is able to move within and extend out of the external system 2000. The internal system 1500 is comprised primarily of:

(1) power and geo-control components;
(2) a jetting fluid intake;
(3) the jetting hose 1595; and
(4) the jetting nozzle 1600.

The internal system 1500 is designed to be housed within the external system 2000 while being conveyed by the coiled tubing conveyance medium 100 and the attached external system 2000 in to and out of the parent wellbore 4. Extension of the internal system 1500 from and retraction back into the external system 2000 is accomplished by the application of: (a) hydraulic forces; (b) mechanical forces; or (c) a combination of hydraulic and mechanical forces. Beneficial to the design of the internal 1500 and external 2000 systems comprising the hydraulic jetting apparatus 50 is that transport, deployment, or retraction of the jetting hose 1595 never requires the jetting hose to be coiled. Specifically, the jetting hose 1595 is never subjected to a bend radius smaller than the I.D. of production casing 12, and that only incrementally while being advanced along the whipstock 1050 of the jetting hose whipstock member 1000 of the external system 2000. Note the jetting hose 1595 is typically ¼th" to ⅝ths" I.D., and up to approximately 1" O.D., flexible tubing that is capable of withstanding high internal pressures.

Figure 3A:
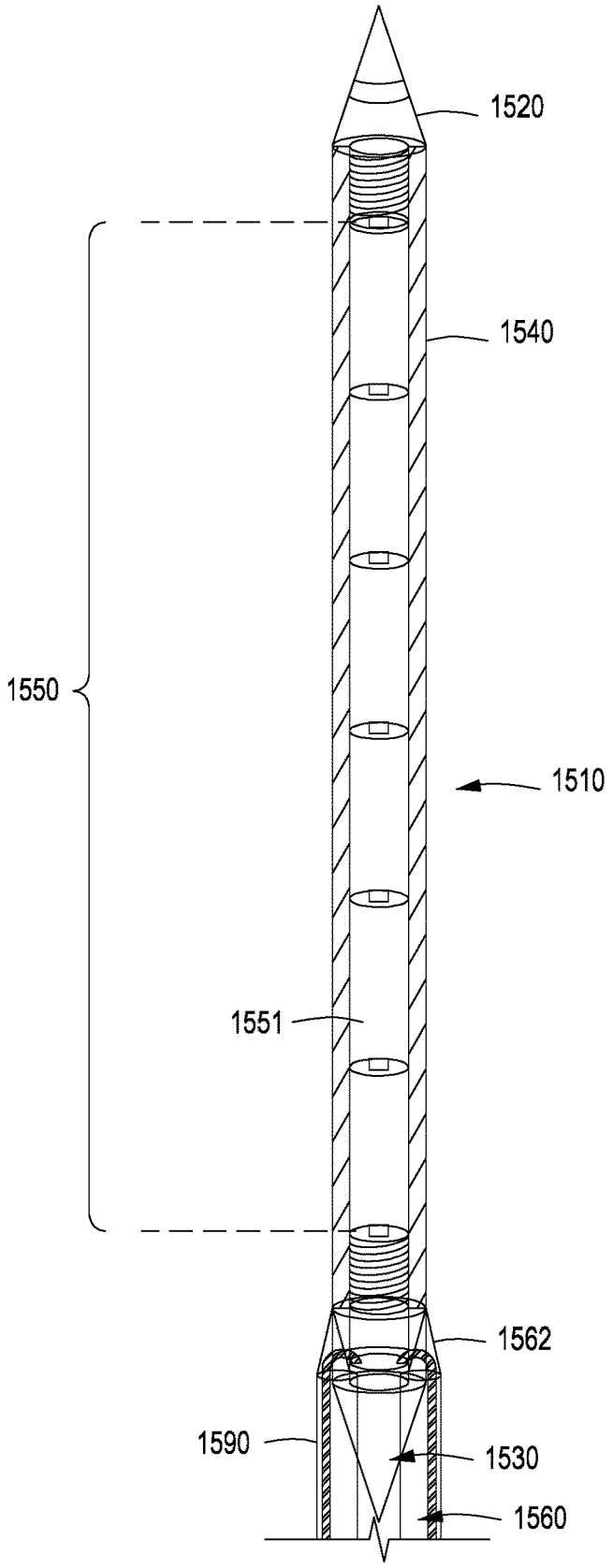
FIG. 3A is a cut-away perspective view of the battery pack section of the internal system of FIG. 3.

The internal system 1500 first includes a battery pack 1510. FIG. 3A provides a cut-away perspective view of the battery pack 1510 of the internal system 1500 of FIG. 3. Note this section 1510 has been rotated 90° from the horizontal view of FIG. 3 to a vertical orientation for presentation purposes. An individual AA battery 1551 is shown in a sequence of end-to-end like batteries forming the battery pack 1550. Protection of the batteries 1551 is primarily via a battery pack casing 1540 which is sealed by an upstream battery pack end cap 1520 and a downstream battery pack end cap 1530. These components (1540, 1520, and 1530) present exterior faces exposed to the high pressure jetting fluid stream. Accordingly, they are preferably constructed of or are coated with a non-conductive, highly abrasion/erosion/corrosion resistant material.

The upstream battery pack end cap 1520 has a conductive ring about a portion of its circumference. When the internal system 1500 is "docked" (i.e., matingly received into a docking station 325 of the external system 2000) the battery pack end cap 1520 can receive and transmit current and, thus, re-charge the battery pack 1550. Note also that the end caps 1520 and 1530 can be sized so as to house and protect any servo, microchip, circuitry, geospatial or transmitter/receiver components within them.

The battery pack end-caps 1520, 1530 may be threadedly attached to the battery pack casing 1540. The battery pack end-caps 1520, 1530 may be constructed of a highly erosive- and abrasive-resistant, high pressure material, such as titanium, perhaps even further protected by a thin, highly erosive- or abrasive-resistant coating, such as polycrystalline diamond. The shape and construction of the end-caps 1520, 1530 are preferably such that they can deflect the flow of high pressure jetting fluid without incurring significant wear. The upstream end cap 1520 must deflect flow to an annular space (not shown in FIG. 3) between the battery casing 1540 and a surrounding jetting hose conduit 420 (seen in FIG. 3C) of a jetting hose carrier system (shown at 400 in FIG. 4D-1). The downstream end-cap 1530 bounds part of the flow path of the jetting fluid from this annular space down into the I.D. of the jetting hose 1595 itself through a jetting fluid receiving (or, "intake") funnel (shown at 1570 in FIG. 3B-1).

Thus, the path of the high pressure hydraulic jetting fluid (with or without abrasives) is as follows:

(1) Jetting fluid is discharged from a high pressure pump at the surface 1 down the I.D. of the coiled tubing conveyance medium 100, at the end of which it enters the external system 2000;

(2) Jetting fluid enters the external system 2000 through a coiled tubing transition connection 200;

(3) Jetting fluid enters the main control valve 300 through a jetting fluid passage 345;

(4) Because the main control valve 300 is positioned to receive jetting fluid (as opposed to hydraulic fluid), a sealing passage cover 320 will be positioned to seal a hydraulic fluid passage 340, leaving the only available fluid path through the jetting fluid passage 345, the discharge of which is sealingly connected to the jetting hose conduit 420 of the jetting hose carrier system 400;

(5) Upon entering the jetting hose conduit 420, the jetting fluid will first pass by a docking station 325 (which is affixed within the jetting hose conduit 420) through the annulus between the docking station 325 and the jetting hose conduit 420;

(6) Because the jetting hose 1595 itself resides in the jetting hose conduit 420, the high pressure jetting fluid must now either go through or around the jetting hose 1595; and (7) Because of the internal system's 1500 seal 1580U, which seals the annulus between the jetting hose 1595 and the jetting hose conduit 420, jetting fluid cannot go around the jetting hose 1595 (note this hydraulic pressure on the seal assembly 1580 is the force that tends to pump the internal system 1500, and hence the jetting hose 1595, "down the hole") and thus jetting fluid is forced to go through the jetting hose 1595 according to the following path:

(a) jetting fluid first passes the top of the internal system 1500 at the upstream battery pack end cap 1520, (b) jetting fluid then passes through the annulus between the battery pack casing 1540 and the jetting hose conduit 420 of the jetting hose carrier system 400;

(c) after jetting fluid passes the downstream battery pack end cap 1530, it is forced to flow between battery pack support conduits 1560, and into a jetting fluid receiving funnel 1570; and (d) because the jetting fluid receiving funnel 1570 is rigidly and sealingly connected to the jetting hose 1595, jetting fluid is forced into the I.D. of jetting hose 1595.

Figures 1A, 3B:
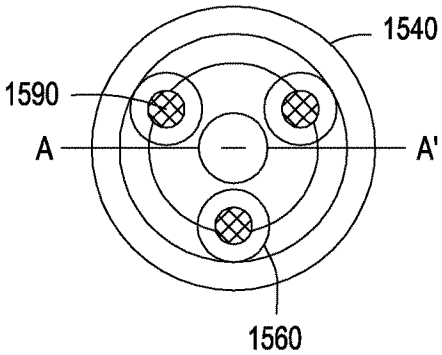
FIG. 3B-1 is a cut-away perspective view of a jetting fluid inlet located between the base of the battery pack section and the jetting hose. A jetting fluid receiving funnel is shown for receiving fluids into the jetting hose of the internal system of FIG. 3.
Figures 1B, 3B:
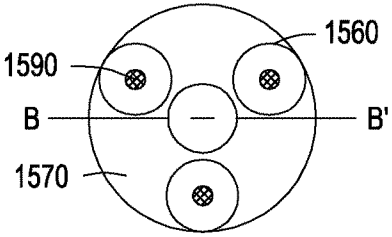
Figures 1, 3B:
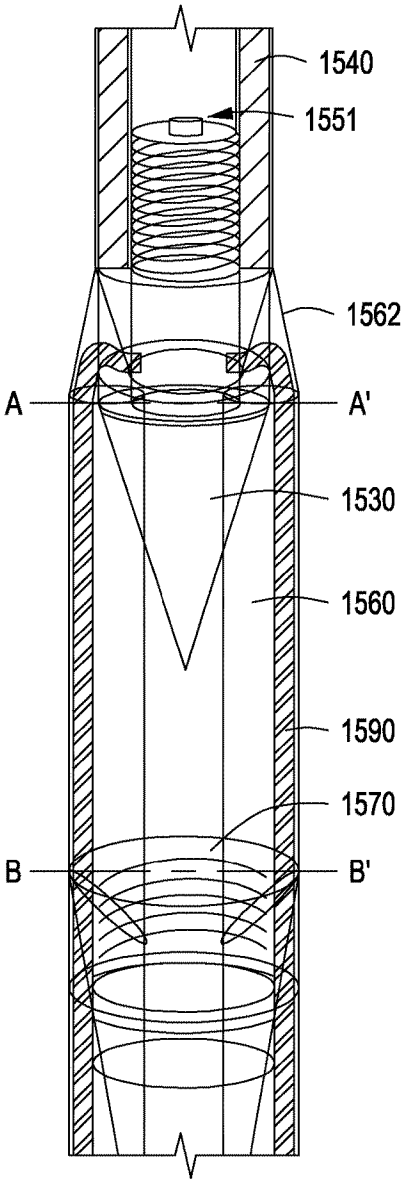
Figure 3C:
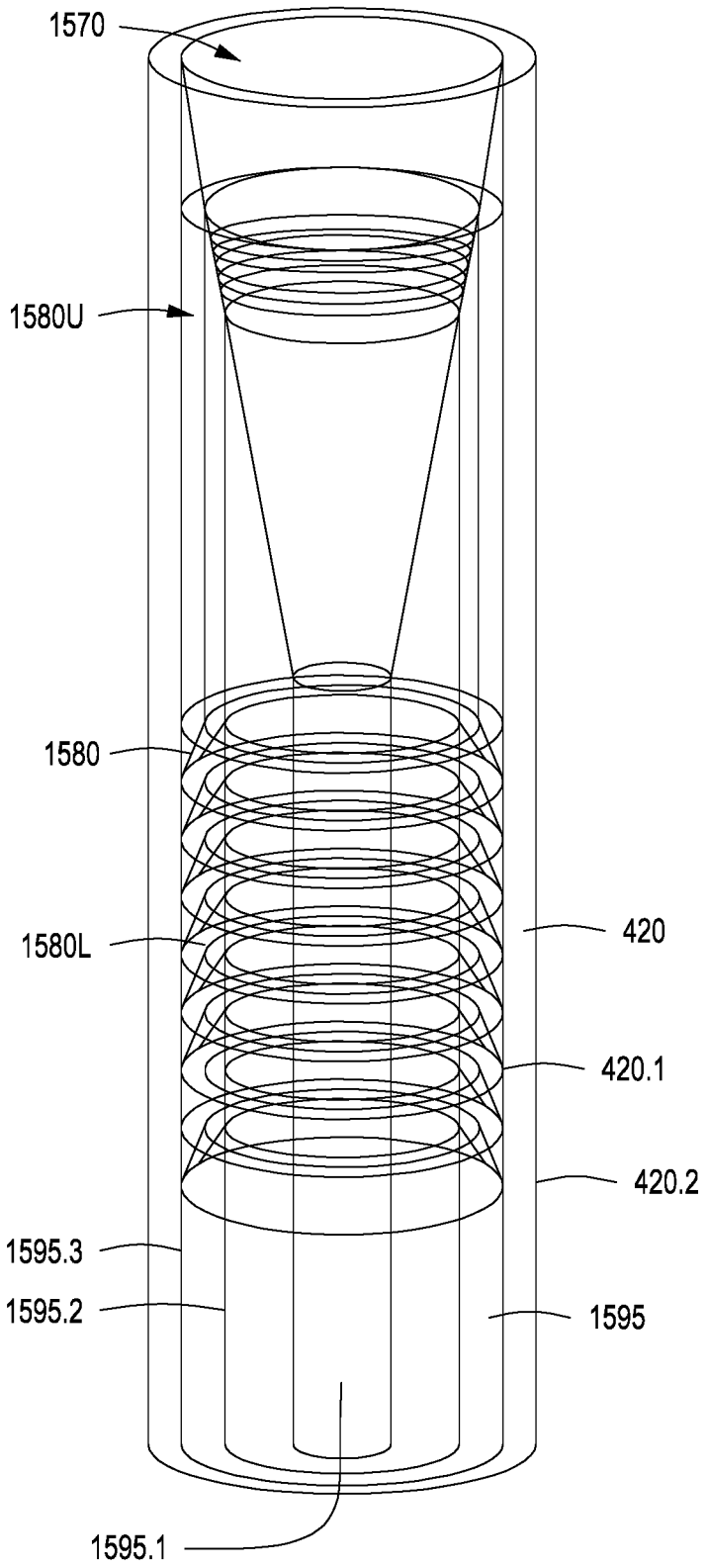
FIG. 3C is a cut-away perspective view of an upper portion of the internal system of FIG. 3, from the base of the jetting hose's fluid receiving funnel through the jetting hose's upper seal assembly.
Figures 1, 3D:
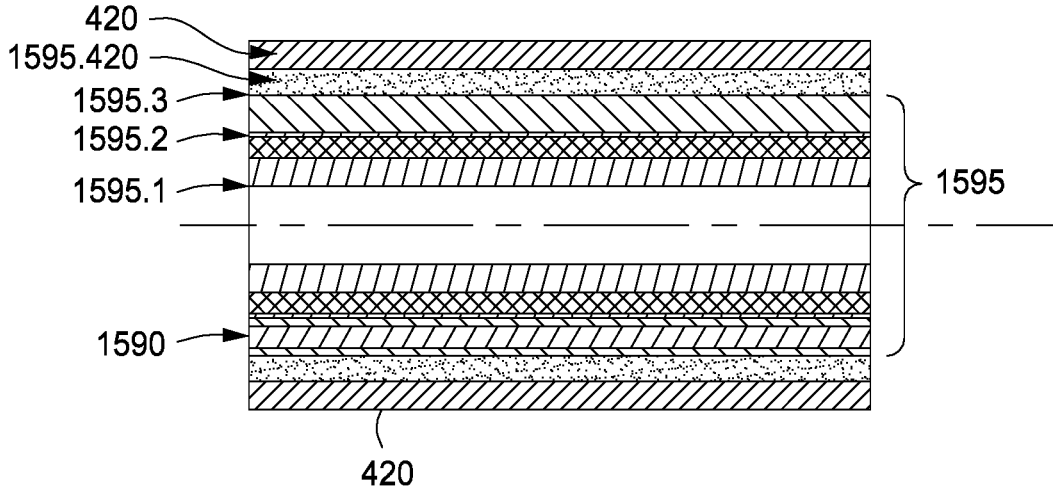
Figures 1A, 3D:
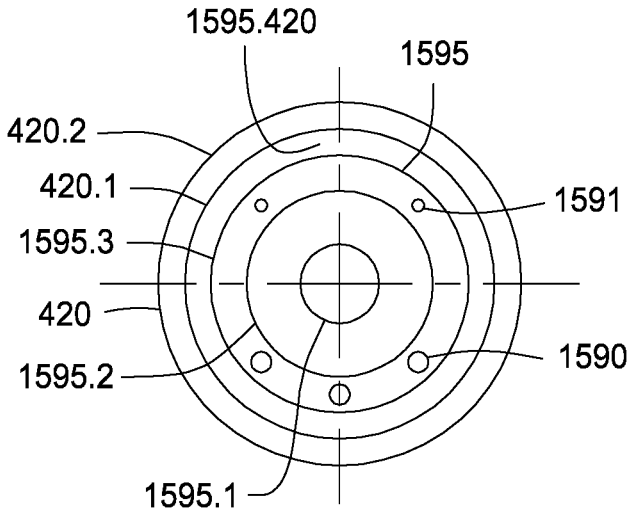
Figure 3E:
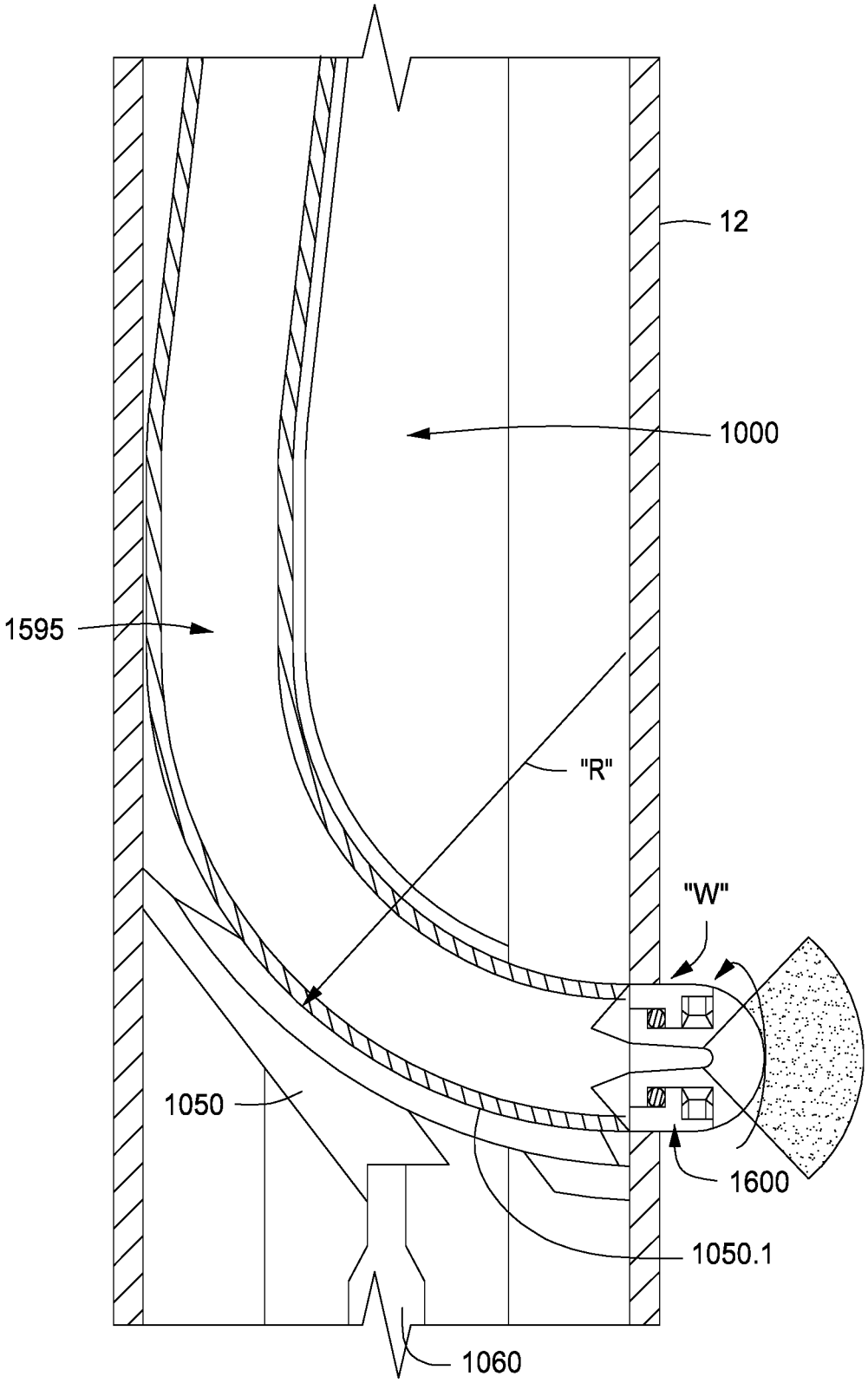
FIG. 3E is an expanded cross-sectional view of the terminal end of the jetting hose of FIG. 3D-1, showing the jetting nozzle of the internal system of FIG. 3. The bend radius of the jetting hose is shown within a cut-away section of the whipstock of the external system of FIG. 3.
Figures 1B, 3F:
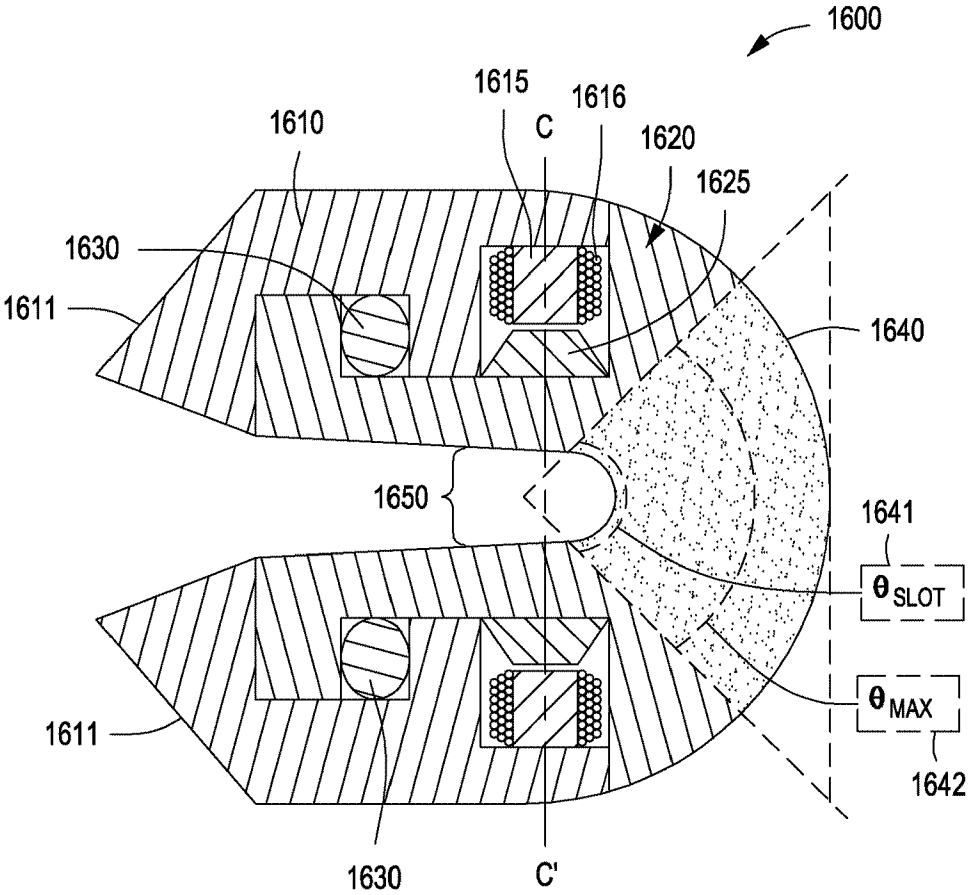
Figures 1A, 3F:
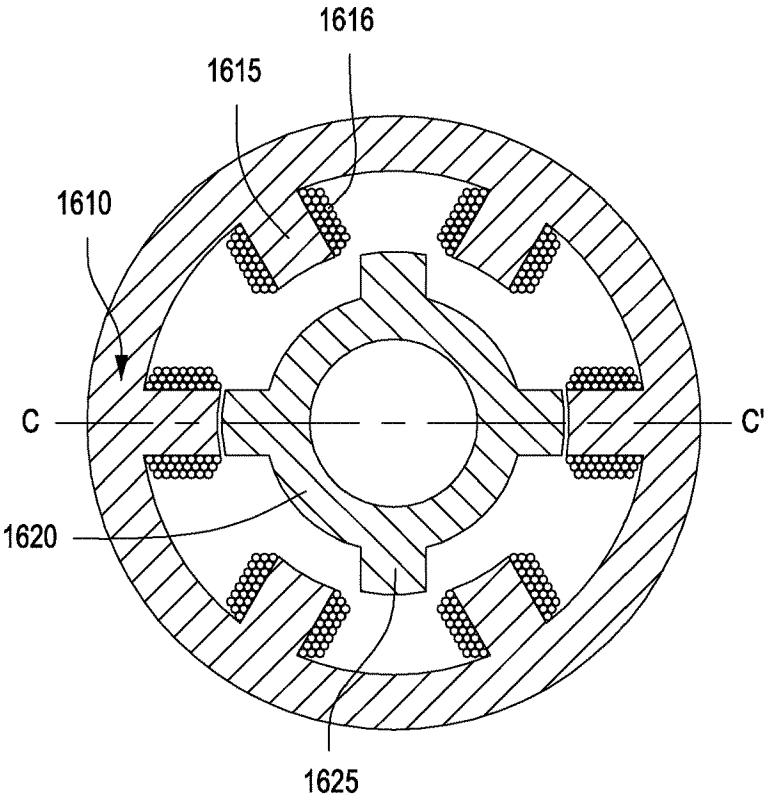
Figures 1C, 3F:
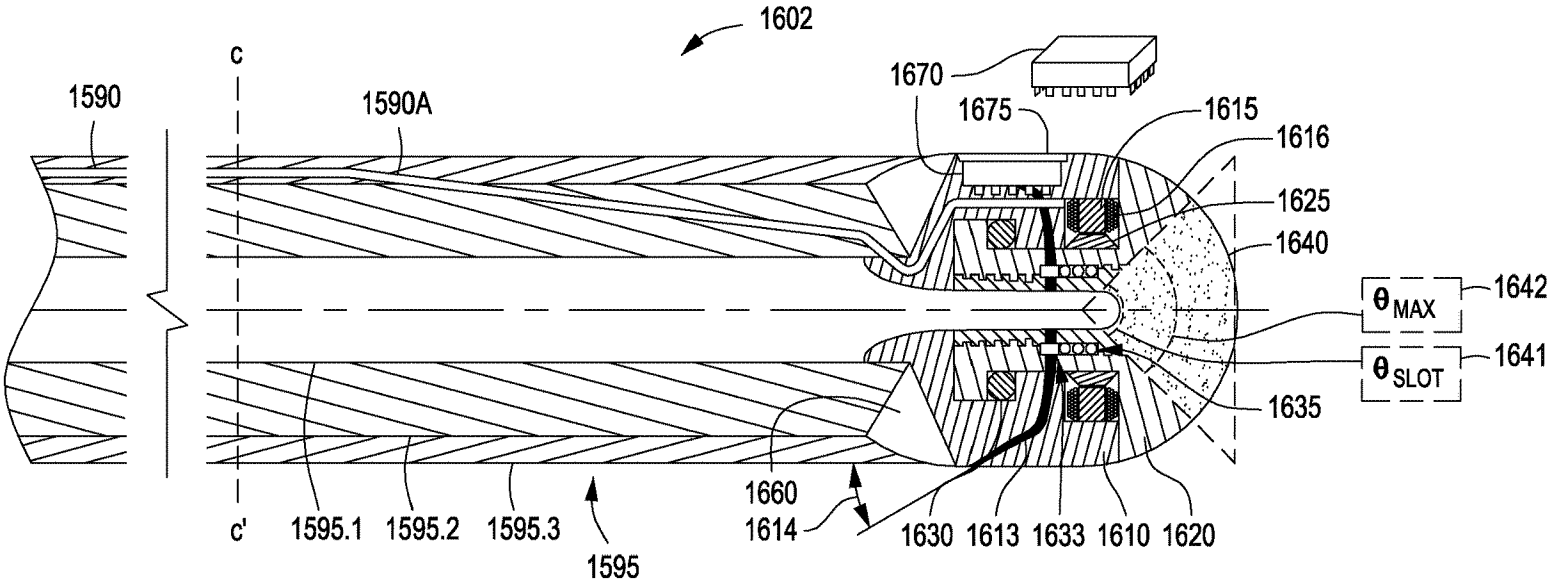
Figures 1D, 3F:
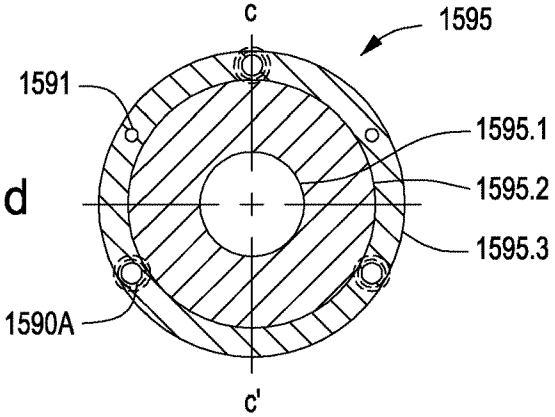
Figures 2B, 3F:
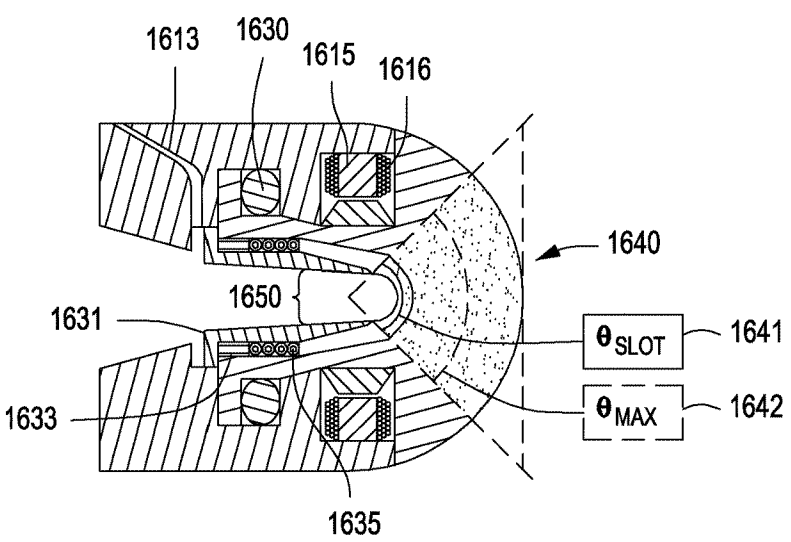
Figure 4:
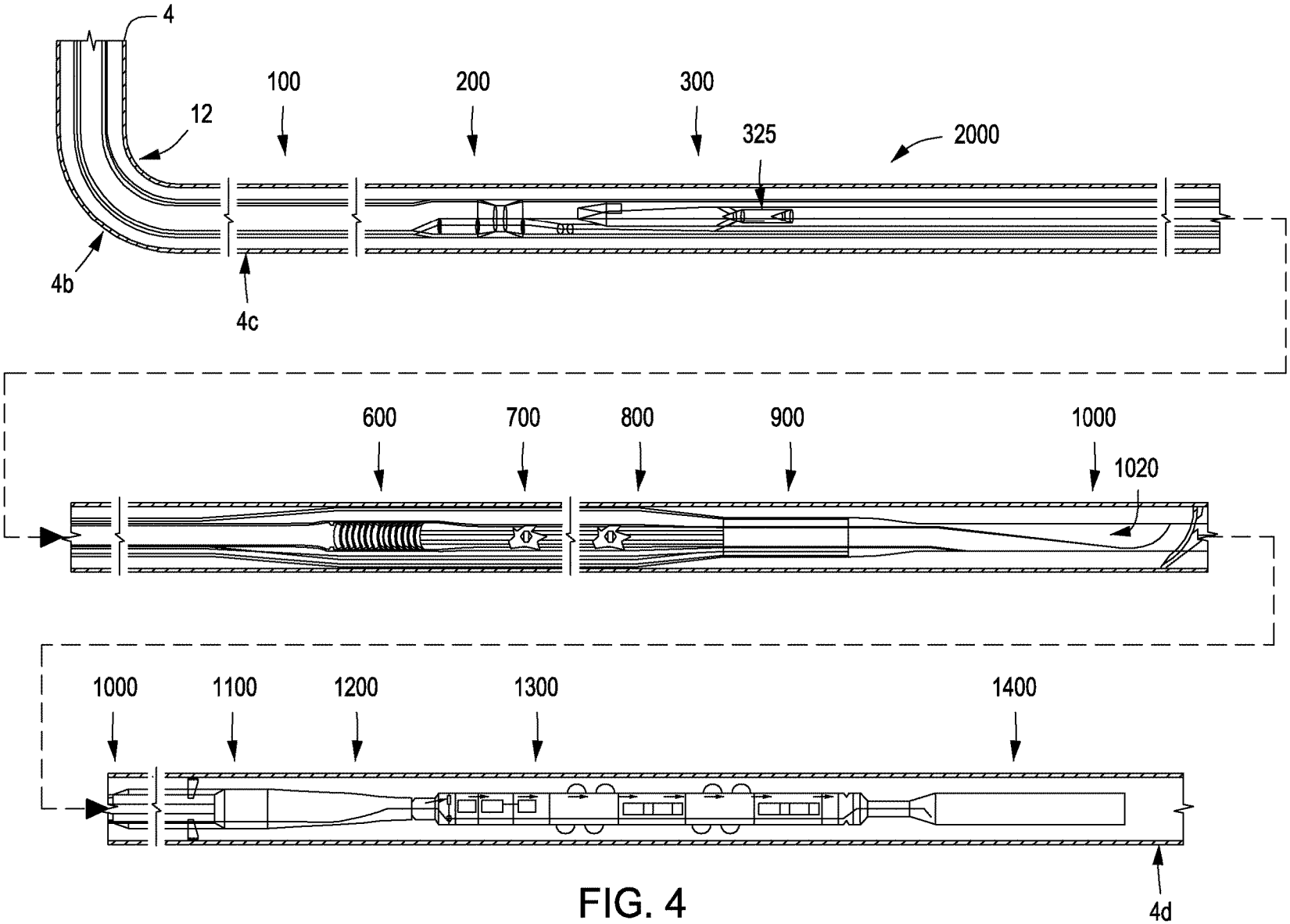
FIG. 4 is a longitudinal, cross-sectional view of the external system of the downhole hydraulic jetting assembly of FIG. 2, in one embodiment. The external system resides within production casing of the horizontal leg of the wellbore of FIG. 2.
Figures 1A, 4A:
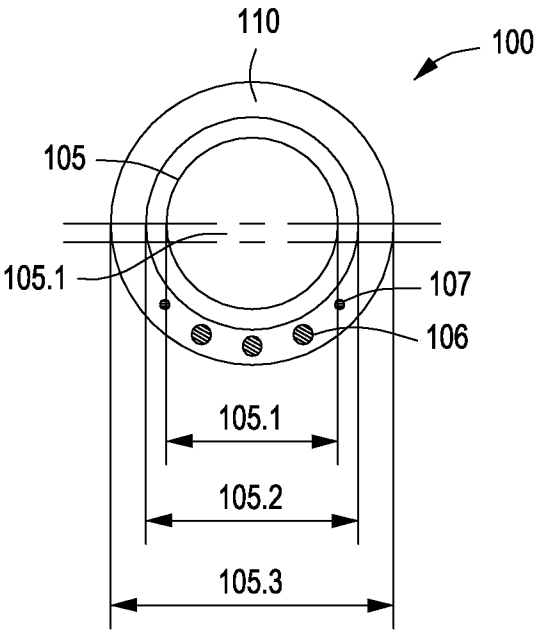
Figures 1, 4A:
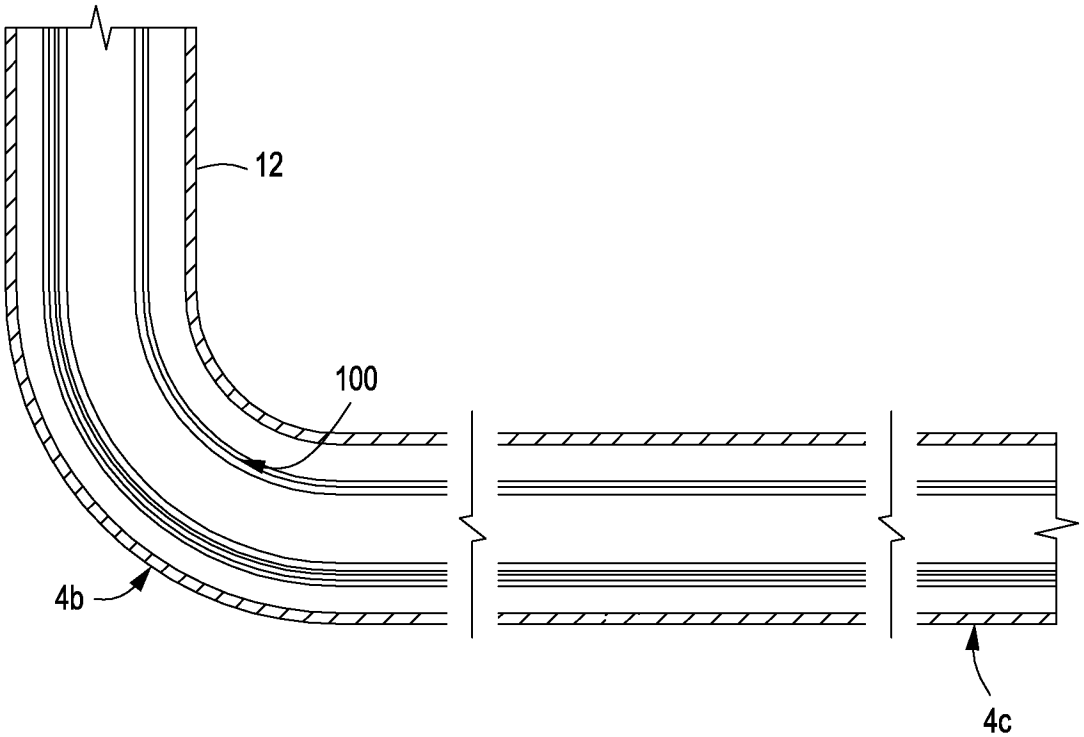
Figures 2, 4A:
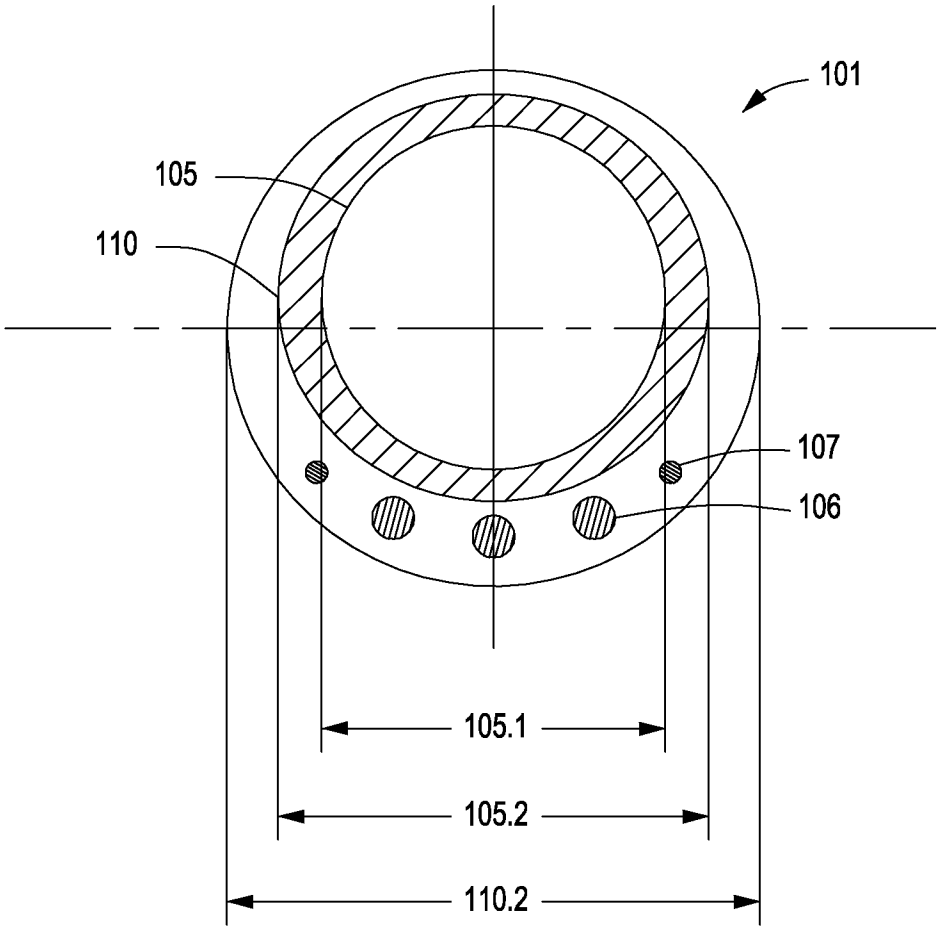
Figures 1, 4B:
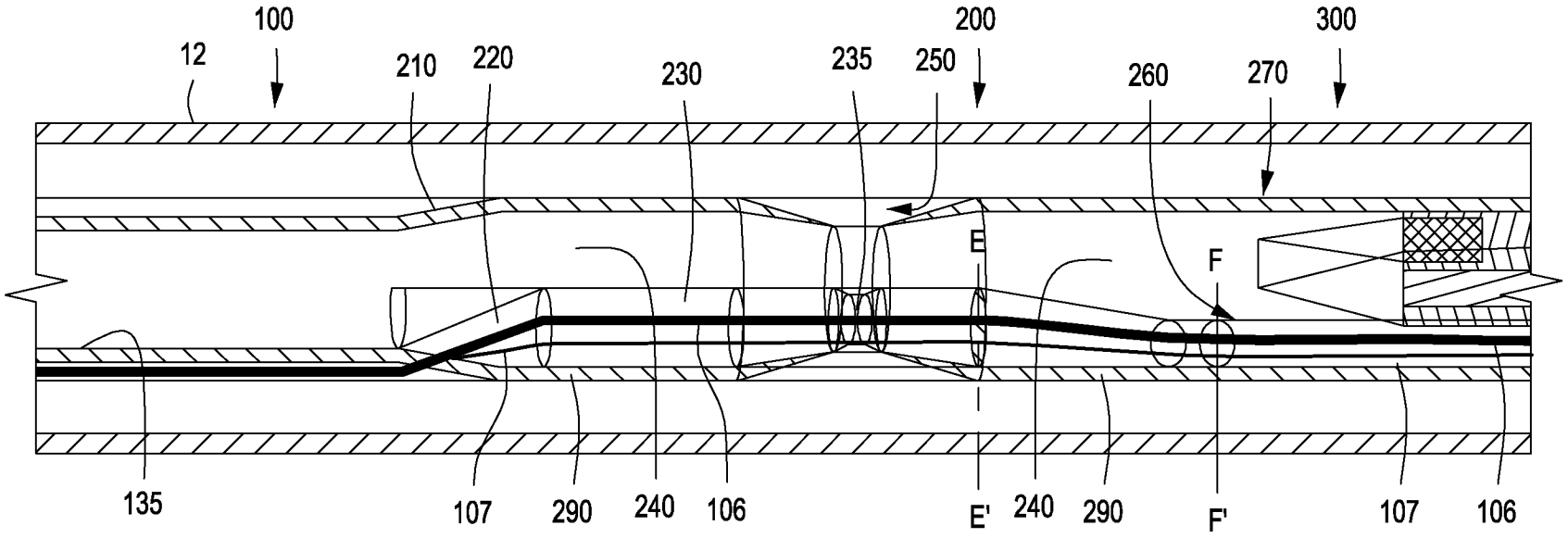
Figures 1A, 4B:
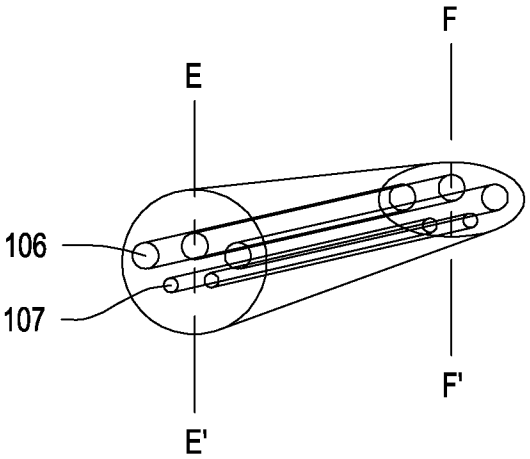
Figures 1, 4D:
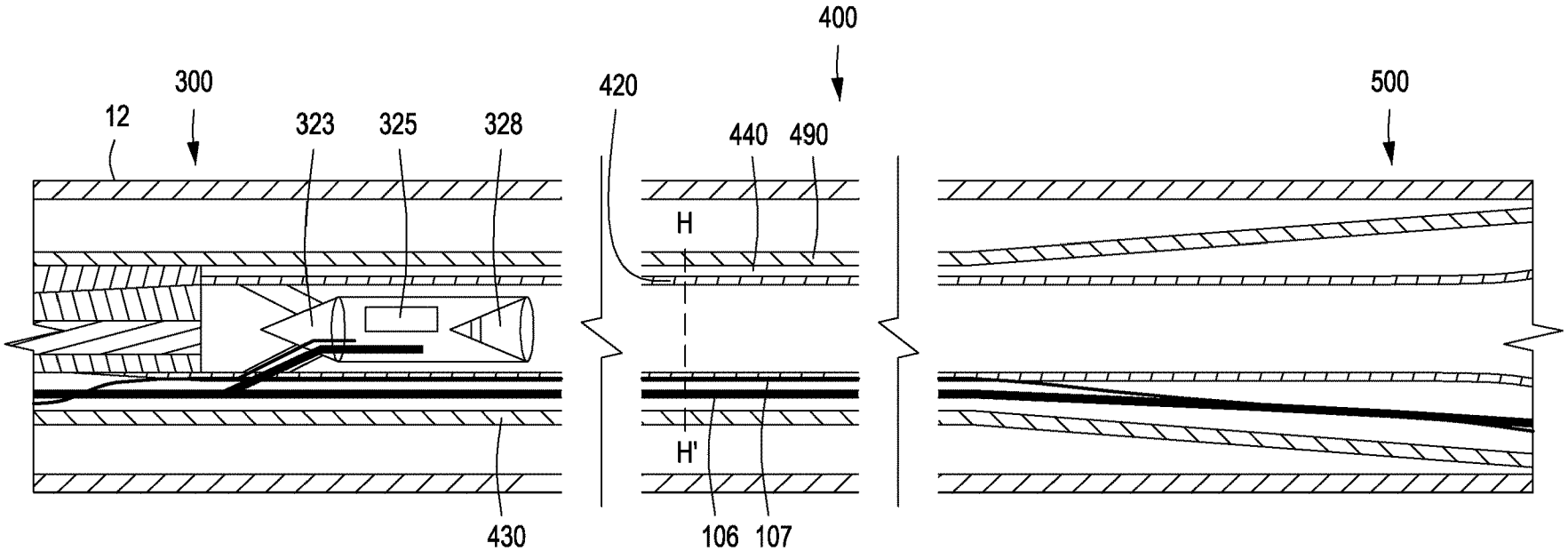
Figures 1B, 4D:
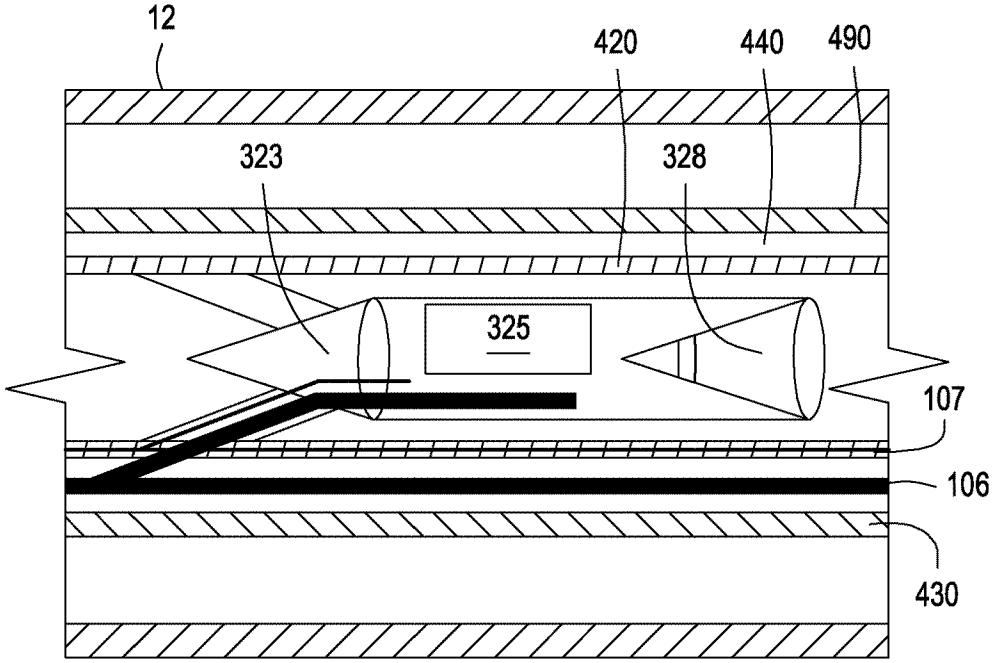
Figures 1A, 4D:
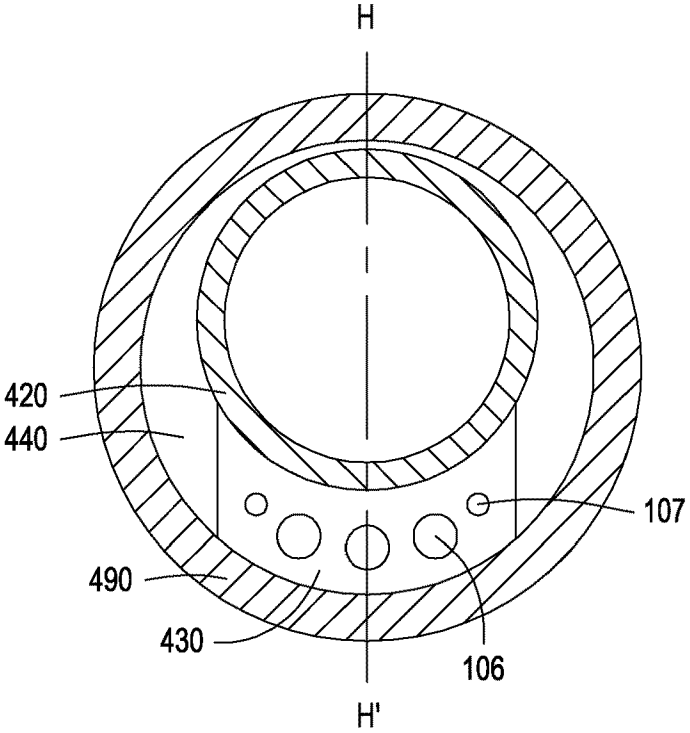
Figures 2A, 4D:
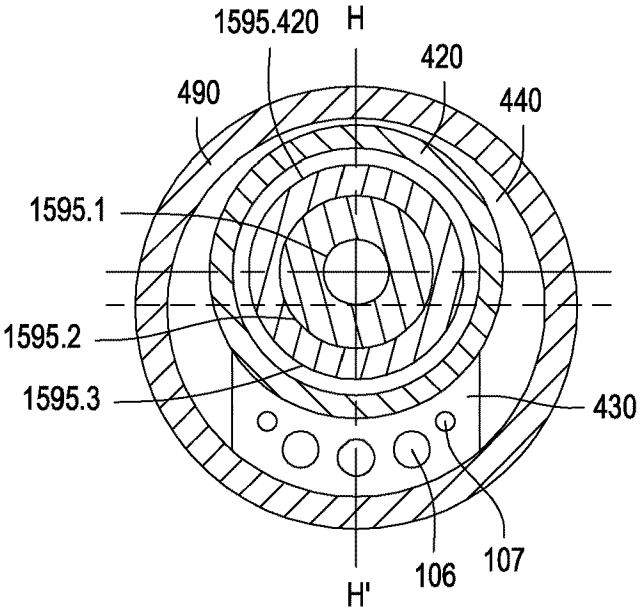
Figures 2, 4D:
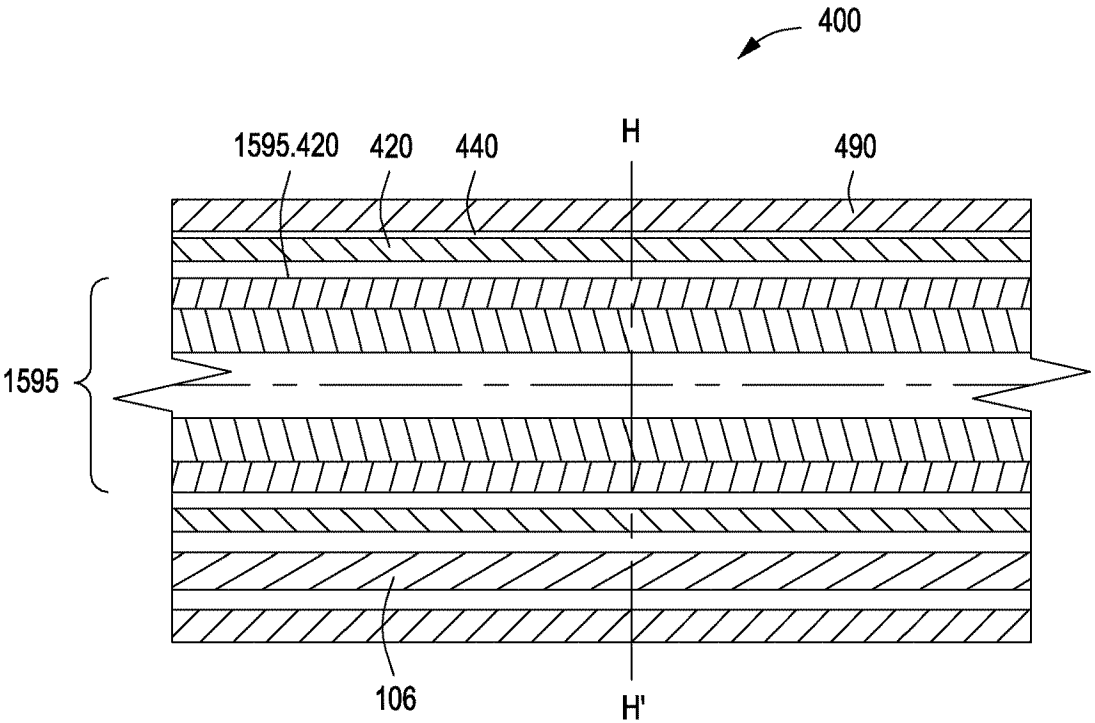
Figures 1, 4E:
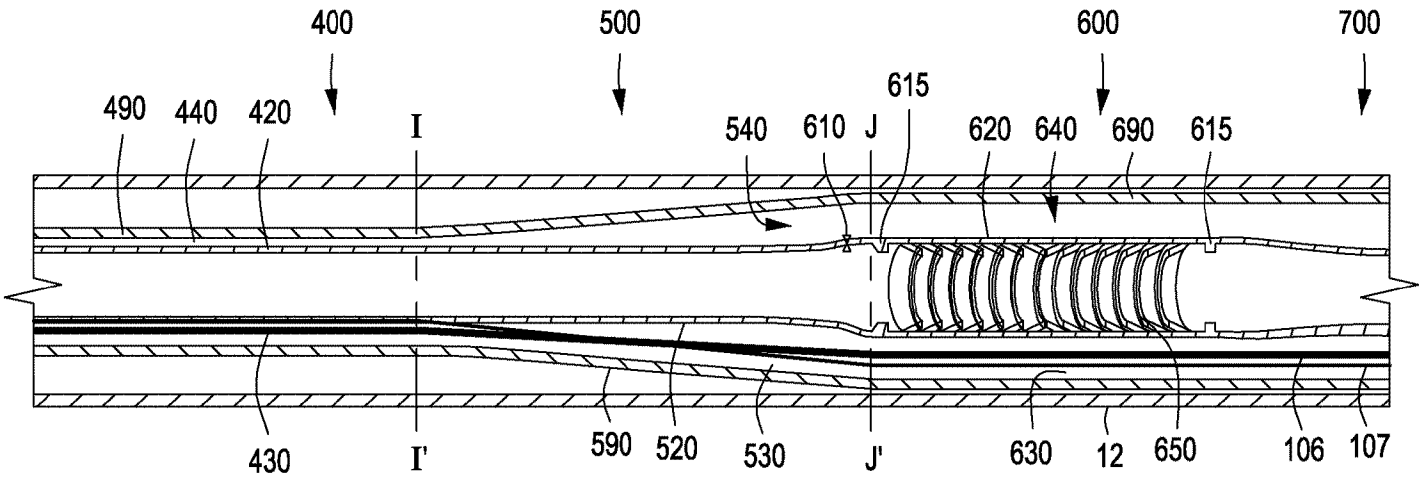
Figures 2, 4E:
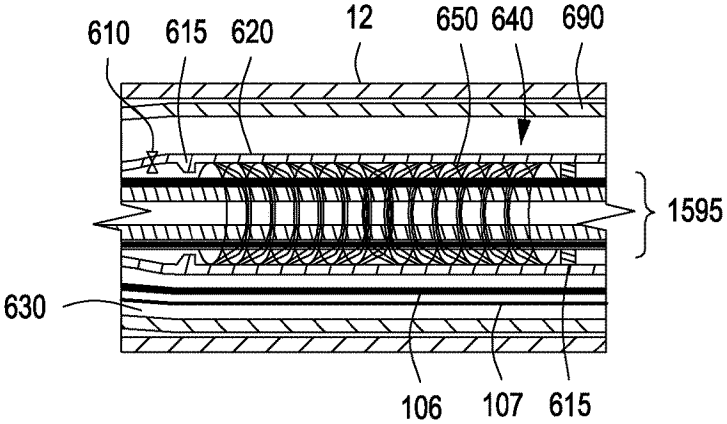
Figures 1A, 4E:
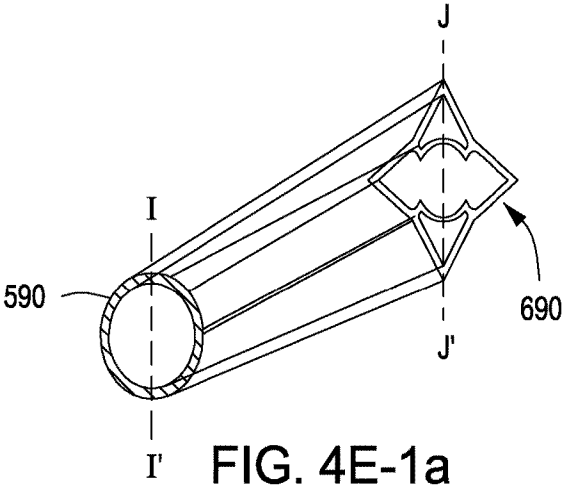
Figures 1, 4F:
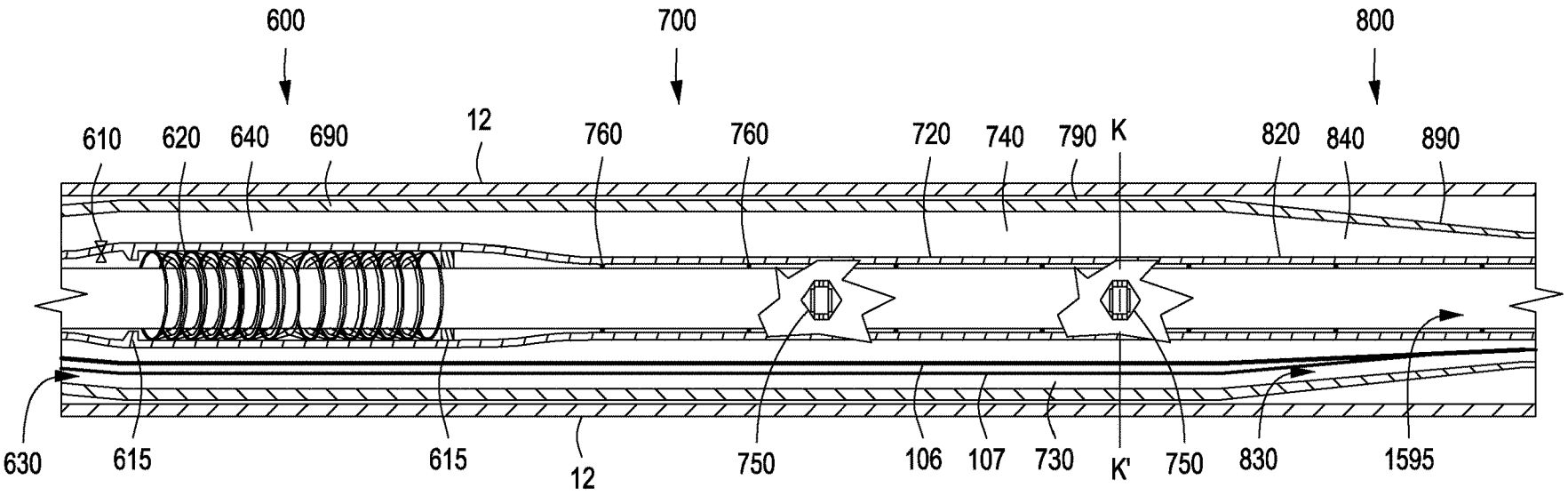

Worthy of note in the above-described jetting fluid flow sequence are the following initiation conditions:

(i) an internal tractor system 700 is first engaged to translate a discreet length of jetting hose 1595 in a downstream direction, such that the jetting nozzle 1600 and jetting hose 1595 enter the jetting hose whipstock 1000 and specifically, after traveling a fixed distance within the inner wall (shown at 1020 in FIG. 4H-1), are forced radially outward to engage first the interior wall of production casing 12 and then engage the upper curved face 1050.1 of whipstock member 1050, at which point, (ii) the jetting hose 1595 is curvedly 'bent' approximately 90°, assuming its pre-defined bend radius (shown at 1599 in FIG. 4H-1) and directing the jetting nozzle 1600 attached to its terminal end to engage the precise point of desired casing exit "W" within the I.D. of the production casing 12; at which point (iii) increased torque within the internal tractor system's 700 gripper assemblies 750 is then realized, a signal for which is immediately conveyed electronically to the surface, signaling the operator to shut down rotation of the grippers (illustrative griper seen at 756 in FIG. 4F-2*b*).

(Practically, such shut-down could be pre-programmed into the operating system at a certain torque level.) Note that during stages (i) through (iii), a pressure regulator valve (seen at 610 in FIG. 4E-2) is in an "open" position This allows hydraulic fluid in the annulus between the jetting hose 1595 and the surrounding jetting hose conduit 420 to bleed-off. Once the tip of jetting nozzle 1600 engages the I.D. (casing wall) of production casing 12, then the operator may:

(iv) reverse the direction of rotation of the grippers 756 to translate the jetting hose 1595 back into the jetting hose (or inner) conduit 420; and (v) switch a main control valve 300 to begin pumping hydraulic fluid though the hydraulic fluid passage 340, down the conduit-carrier annulus 440, through the pressure regulator valve 610, and into the jetting hose 1595/jetting hose conduit 420 annulus 1595.420 to both: (1) pump upwards against lower seals 1580L of the jetting hose's seal assembly 1580 to re-extend the jetting hose 1595 in a taught position; and, (2) assist the (now reversed) gripper assemblies 750 in positioning the internal system 1500 such that the jetting nozzle 1600 has the desired stand-off distance (preferably less than 1 inch) between itself and the I.D. of the production casing 12 to begin jetting the casing exit.

Upon reaching this desired stand-off distance, rotation of grippers 756 ceases, and pressure regulator valve 610 is closed to lock down the internal system at the desired, fixed position for jetting the casing exit "W".

Referring back to FIG. 3A, in one embodiment the interior of the downstream end-cap 1530 houses a micro-geo-steering system. The system may include a micro-transmitter, a micro-receiver, a micro-processor, and a current regulator. This geo-steering system is electrically or fiber-optically connected to a small geo-spatial IC chip (shown at 1670 in FIG. 3F-1*c* and discussed more fully below.) located in the body of the jetting nozzle 1600. In this way, geo-location data may be sent from the jetting nozzle 1600 to the micro-processor (or appropriate control system) which, coupled with the values of dispensed hose length, can be used to calculate the precise geo-location of the nozzle at any point, and thus the contour of the UDP's path. Conversely, geo-steering signals may be sent from the control system (such as a micro-processor in the docking station or at the surface) to modify, through one or more electrical current regulators, individualized current strengths down to each of the (at least three) actuator wires (shown at 1590A in FIG. 3F-1*c*), thus redirecting the nozzle as desired.

The geo-steering system can also be utilized to control the rotational speed of a rotor body within the jetting nozzle 1600. As will be described more fully below, the rotating nozzle configuration utilizes the rotor portion 1620 of a miniature direct drive electric motor assembly to also form a throat and end discharge slot 1640 of the rotating nozzle itself. Rotation is induced via electromagnetic forces of a rotor/stator configuration. In this way, rotational speeds can be governed in direct proportion to the current supplied to the stators.

As depicted in FIGS. 3F-1 through 3F-3, the upstream portion of the rotor (in this depiction, a four-pole rotor) 1620 includes a near-cylindrical inner diameter (the I.D. actually reduces slightly from the fluid inlet to the discharge slot to further accelerate the fluid before it enters the discharge slot) that provides a flow channel for the jetting fluid through the center of the rotor 1620. This near-cylindrical flow channel then transitions to the shape of the nozzle's 1600 discharge slot 1640 at its far downstream end. This is possible because, instead of the typical shaft and bearing assembly inserted longitudinally through the center diameter of the rotor 1620, the rotor 1620 is stabilized and positioned for balanced rotation about the longitudinal axis of the rotor 1620 by a single set of bearings 1630 positioned about the interior of the upstream butt end, and outside the outer diameter of the flow channel ("nozzle throat") 1650, such that the bearings 1630 stabilize the rotor body 1620 both longitudinally and axially.

Referring now to FIG. 3B-1*a*, and again discussing the internal system 1500, a cross-sectional view of the battery pack section 1510, taken across line A-A' of FIG. 3B-1 is shown. The view is taken at the top of the bottom end cap 1530 of the battery pack 1510 looking down into a jetting fluid receiving funnel 1570. Visible in this figure are three wires 1590 extending away from the battery pack 1510. Using the wires 1590, power is sent from the "AA"-size lithium batteries 1551 to the geo-steering system for controlling the rotating jet nozzle 1600. By adjusting current through the wires 1590, the geo-steering system controls the rate of rotation of the rotor 1620 along with its orientation.

Note that because the longitudinal axis of the nozzle's discharge stream is designed to be continuous to and aligned with that of the nozzle throat, there is virtually no axial moment acting on the nozzle from thrust of the exiting jetting fluid. That is, as the nozzle is designed to operate in an axially "balanced" condition, the torque moment required to actually rotate the nozzle about its longitudinal axis is relatively small. Similarly, in that relatively low rotational speeds (RPM's) are required for rotational excavation, the electromagnetic force required from the nozzle's rotor/stator interaction is relatively small as well.

Note from FIG. 3 that the jetting nozzle 1600 is located at the far downstream end of the jetting hose 1595. Though the diameters of the components of the internal system 1500 must meet some rather stringent diameter constraints, the respective lengths of each component (with the exception of the jetting nozzle 1600 and, if desired, one or more jetting collars) are typically far less restricted. This is because the jetting nozzle 1600 and collars are the only components affixed to the jetting hose 1595 that will ever have to make the approximate 90° bend as directed by the whipstock face 1050.1. All other components of the internal system 1500 will always reside at some position within the jetting hose carrier system 400, and above the jetting hose pack-off section 600 (discussed below).

The length of many of the components can also be adjusted. For example, though the battery pack 1510 in FIG. 3A is depicted to house six AA batteries 1551, a much greater number could be easily accommodated by simply constructing a longer battery pack casing 1540. Similarly, the battery pack end-caps 1520, 1530, the support columns 1560, and the fluid intake funnel 1570 may be substantially elongated as well to accommodate fluid flow and power needs.

Referring again to the docking station 325, the docking station 325 serves as a physical "stop" beyond which the internal system 1500 can no longer travel upstream. Specifically, the upstream limit of travel of the internal system 1500 (comprised primarily of the jetting hose 1595) is at that point where the upstream battery pack end cap 1520 lodges (or, "docks") within a bottom, conically-shaped receptacle 328 of the docking station 325. The receptacle 328 serves as a lower end cap. The receptacle 328 provides matingly conductive contacts which line up with the upstream battery pack end cap 1520 to form a docking point. In this way, a transfer of data and/or electrical power (specifically, to recharge batteries 1551) can occur while "docked."

The docking station 325 also has a conically-shaped end-cap 323 at the upstream (proximal) end of the docking station 325. The conical shape serves to minimizing erosive effects by diverting the flow of jetting fluid around the body thereof, thereby aiding in the protection of the system components housed within the docking station 325. Depending on the guidance, steering, and communications capabilities desired, an upper portion 323 of the docking station 325 can house the servo, transmission, and reception circuitry and electronics systems designed to communicate directly (either in continuous real time, or only discretely while docked) with counterpart systems in the internal system 1500. Note, as shown in FIG. 3, the O.D. of the cylindrical docking station 325 is approximately equal to that of the jetting hose 1595.

The internal system 1500 next includes a jetting fluid receiving funnel 1570. FIG. 3B-1 includes a cut-away perspective view of the jetting fluid receiving funnel 1570, with an axial cross-sectional view along B-B' shown as FIG. 3B-1*b*. The jetting fluid receiving funnel 1570 is located below the base of the battery pack section 1510, shown and described above in connection with FIG. 3A. As the name implies, the jetting fluid receiving funnel 1570 serves to guide the jetting fluid into the interior of the jetting hose 1595 during the casing exit and mini-lateral formation process. Specifically, the annular flow of jetting fluid (e.g., passing along the outside of battery pack casing 1540 and subsequently the battery pack end cap 1530, and inside the I.D. of jetting hose conduit 420) is forced to transition to flow between the three battery pack support conduits 1560, because an upper seal (seen in FIG. 3 at 1580U) precludes any fluid flow along a path exterior to the jetting hose 1595. Thus, all flow of jetting fluid (as opposed to hydraulic fluid) is forced between conduits 1560 and into fluid receiving funnel 1570.

In the design of FIG. 3B-1, three columnar supports 1560 are used to house the wires 1590. The columnar supports 1560 also provide an area open to fluid flow. The spacing between the supports 1560 is designed to be significantly greater than that provided by the I.D. of the jetting hose 1595. At the same time, the supports 1560 have I.D.'s large enough to house and protect up to an AWG #5 gauge wire 1590. The columnar supports 1560 also support the battery pack 1510 at a specific distance above the jetting fluid intake funnel 1570 and the jetting hose seal assembly 1580. The supports 1560 may be sealed with sealing end caps 1562, such that removal of the end caps 1562 provides access to the wiring 1590.

FIG. 3B-1*b* provides a second axial, cross-sectional view of the fluid intake funnel 1570. This view is taken across line B-B' of FIG. 3B-1. The three columnar supports 1560 are again seen. The view is taken at the top of the jetting fluid inlet, or receiving funnel 1570.

Downstream from the jetting fluid receiving funnel 1570 is a jetting hose seal assembly 1580. FIG. 3C is a cut-away perspective view of the seal assembly 1580. In the view of FIG. 3C, columnar support members 1560 and electrical wiring 1590 have been removed for the sake of clarity. However, the receiving funnel 1570 is again seen at the upper end of the seal assembly 1580.

Also visible in FIG. 3C is an upper end of the jetting hose 1595. The jetting hose 1595 has an outermost jetting hose wrap O.D. 1595.3 (also seen in FIG. 3D-1*a*) that, at points, may engage the jetting hose conduit 420. A micro-annulus 1595.420 (shown in FIGS. 3D-1 and 3D-1*a*) is formed between the jetting hose 1595 and the surrounding conduit 420. The jetting hose 1595 also has a core (O.D. 1595.2, I.D. 1595.1) that transmits jetting fluid during the jetting operation. The jetting hose 1595 is fixedly connected to the seal assembly 1580, meaning that the seal assembly 1580 moves with the jetting hose 1595 as the jetting hose advances into a mini-lateral.

As previously described, the upper seal 1580U of the jetting hose's seal assembly 1580 (shown as a solid portion with a slightly concave upwards upper face) precludes any continued downstream flow of jetting fluid outside of the jetting hose 1595. Similarly, the lower seal 1580L of this seal assembly 1580 (shown as a series of concave-downwards cup faces) precludes any upstream flow of hydraulic fluid from below. Note how any upstream-to-downstream hydraulic pressure from the jetting fluid will tend to expand the jetting fluid intake funnel 1570 and, thus, urge the upper seal 1580U of the seal assembly 1580 radially outwards to sealingly engage the I.D. 420.1 of the jetting hose carrier's (inner) jetting hose conduit 420. Similarly, any downstream-to-upstream hydraulic pressure from the hydraulic fluid radially expands bottom cup-like faces making up the lower seal 1580L to sealingly engage the I.D. 420.1 of the jetting hose carrier's inner conduit 420. Thus, when jetting fluid pressure is greater than the trapped hydraulic fluid pressure, the overbalance will tend to "pump" the entire assembly "down-the-hole". Conversely, when the pressure overbalance is reversed, hydraulic fluid pressure will tend to "pump" the entire seal assembly 1580 and connected hose 1595 back "up-the-hole".

Returning to FIGS. 2 and 3, the upper seal 1580U provides an upstream pressure and fluid-sealed connection for the internal system 1500 to the external system 2000. (Similarly, as will be discussed further below, a pack-off seal assembly 650 within a pack-off section 600 provides a downstream pressure and fluid-sealed connection between the internal system 1500 and the external system 2000.) The seal assembly 1580 includes seals 1580U, 1580L that hold incompressible fluid between the hose 1595 and the surrounding conduit 420. In this way, the jetting hose 1595 is operatively connected to the coiled tubing string 100 and sealingly connected to the external system 2000.

FIG. 3C illustrates utility of the sealing mechanisms involved in this upstream seal 1580. During operation, jetting fluid passes:

(1) through an annulus 420.2 between the battery pack casing 1540 and the jetting hose carrier inner conduit 420;
(2) between the battery pack support conduits 1560;
(3) into the fluid receiving funnel 1570;
(4) down the core 1595.1 (I.D.) of the jetting hose 1595; and
(5) then exits the jetting nozzle 1600.

As noted, the downward hydraulic pressure of the jetting fluid acting upon the axial cross-sectional area of the jetting hose's fluid receiving funnel 1570 creates an upstream-to-downstream force that tends to "pump" the seal assembly 1580 and connected jetting hose 1595 "down the hole." In addition, because the components of the fluid receiving funnel 1570 and the supporting upper seal 1580U of the seal assembly 1580 are slightly flexible, the net pressure drop described above serves to swell and flare the outer diameters of upper seal 1580U radially outwards, thus producing a fluid seal that precludes fluid flow behind the hose 1595.

FIG. 3D-1 provides a longitudinal, cross-sectional view of the "bundled" jetting hose 1595 of the internal system 1500 as it resides in the jetting hose carrier's inner conduit 420. Also included in the longitudinal cross section are perspective views (dashed lines) of electrical wires 1590 and data cables 1591. Note from the axial cross-sectional view of FIG. 3D-1*a*, that all of the electrical wires 1590 and data cables 1591 in the "bundled" jetting hose 1595 safely reside within the outermost jetting hose wrap 1595.3.

In the preferred embodiment, the jetting hose 1595 is a "bundled" product. The hose 1595 may be obtained from such manufacturers as Parker Hannifin Corporation. The bundled hose includes at least three electrically conductive wires 1590, and at least one, but preferably two dedicated data cables 1591 (such as fiber optic cables), as depicted in FIGS. 3B-1*b* and 3D-1*a*. Note these wires 1590 and fiber optic strands 1591 are located on the outer perimeter of the core 1595.2 of the jetting hose 1595, and surrounded by a thin outer layer of a flexible, high strength material or "wrap" (such as Kevlar®) 1595.3 for protection. Accordingly, the wires 1590 and fiber optic strands 1591 are protected from any erosive effects of the high-pressure jetting fluid.

Moving now down the hose 1595 to the distal end, FIG. 3E provides an enlarged, cross sectional view of the end of the jetting hose 1595. Here, the jetting hose 1595 is passing through the whipstock member 1000, and ultimately along the whipstock face 1050.1 to casing exit "W". A jetting nozzle 1600 is attached to the distal end of the jetting hose 1595. The jetting nozzle 1600 is shown in a position immediately subsequent to forming an exit opening, or window "W" in the production casing 12. Of course, it is understood that the present assembly 50 may be reconfigured for deployment in an uncased wellbore.

As described in the related applications, the jetting hose 1595 immediately preceding this point of casing exit "W" spans the entire I.D. of the production casing 12. In this way, a bend radius "R" of the jetting hose 1595 is provided that is always equal to the I.D. of the production casing 12. This is significant as the subject assembly 50 will always be able to utilize the entire casing (or wellbore) I.D. as the bend radius "R" for the jetting hose 1595, thereby providing for utilization of the maximum I.D./O.D hose. This, in turn, provides for placement of maximum hydraulic horsepower ("HHP") at the jetting nozzle 1600, which further translates in the capacity to maximize formation jetting results such as penetration rate, or the lateral borehole diameter, or some optimization of the two.

It is observed here that there is a consistency of three "touch points" for the bend radius "R" of the jetting hose 1595. First, there is a touch point where the hose 1595 contacts the I.D. of the casing 12. This occurs at a point directly opposite and slightly (approximately one casing I.D. width) above the point of casing exit "W." Second, there is a touch point along a whipstock curved face 1050.1 of the whipstock member 1000 itself. Finally, there is a touch point against the I.D. of the casing 12 at the point of casing exit "W," at least until the window "W" is formed.

As depicted in FIG. 3E (and in FIG. 4H-1), the jetting hose whipstock member 1000 is in its set and operating position within the casing 12. (U.S. Pat. No. 8,991,522, which is incorporated herein by reference, also demonstrates the whipstock member 1050 in its run-in position.) The actual whipstock 1050 within the whipstock member 1000 is supported by a lower whipstock rod 1060. When the whipstock member 1000 is in its set-and-operating position, the upper curved face 1050.1 of the whipstock member 1050 itself spans substantially the entire I.D. of the casing 12. If, for example, the casing I.D. were to vary slightly larger, this would obviously not be the case. The three aforementioned "touch points" of the jetting hose 1595 would remain the same, however, albeit while forming a slightly larger bend radius "R" precisely equal to the (new) enlarged I.D. of casing 12.

As described in greater detail in the co-owned U.S. Pat. No. 8,991,522, the whipstock rod is part of a tool assembly that also includes an orienting mechanism, and an anchoring section that includes slips. Once the slips are set, the orienting mechanism utilizes a ratchet-like action that can rotate the upstream portion of the whipstock member 1000 in discreet 10° increments. Thus, the angular orientation of the whipstock member 1000 within the wellbore may be incrementally changed downhole.

In one embodiment, the whipstock 1050 is a single body having an integral curved face configured to receive the jetting hose and redirect the hose about 90 degrees. Note the whipstock 1050 is configured such that, at the point of casing exit when in set and operating position, it forms a bend radius for the jetting hose that spans the entire ID of the parent wellbore's production casing 12.

Figures 1, 4G:
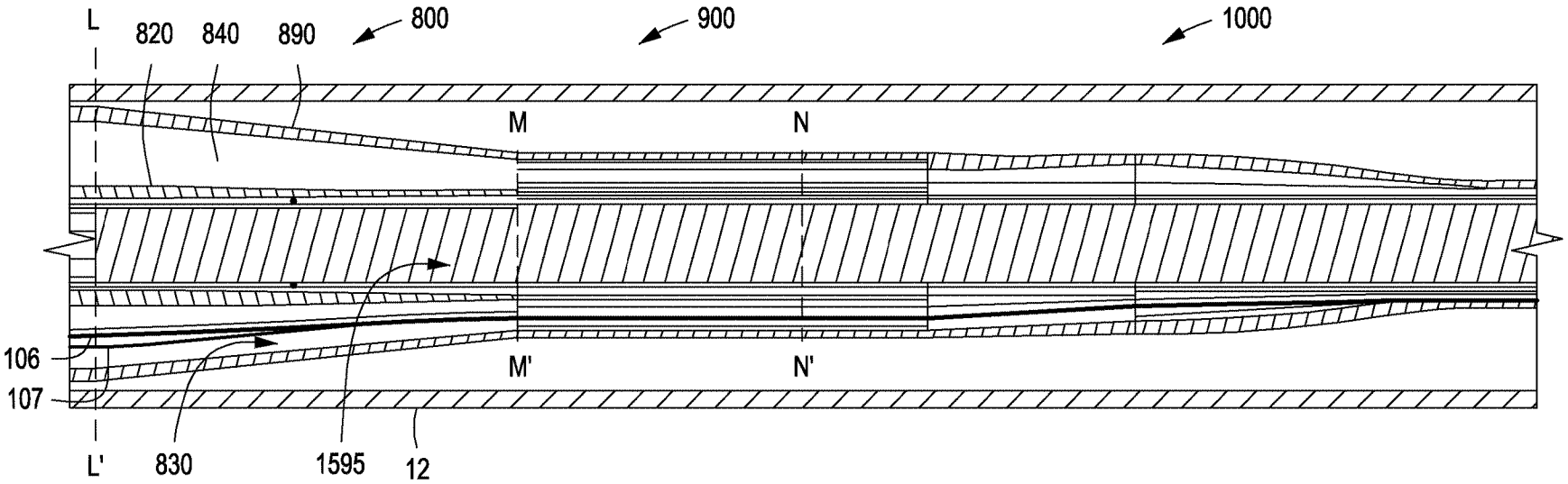
Figures 1B, 4G:
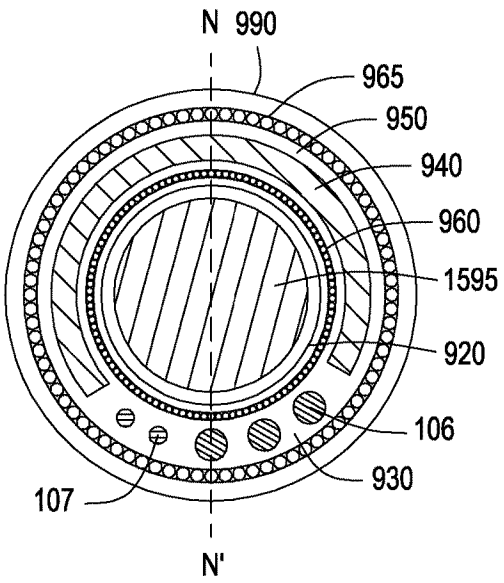
Figures 1A, 4G:
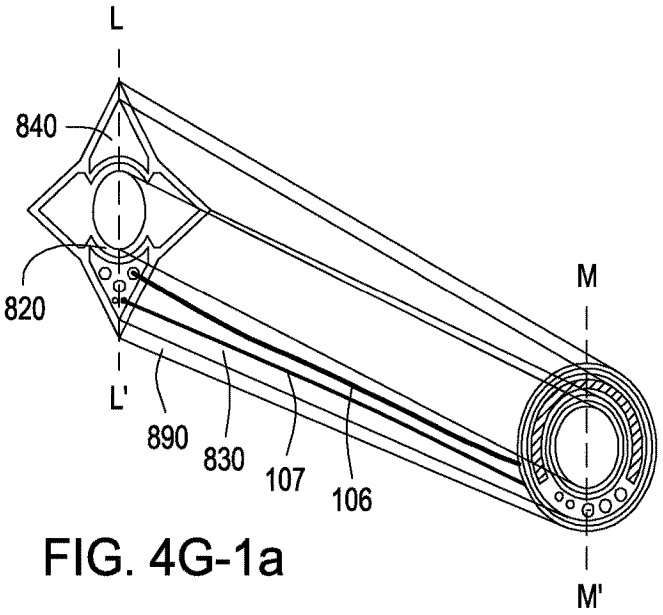
Figures 1, 4H:
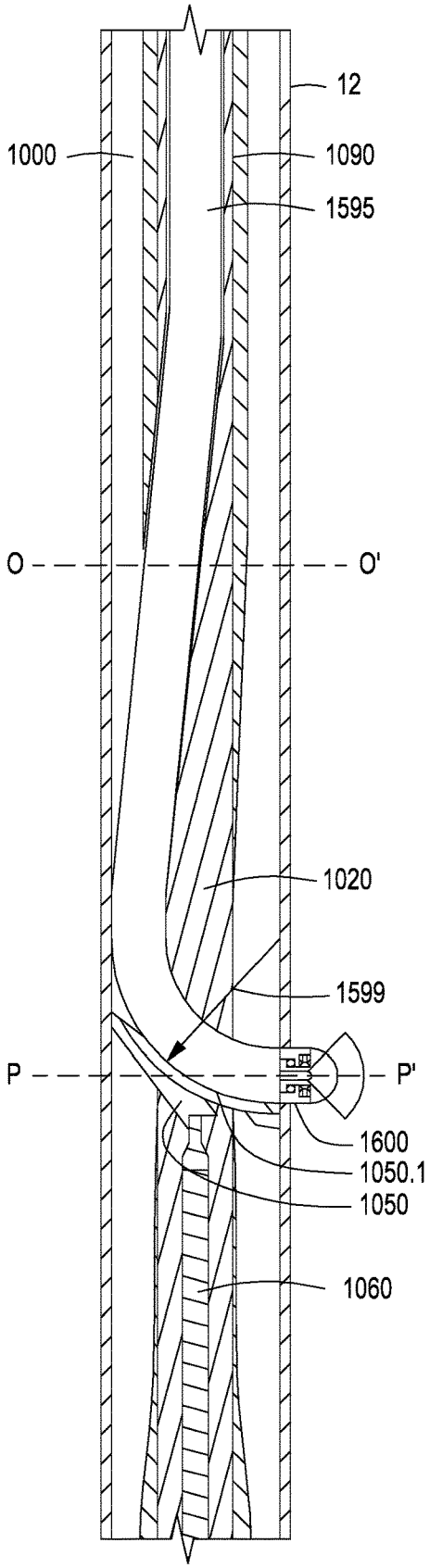
Figures 1A, 4H:
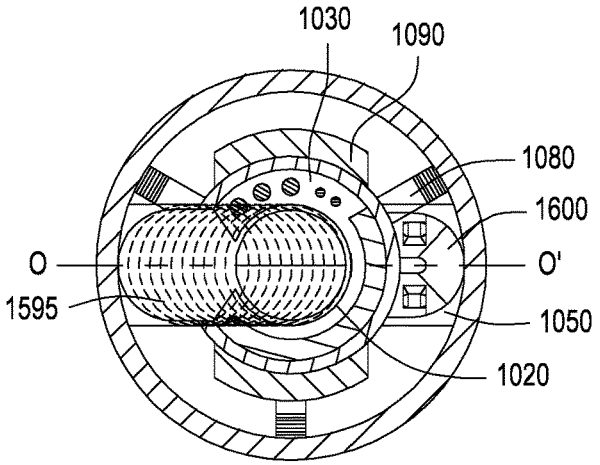
Figures 1B, 4H:
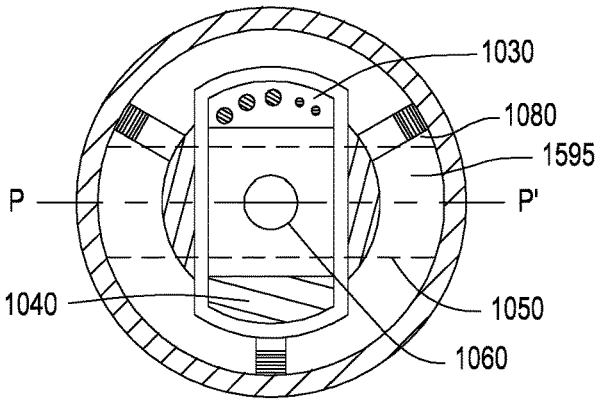

FIG. 4H-1 is a cross-sectional view of the whipstock member 1000 of the external system of FIG. 4, but shown vertically instead of horizontally. The jetting hose of the internal system (FIG. 3) is shown bending across the whipstock face 1050, and extending through a window "W" in the production casing 12. The jetting nozzle of the internal system 1500 is shown affixed to the distal end of the jetting hose 1595.

FIG. 4H-1*a* is an axial, cross-sectional view of the whipstock member 1000, with a perspective view of sequential axial jetting hose cross-sections depicting its path downstream from the center of the whipstock member 1000 at line O-O' to the start of the jetting hose's bend radius as it approaches line P-P'.

FIG. 4H-1*b* depicts an axial, cross-sectional view of the whipstock member 1000 at line P-P'. Note the adjustments in location and configuration of both the whipstock member's wiring chamber and hydraulic fluid chamber from line O-O' to line P-P'.

As noted above, the present assembly 50 is preferably used in connection with a nozzle having a unique design. FIGS. 3F-1*a* and 3F-1*b* provide enlarged, cross-sectional views of the nozzle 1600 of FIG. 3, in a first embodiment. The nozzle 1600 takes advantage of a rotor/stator design, wherein the forward portion 1620 of the nozzle 1600, and hence the forward jetting slot (or "port") 1640, is rotated. Conversely, the rearward portion of the nozzle 1600, which itself is directly connected to jetting hose 1595, remains stationary relative to the jetting hose 1595. Note in this arrangement, the jetting nozzle 1600 has a single forward discharge slot 1640.

First, FIG. 3F-la presents a basic nozzle body having a stator 1610. The stator 1610 defines an annular body having a proximal end 1611 and a series of inwardly facing shoulders 1615 equi-distantly spaced therein. The nozzle 1600 also includes a rotor 1620. The rotor 1620 also defines a body and has a series of outwardly facing shoulders 1625 equi-distantly spaced therearound. In the arrangement of FIG. 3F-la, the stator body 1610 has six inwardly-facing shoulders 1615, while the rotor body 1620 has four outwardly-facing shoulders 1625.

Residing along each of the shoulders 1615 is a small diameter, electrically conductive wire 1616 wrapping the stator's inwardly facing shoulders (or "stator poles") 1615 with multiple wraps. Movement of electrical current through the wires 1616 thus creates electro-magnetic forces in accordance with a DC rotor/stator system. Power to the wires is provided from the batteries 1551 (or battery pack 1550) of FIG. 3A.

As noted above, the stator 1610 and rotor 1620 bodies are analogous to a direct drive motor. The stator 1610 (in this depiction, a six-pole stator) of this direct drive electric motor analog is included within the outer body of the nozzle 1600 itself, with each pole protruding directly from the body 610, and commensurately wrapped in electric wire 1616. The current source for the wire 1616 wrapping the stator poles is derived through the 'bundled' electrical wires 1590 of the jetting hose 1595, and is thereby manipulated by the current regulator and micro-servo mechanism housed in the conically-shaped battery pack's (downstream) end-cap 1530. Rotation of the rotor 1620 of the nozzle 1600, and particularly the speed of rotation (RPM's), is controlled via induced electro-magnetic forces of a DC rotor/stator system.

Note that FIG. 3F-1*a* could serve as a representative axial cross section of essentially any basic direct current electromagnetic motor, with the central shaft/bearing assembly removed. By eliminating a central shaft and bearings, the nozzle 1600 can now accommodate a nozzle throat 1650 placed longitudinally through its center. The throat 1650 is suitable for conducting high pressure fluid flow.

FIG. 3F-1*b* provides a longitudinal, cross-sectional view of the nozzle 1600 of FIG. 3F-1*a*, taken across line C-C' of FIG. 3F-1*b*. The rotor 1620 and surrounding stator 1610 are again seen. Bearings 1630 are provided to facilitate relative rotation between the stator body 1610 and the rotor body 1620.

It is observed in FIG. 3F-1*b* that the nozzle throat 1650 has a conically-shaped narrowing portion before terminating in the single fan-shaped discharge slot 1640. This profile provides two benefits. First, additional non-magnetic, high-strength material may be placed between the throat 1650 and the magnetized rotor portion 1625 of the forward portion of the nozzle body 1620. Second, final acceleration of the jetting fluid through the throat 1650 is accommodated before entering the discharge slot 1640. The size, placement, load capacity, and freedom of movement of the bearings 1630 are considerations as well. The forward slot 1640 begins with a relatively semi-hemispherically shaped opening, and terminates at the forward portion of the nozzle 1600 in a curved, relatively elliptical shape (or, optionally, a curved rectangle with curved small ends.)

Simulations were conducted with the single planar slot slightly twisted such that the discharge angle(s) of the fluid generated sufficient thrust so as to rotate the nozzle 1600. The observed problem was that nozzle rotation rates were hypersensitive to changes in fluid flow rates, leaving the concern of instantaneous and frequent overloading (with resultant failure) of the bearings 1630. The solution was to design, as nearly as possible, a balanced single slot system, such that there is no appreciable axial thrust generated by fluid discharge. In other words, the nozzle 1600 is no longer sensitive to injection rate.

At this point it is important to note the basic nozzle design criteria for the flow capacity of the combined flow path comprised of the throat 1650 and slot 1640 elements. That is, that these inner throat 1650 and slot 1640 elements of the nozzle 1600 retain dimensions that can approximate the dimensions, and resultant hydraulics, of conventional hydraulic jet casing perforators. Specifically, the nozzle 1600 depicted in FIGS. 3F-1*a* and 3F-1*b* throat 1650 and slot 1640 dimensions that can approximate the perforating hydraulics obtained by a perforator's ⅛th-inch orifice. Note that the terminal width of slot 1640 can not only accommodate 100 mesh sand as an abrasive, but the larger sizes such as 80 mesh sand as well.

Angles $\theta_{SLOT}$ 1641 and $\theta_{MAX}$ 1642 are shown in FIG. 3F-1*b*. (These angles are also shown in FIGS. 3F-2*b* and 3F-3*b*, discussed below.) Angle $\theta_{SLOT}$ 1641 represents the actual angle of the outer edges of the slot 1640, and angle $\theta_{MAX}$ 1642 represents the maximum $\theta_{SLOT}$ 1641 achievable within the existing geometric and construction constraints of the nozzle 1600. In FIGS. 3F-1*b*, 3F-2*b* and 3F-3*b*, both angles $\theta_{SLOT}$ 1641 and $\theta_{MAX}$ 1642 are shown at 90 degrees. This geometry, coupled with rotation of the rotor body 1620 (and, consequently, rotation of the jetting slot 1640) provides for the erosion of a hole diameter that is at least equal to the nozzle's outer diameter even at a stand-off (e.g., the distance from the very tip of the nozzle 1600 at the longitudinal center line to the target rock along the same centerline) of zero.

Figures 2A, 3F:
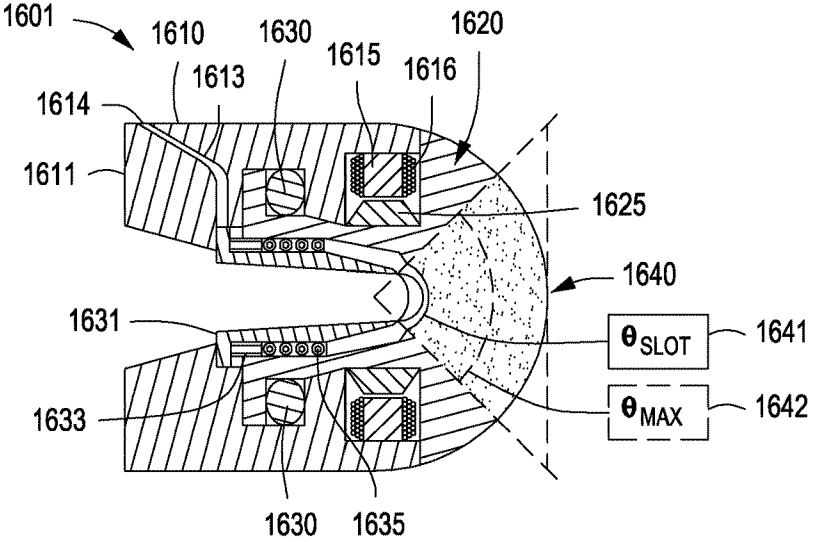

FIGS. 3F-2*a* and 3F-2*b* provide longitudinal, cross-sectional views of the jetting nozzle of FIG. 3E, in an alternate embodiment. In this embodiment, multiple ports are used, including both a forward discharge port 1640 and a plurality of rearward thrust jets 1613, for a modified nozzle 1601.

The nozzle configuration of FIGS. 3F-2*a* and 3F-2*b* is identical to the nozzle configuration 1600 of FIG. 3F-1*a*, with the exception of three additional components:

(1) the use of rearward thrusting jets 1613;
(2) the use of a slideable collar 1633 biased by a biasing mechanism (spring) 1635; and
(3) the use of a slideable nozzle throat insert, or sleeve 1631.

The first of these three additional components, rearward thrusting jets 1613, provide a rearward thrust that effectively drags the jetting hose 1595 along the lateral borehole, or mini-lateral, as it is formed. Preferably, five rearward thrust jets 1613 are used along the body 1610, although variations of the number and/or exit angle(s) 1614 of the jets 1613 may be utilized.

Figures 2C, 3F:
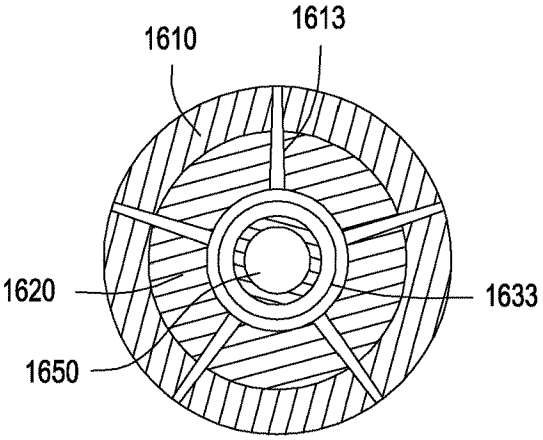
Figures 3B, 3F:
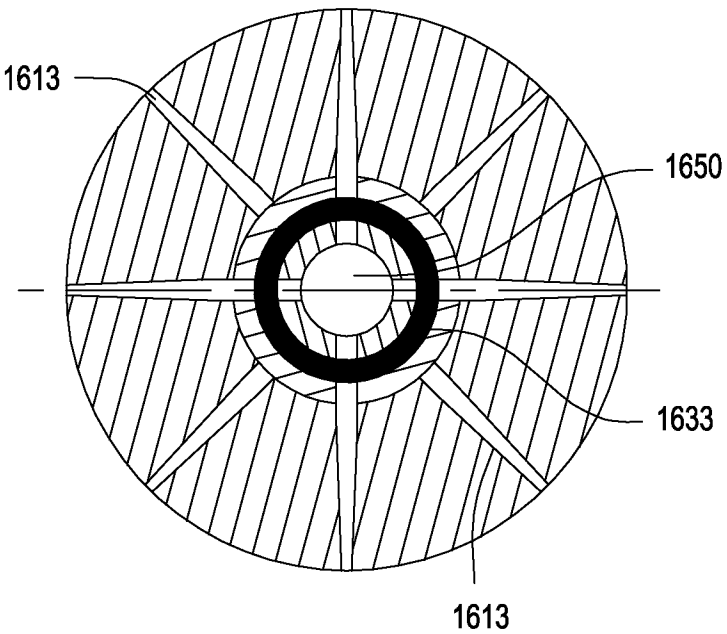
Figures 3A, 3F:
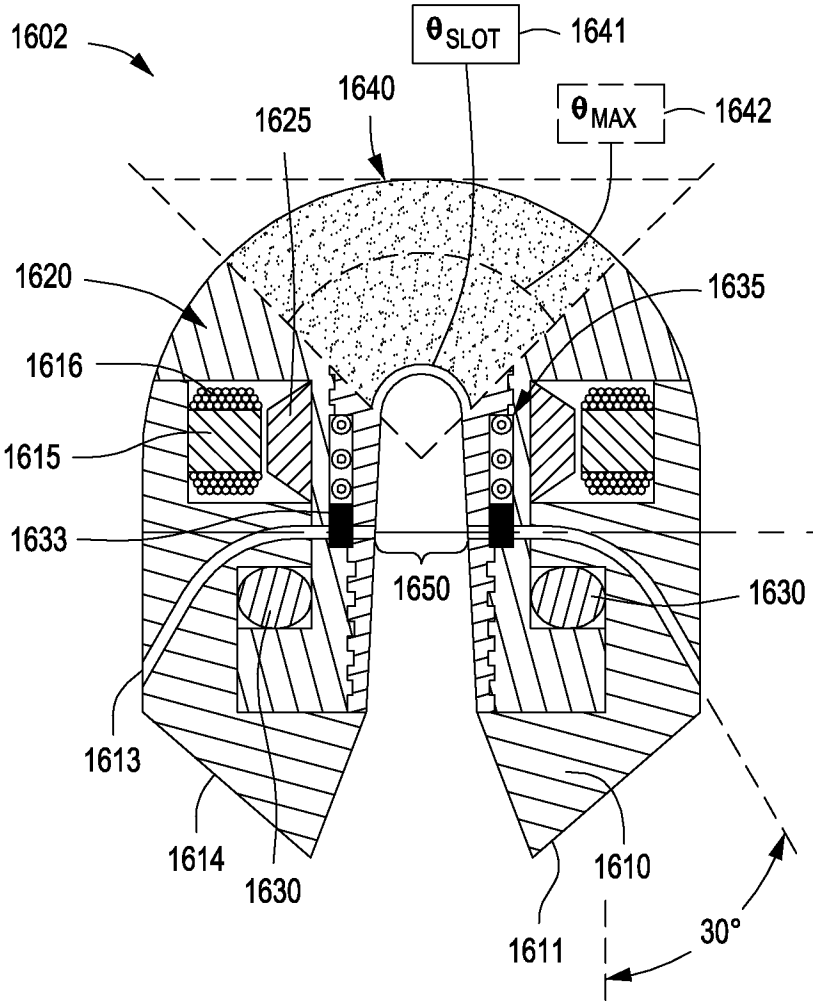
Figures 3C, 3D, 3F:
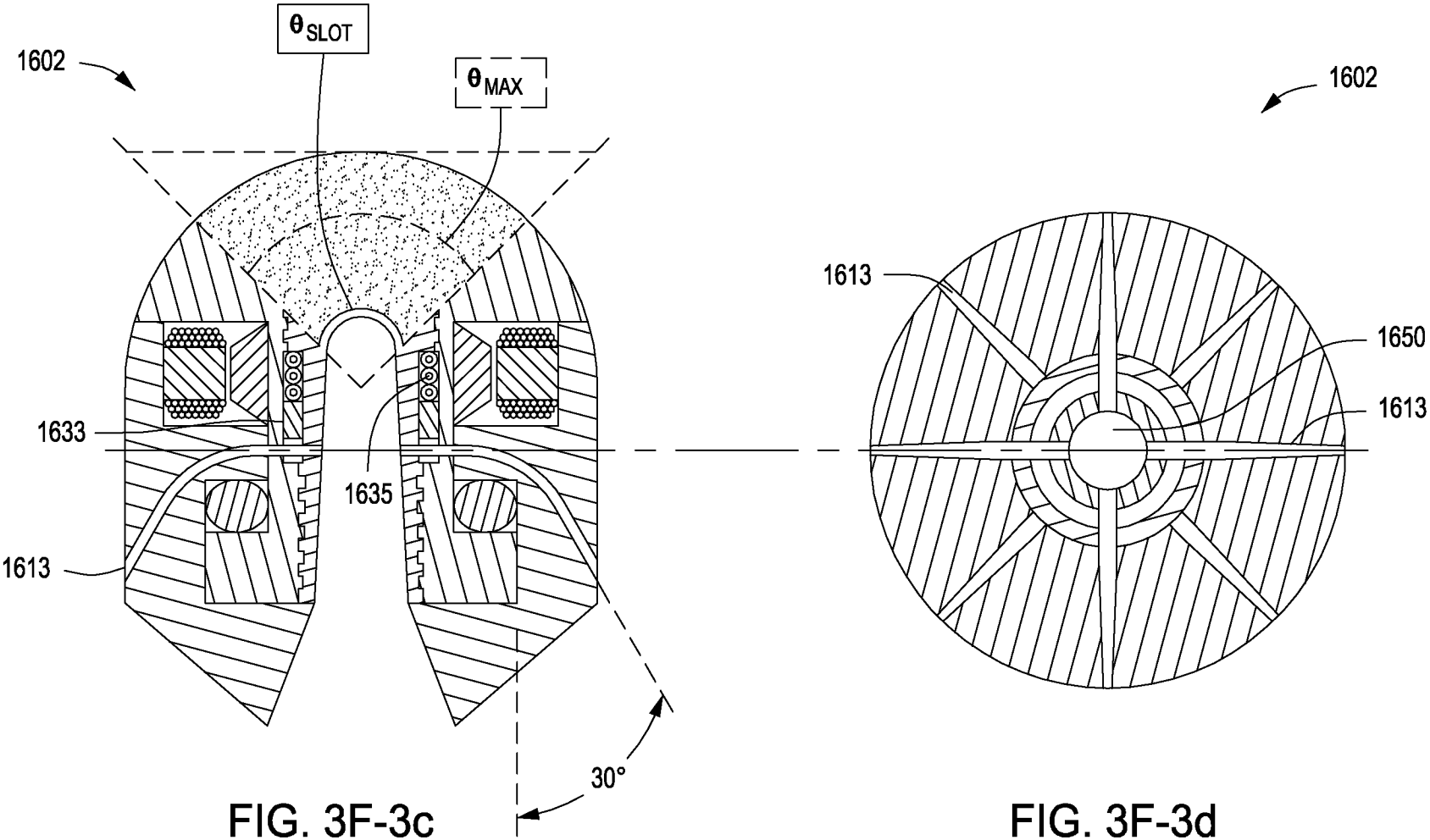

FIG. 3F-2*c* is an axial, cross-sectional view of the jetting nozzle 1601 of FIGS. 3F-2*a* and 3F-2*b*. This demonstrates the star-shaped jet pattern created by the multiple rearward thrust jets 1613. Five points are seen in the star, indicating five illustrative rearward thrust jets 1613.

Note particularly in a homogeneous host pay zone, the forward (jetting) hydraulic horsepower requirement necessary to excavate fresh rock at a given rate of penetration would be essentially constant. The rearward thrust hydraulic horsepower requirement, however, is constantly increasing in proportion to the growth in length of the mini-lateral. As continued extension of the mini-lateral requires dragging an ever-increasing length of jetting hose 1595 along an ever-increasing distance, the rearward thrusting hydraulic horsepower requirement to maintain forward propulsion of the jetting nozzle 1601 and hose 1595 increases commensurately.

It may be required to consume upwards of two-thirds of available horsepower through the rearward thrust jets 1613 in order to extend the jetting hose 1595 and connected nozzles 1601, 1602 to the furthest lateral extent. If this maximum requirement is utilized constantly throughout the borehole jetting process, much of the available horsepower will be wasted in the early stages in jetting the bore. This is particularly detrimental when the same jetting nozzle and assembly utilized in rock excavation is also utilized to form the initial casing exit "W." Further, if the same rearwards jetting forces cutting the 'points' of the star-shaped rock excavation are active in the wellbore tubulars (particularly, while jetting the casing exit "W") significant damage to the nearby tool string (particularly, the whipstock member 1000) and the well casing 12 could result. Hence, the optimum design would provide for the activation/deactivation of the rearward thrust jets 1613 when desired, particularly, after the casing exit is formed and after the first 5 or 10 feet of lateral borehole is formed.

There are several possible mechanisms by which jet activation/deactivation may be enabled to help conserve HHP and protect the tool string and tubulars. One approach is mechanical, whereby the opening and closing of flow to the jets 1613 is actuated by overcoming the force of a biasing mechanism. This is shown in connection with the spring 1635 of FIGS. 3F-2*a* and 3F-2*b*, where a throat insert (or sleeve) 1631 and a slideable collar 1633 are moved together to open rearward thrust jets 1613. Another approach is electromagnetic, wherein a collar (without a sleeve) is pulled against a biasing mechanism (spring 1635) by electromagnetic forces. This is shown in connection with FIGS. 3F-3*a* and 3F-3*c*, discussed below.

The second of the three additions incorporated into the nozzle design of FIGS. 3F-2*a* and 3F-2*b* is that of a slideable collar 1633. The collar 1633 is biased by a biasing mechanism (spring) 1635. The function of this collar 1633, whether directly or indirectly (by exerting a force on the slideable sleeve 1631), is to temporarily seal the fluid inlets of the thrust jets 1613. Note that this sealing function by the slideable collar 1633 is "temporary"; that is, unless a specific condition determined by the biasing mechanism 1635 is satisfied. As shown in the embodiment presented in FIGS. 3F-2*a* and 3F-2*b*, the biasing mechanism 1635 is a simple spring.

In FIG. 3F-2*a*, the collar 1633 is in its closed position, while in FIG. 3F-2*b* the collar 1633 is in its open position. Thus, a specific differential pressure exerted on the cross-sectional area of the sleeve 1631 has overcome the pre-set compressive force of the spring 1635.

The third of the three additions incorporated into the nozzle 1601 design of FIGS. 3F-2*a* and 3F-2*b* is that of the sleeve 1631. The slideable sleeve (or throat insert) 1631 has two basic functions. First, the sleeve 1631 provides an intentional and pre-defined protrusion into the flow path within the nozzle throat 1650. Second, the sleeve 1631 provides an erosion- and abrasion-resistant surface within the highest fluid velocity portion of the internal system 1500. For the first of these functions, the degree of protrusion to be designed into the slideable nozzle throat insert 1631 is a function of at what point in mini-lateral formation the operator anticipates actuating the thrust jets 1613.

To illustrate, suppose that system hydraulics provide for a suitable pump rate of 0.5 BPM through the nozzle 1601 at the point of casing exit "W," and that this can be sustained at a surface pumping pressure of 8,000 psi. Suppose further that actuation of the thrust jets 1613 in the nozzle 1601 is not required until the nozzle 1601 achieves a lateral distance of 50 feet from the parent wellbore. That is, particularly while jetting the casing exit "W" itself and an abrasive mixture (say, of 1.0 ppg of 100 mesh sand in a 1 pound guar-based fresh water gel system) is being pumped, none of the jets 1613 have been opened (which could risk clogging by the abrasive in the jetting fluid mixture.) Consequently, no abrasives are included in the jetting fluid after it is sure that the nozzle 1600 has sufficiently cleared the casing exit "W". Accordingly, while jetting the hole in production casing 12 to form casing exit "W", no rearwards jetting forces from fluids expelled through thrust jets 1613 can pose a threat to unintentionally damage either the jetting hose 1595, the whipstock member 1000, or the production casing 12.

Later, after generating the casing exit "W" plus a mini-lateral length of, say, approximately 50 feet, the pump pressure is increased to 9,000 psi, the incremental 1,000 psi increase in surface pumping pressure being sufficient to overcome the force of the biasing mechanism 1635 and act against the cross-sectional area of the protrusion of the sleeve 1631 to actuate the jets 1613. Thus, at mini-lateral length of 50 feet from the parent wellbore 4, the thrust jets 1613 are actuated, and high pressure rearwards thrust flow is generated through the jets 1613.

Suppose these conditions are sufficient to continue jetting a mini-lateral out to a lateral length of 300 feet. At 300 feet, the length of jetting hose laying against the floor of the mini-lateral is causing a commensurate frictional resistance such that it and the thrust forces generated through the thrust jets 1613 are in approximate equilibrium. (Instrumentation such as tensiometers, for example, would indicate this.) At this point, the pump rate is increased to, say, 10,000 psi, and the rearward thrust jets 1613 remain actuated, but at higher differential pressures and flow rates, thus generating higher pull force on the jetting hose 1595.

FIGS. 3F-3*a* and 3F-3*c* provide longitudinal, cross-sectional views of a jetting nozzle 1602, in yet another alternate embodiment. Here, multiple rearward thrust jets 1613, and a single forward jetting slot 1640, are again used. A collar 1633 and spring 1635 are again used for providing selective fluid flow through rearward thrust jets 1613.

FIGS. 3F-3*b* and 3F-3*d* provide axial, cross-sectional views of the jetting nozzle 1602 of FIGS. 3F-3*a* and 3F-3*c*, respectively. These demonstrate the star-shaped jet pattern created by the multiple jets 1613. Eight points are seen in the star, indicating two sets of four (alternating) illustrative thrust jets 1613. In FIGS. 3F-3*a* and 3F-3*b*, the collar 1633 is in its closed position, while in FIGS. 3F-3*c* and 3F-3*d* the collar 1633 is in its open position permitting fluid flow through the jets 1613. The biasing force provided by the spring 1635 has been overcome.

The nozzle 1602 of FIGS. 3F-3*a* and 3F-3*c* is similar to the nozzle 1601 of FIGS. 3F-2*a* and 3F-2*b*; however, in the arrangement of FIGS. 3F-3*a* and 3F-3*c*, an electro-magnetic force generating a downstream magnetic pull against the slideable collar 1633, sufficient to overcome the biasing force of the biasing mechanism (spring) 1635, replaces the hydraulic pressure force against the slideable sleeve 1631 in the jetting nozzle 1601 of FIGS. 3F-2*a* and 3F-2*b*.

Figures 1A, 1B, 1C, 3G:
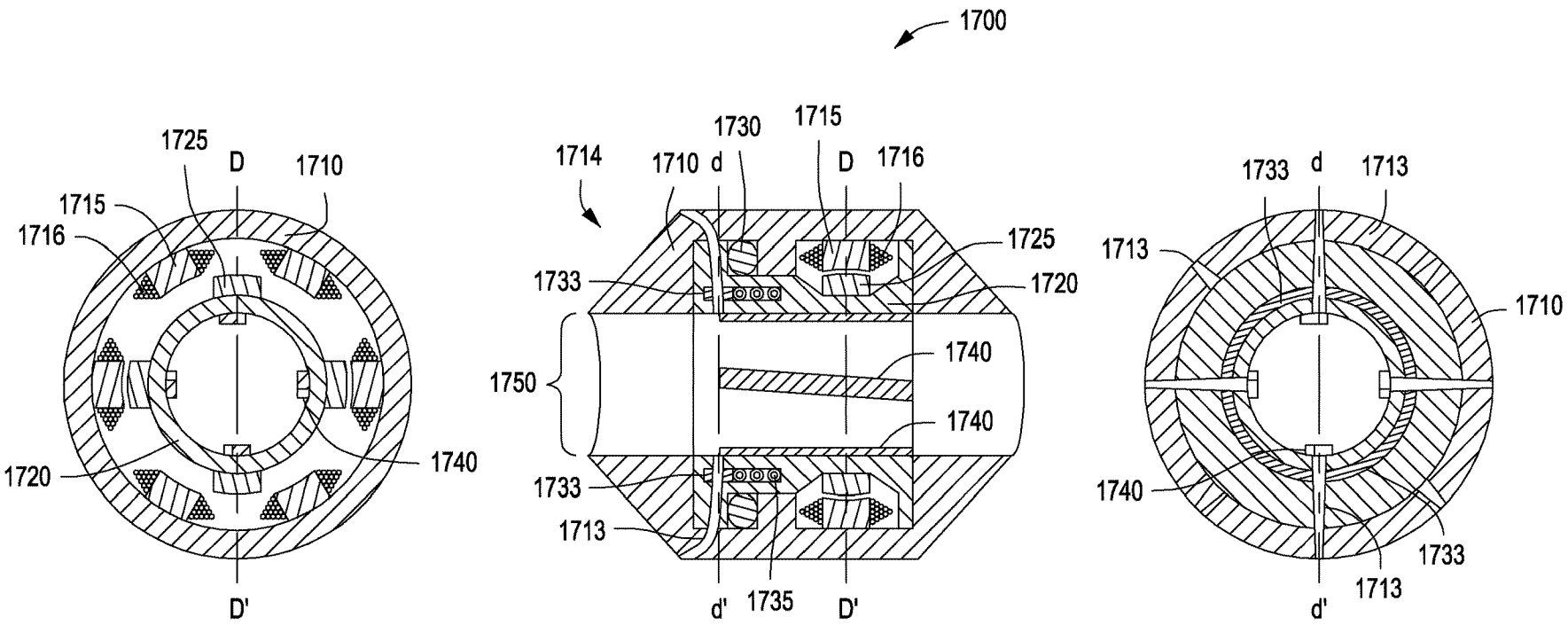

The nozzle 1602 of FIGS. 3F-3*a* and 3F-3*c* presents yet another preferred embodiment of a rotating nozzle 1602, also suitable for forming casing exits and continued excavation through a cement sheath and host rock formation. In FIGS. 3F-3*a* and 3F-3*c* (and in FIG. 3G-1, described in more detail below), it is the electromagnetic force generated by the rotor/stator system that must overcome the spring 1635 force to open hydraulic access to the rearward thrust jets 1613 (and 1713). (Note that in FIG. 3G-1, depicting an in-line hydraulic jetting collar, discussed more fully below, direct mechanical connection of internal turbine fins 1740 to the slideable collar 1733 change the biasing criteria to one of differential pressure, as in FIG. 3F-2*a*). The key here is the ability to keep the fluid inlets to the rearward thrust jets 1613 (and 1713) closed until the operator initiates opening them, specifically by increasing the pump rate, such that either (or both) the differential pressure through the nozzle and/or the nozzle rotation speed's proportional increase of electromagnetic pull on the slideable collars 1633/1733 opens access to the fluid inlets of the thrust jets 1613/1713.

It is also observed that in the nozzle 1602, the number of rearward thrust jets 1613, though also symmetrically placed about the circumference of the rotor 1610, has been increased from a single set of five to two sets of four. Note that each of the four jets 1613 within each of the two sets are also symmetrically placed about the rotor 1610 circumference, orthogonally relative to each other; hence, the two sets of jets 1613 must overlap. Additionally, the path of each jet now not only travels through the rearward (stator) portion 1610 of the nozzle 1602, but now also through the forward (rotor) section 1620 of the nozzle 1602. Note, however, as depicted in FIGS. 3F-3*b* and 3F-3*d*, whereas there are eight individual jet passages through the rearward (stator) portion 1610 of the nozzle 1602, there are only four passing through the forward (rotor) section 1620 of the nozzle 1600. Hence, rotation of the forward (rotor) section 1620 of the nozzle 1602 will only provide for the alignment of, and subsequent fluid flow through, only one set of four jets 1613 at a time. In fact, for most of a single rotation's duration, the flow channels of the rotor 1620 will have no access to those of the stator 1610, and are thereby effectively sealed. The result will be an oscillating (or, "pulsating") jetting flow through the rearward thrust jets 1613.

The commensurate subtraction of jetting fluid volumes going through the nozzle port 1640 produces a commensurate pulsating forward jetting flow for excavation, as well. The benefits of pulsating flow over and against continuous flow for excavation systems are well documented, and will not be repeated here. Note, however, the subject nozzle design not only captures the rock excavation benefits of a rotating jet, but also the benefits of a pulsating jet.

Another embodiment of a thrust collar that employs an electromagnetic force is provided in FIGS. 3G-1*a* and 3G-1*b*. FIGS. 3G-1*a* presents an axial, cross-sectional view of a basic body for a thrust jetting collar 1700 of the internal system 1500 of FIG. 3. The view is taken through line D-D' of FIG. 3G-1*b*. Here, as with the jetting nozzle 1602, two layers of rearward thrust jets 1713 are again offered.

The collar 1700 has a rear stator 1710 and an inner (rotating) rotor 1720. The stator 1710 defines an annular body having a series of inwardly facing shoulders 1715 equi-distantly spaced therein, while the rotor 1720 defines a body having a series of outwardly facing shoulders 1725 equi-distantly spaced therearound. In the arrangement of FIG. 3G.1.*a*, the stator body 1710 has six inwardly-facing shoulders 1715, while the rotor body 1720 has four outwardly-facing shoulders 1725.

Residing along each of the shoulders 1715 is a small diameter, electrically conductive wire 1716 wrapping the stator's 1710 inwardly facing shoulders (or, "stator poles") 1715 with multiple wraps. Movement of electrical current through the wires 1716 thus creates electro-magnetic forces in accordance with a DC rotor/stator system. Power to the wires is provided from the batteries 1551 of FIG. 3A.

FIG. 3G-1*b* is a longitudinal, cross-sectional view of the nozzle 1700. FIG. 3G-1*c* is an axial cross section intersecting the thrust jets 1713 along line d-d' of FIG. 3G-1*b*.

FIGS. 3G-1*a* thru 3G-1*c* show the embodiment of similar concepts for the rotating nozzles 1600, 1601, and 1602, but with modifications adapting the apparatus for use as an in-line thrust jetting collar 1700. One or more of these jetting collars 1700 can be strategically placed "in-line" along the body of the jetting hose, thereby supplying supplemental drag force where needed. Note particularly the retention of a flow-through rotor 1725 providing a collar throat 1750, coupled with a stator 1715 and bearings 1730. However, the stationary flow channels for the rearward thrusting jets 1713 penetrating the stator 1710 are staggered, being in two sets of four. The single set of four orthogonal jets penetrating the rotor 1725 will, for each full rotation, "match-up" four times each with the jets penetrating the stator 1710, each match-up providing a four-pronged instantaneous pulsed flow spaced equi-distant about the outer circumference of the collar 1700. Similar to the rotating nozzle 1602, the slideable collar 1733 is moved electromagnetically against a biasing mechanism (spring) 1735 to actuate flow through the rearward thrust jets 1713.

FIG. 3G-1*c* is another cross-sectional view, showing the star pattern of the rearward thrust jets 1713. Eight points are seen.

A unique opportunity exists to configure the collar 1733 as either a net power consumer or a net power provider. The former would rely on the battery pack-provided power, just as the jetting nozzle 1600 does, to fire the stator, rotate the rotor, and generate the requisite electromagnetic field. The latter is accomplished by incorporating interior, slightly angled turbine fins 1740 within the I.D. of the rotor 1720, hence harnessing the hydraulic force of the jetting fluid as it is pumped through the collar 1700. Such force would be dependent only on the pump rate and the configuration of the turbine fins 1740.

In one aspect, internal turbine fins 1740 are placed equidistant about the collar throat 1750, such that hydraulic forces are harnessed both to rotate the rotor 1720 and to supply a net surplus of electrical current to be fed back into the internal system's circuitry. This may be done by sending excess current back up wires 1590. The ability to incorporate a rotor/stator configuration into construction of the rearward thrust jet collar enables a full-opening I.D. equal to that of the jetting hose. More than ample hydroelectric power could be obtained to generate the electromagnetic field needed to operate the slideable port collar 1733, the surplus being available to be fed into the now "closed" electrical system incurred once the internal system 1500 disengages from the docking station 325. Hence, this surplus hydroelectric power generated by the collar 1700 may beneficially be used to maintain charges of the batteries 1551 in the battery pack 1550.

It is observed that the various nozzle designs 1600, 1601, 1602 discussed above are designed to jet not only through a rock matrix, but also through the steel casing and the surrounding cement sheath of the wellbore 4*c* in order to reach the rock. The nozzle designs incorporate the ability to handle relatively large mesh-size abrasives through the forward nozzle jetting port 1640 prior to engaging the RTJ's 1613. It is understood though that other nozzle designs may be used that accomplish the purpose of forming mini-laterals but which are not so robust as to cut through steel.

In the various nozzle designs 1600, 1601, 1602 discussed above, a single forward port in a hemispherically-shaped nozzle is used. The forward port 1640 is defined by the angles $\theta_{MAX}$ (whereby the width of the jet is equal to the width of the nozzle when the outermost edge of the jet reaches a point forward equivalent to the nozzle tip) and $\theta_{SLOT}$ (the actual slot angle). Note $\theta_{SLOT} \leq \theta_{MAX}$. For presentation purposes herein, $\theta_{SLOT} = \theta_{MAX}$, such that even if the tip of the rotating nozzle was against the host rock face while jetting, it would still excavate a rock tunnel diameter equal to the outer (maximum) nozzle diameter. It is this single-plane, rotating slot configuration that will provide a maximum width in order to accommodate ample pass-through capacity for any abrasives that may be incorporated in the jetting fluid.

The preferred rearward orifice jet orientation is from 30° to 60° from the longitudinal axis. The rearward thrust jets 1613/1713 are designed to be symmetrical about the circumference of the nozzle's/collar's stator body 1610. This maintains a purely forwards orientation of the jetting nozzle 1600, 1601, 1602 along the longitudinal axis. Accordingly, there should be at least three jets 1613/1713 spaced equidistant about the circumference, and preferably five equidistant jets 1613/1713.

As noted above, the nozzle in any of its embodiments may be deployed as part of a guidance, or geo-steering, system. In this instance, the nozzle will include at least one geo-spatial chip, and will employ at least three actuator wires. The actuator wires are spaced equi-distant about the nozzle, and receive electrical current, or excitation, from the electrical wires 1590 already provided in the jetting hose 1595.

FIG. 3F-1*c* is a longitudinal cross-sectional view of the jetting nozzle 1600 of FIG. 3F-1*b*, in a modified embodiment. Here, the jetting nozzle 1600 is shown connected to a jetting hose 1595. The connection may be a threaded connection; alternatively, the connection may be by means of welding. In FIG. 3F-1*c*, an illustrative weld connection is shown at 1660.

In the arrangement of FIG. 3F-1*c*, the jetting nozzle 1600 includes a geo-spatial chip 1670. The geo-spatial chip 1670 resides within an IC chip port seal 1675. The geo-spatial chip 1670 may comprise a two-axial or a three-axial accelerometer, a bi-axial or a tri-axial gyroscope, a magnetometer, or combinations thereof. The present inventions are not limited by the type of geo-spatial chip used unless expressly so stated in the claims. Preferably, the chip 1670 will be associated with a micro-electro-mechanical system residing on or near the nozzle body such as shown and described in connection with the nozzle embodiments (1600, 1601, 1602) described above.

FIG. 3F-1*d* is an axial-cross-sectional view of the jetting hose 1590 of FIG. 3F-1*c*, taken across line c-c'. Visible in this view are power wires 1590 and actuator wires 1590A. Also visible are optional fiber optic data cables 1591. The wires 1590, 1590A, 1591 may be used to transmit geo-location data from the chip 1670 up to a micro-processor in the battery pack section 1550, and then wirelessly to a receiver located in the docking station (shown best at 325 in FIG. 4D-1*b*), wherein the receiver communicates with the micro-processor in the docking station 325. Preferably, the micro-processor in the docking station 325 processes the geo-location data, and makes adjustments to electrical current in the actuator wires 1590A (using one or more current regulators), in order to ensure that the nozzle is oriented to hydraulically bore the lateral boreholes in a pre-programmed direction.

The micro-transmitter in the battery pack is preferably housed in the battery pack's downstream end cap 1530, while the docking station 325 is preferably affixed to the interior of a jetting hose carrier system 400 (described below in connection with FIGS. 3A, 3B-1, and 4D-1). The receiver housed in the docking station 325 may be in electrical or optical connection with a micro-processor at the surface 1. For example, a fiber optic cable 107 may run along the coiled tubing conveyance system 100, to the surface 1, where the geo-location data is processed as part of a control system.

The reverse (surface-to-downhole instrumentation) communication is likewise facilitated by hard-wired (again, preferably fiber optic) connection of surface instrumentation, through fiber optic cable 107 within coiled tubing conveyance medium 100 and external system 2000, to a specific terminus receiver (not shown) housed within the docking station 325. An adjoining wireless transmitter within the docking station 325 then transmits the operator's desired commands to a wireless receiver housed within the end cap 1530 of the internal system 1500. This communication system allows an operator to execute commands setting both the rotational speed and/or the trajectory of the jetting nozzle 1600.

When the nozzle 1600 exits the casing, the operator knows the location and orientation of the nozzle 1600. By monitoring the length of jetting hose 1590 that is translated out of the jetting hose carrier, integrated with any changes in orientation, the operator knows the geo-location of the nozzle 1600 in the reservoir.

In one option, a desired geo-trajectory is first sent as geo-steering command from the surface 1, down the coiled tubing 100, and to the micro-processor associated with the docking station 325. Upon receiving a geo-steering command from the surface 1, such as from an operator or a surface control system, the micro-processor will forward the signals on wirelessly to a corresponding micro-receiver associated with the battery pack section 1550. That signal, in turn, will engage one or more current regulators to alter the current conducted down one, two, or all three of the at least three electric wires 1590, connected directly to the jetting nozzle 1600. Note that at least part of these electrical wire connections, preferably segments closest to the jetting nozzle 1600, are comprised of actuator wires 1590A, such as the Flexinol® actuator wires manufactured by Dynalloy, Inc. These small diameter, nickel-titanium wires contract when electrically excited. This ability to flex or shorten is characteristic of certain alloys that dynamically change their internal structure at certain temperatures. The contraction of actuator wires is opposite to ordinary thermal expansion, is larger by a hundredfold, and exerts tremendous force for its small size. Given close temperature control under a constant stress, one can get precise position control, i.e., control in microns or less. Accordingly, given (at least) three separate actuator wires 1590A positioned at-or-near equidistant around the perimeter and within the body of the jetting hose (toward its end, adjacent to the jetting nozzle 1600), a small increase in current in any given wire will cause it to contract more than the other two, thereby steering the jetting nozzle 1600 along a desired trajectory. Given an initial depth and azimuth via the geo-spatial chip 1675 in the nozzle 1600, a determined path for a lateral borehole 15 may be pre-programmed and executed automatically.

Of interest, the actuator wires 1590A have a distal segment residing along a chamber or sheath, or even interwoven within the matrix of the distal segment of the jetting hose 1595. Further, the distal end of the actuator wires 1590A may continue partially into the nozzle body, wrapping the stator poles 1615 to connect to, or even form the electromagnetic coils 1616. This is also demonstrated in FIG. 3F-1*c*. In this way, electrical power is provided from the battery pack section 1550 to induce the relative rotational movement between the rotor body and the stator body.

As can be seen from the above discussion, an internal system 1500 for a hose jetting assembly 50 is provided. The system 1500 enables a powerful hydraulic nozzle (1600, 1601, 1602) to jet away subsurface rock in a controlled (or steerable) manner, thereby forming a mini-lateral borehole that may extend many feet out into a formation. The unique combination of the internal system's 1500 jetting fluid receiving funnel 1570, the upper seal 1580U, the jetting hose 1595, in connection with the external system's 2000 pressure regulator valve 610 and pack-off section 600 (discussed below) provide for a system by which advancement and retraction of the jetting hose 1595, regardless of the orientation of the wellbore 4, can be accomplished entirely by hydraulic means. Alternatively, mechanical means may be added through use of an internal tractor system 700, described more fully below.

Not only can the above-listed components be controlled to determine the direction of the jetting hose 1595 propulsion (e.g., either advancement or retraction), but also the rate of propulsion. The rate of advancement or retraction of the internal system 1500 may be directly proportional to the rate of fluid (and pressure) bleed-off and/or pump-in, respectively. Specifically, "pumping the hose 1595 down-the-hole" would have the following sequence:

(1) the micro-annulus 1595.420 between the jetting hose 1595 and the jetting hose carrier's inner conduit 420 is filled by pumping hydraulic fluid through the main control valve 310, and then through the pressure regulator valve 610; then (2) the main control valve 310 is switched electronically using surface controls to begin directing jetting fluid to the internal system 1500; which (3) initiates a hydraulic force against the internal system 1500 directing jetting fluid through the intake funnel 1570, into the jetting hose 1595, and "down-the-hole"; such force being resisted by (4) compressing hydraulic fluid in the micro-annulus 1595.420; which is (5) bled-off, as desired, from surface control of the pressure regulator valve 610, thereby regulating the rate of "down-the-hole" decent of the internal system 1500.

Similarly, the internal system 1500 can be pumped back "up-the-hole" by directing the pumping of hydraulic fluid through (first) the main control valve 310 and (secondly) through the pressure regulator valve 610, thereby forcing an ever-increasing (expanding) volume of hydraulic fluid into the micro-annulus 1595.420 between the jetting hose 1595 and the jetting hose conduit 420, which pushes upwardly against the bottom seals 1580L of the jetting hose seal assembly 1580, thereby driving the internal system 1500 back "up-the-hole". The direction and rate of propulsion of the internal system 1500 by hydraulic means can be either augmented or replaced by propulsion of the internal system 1500 via the mechanical means of the internal tractor system 700, also described below.

Beneficially, once the jetting hose assembly 50 is deployed to a downhole location adjacent a desired point of casing exit "W" within a parent wellbore 4 of any inclination (including at-or-near horizontal), the entire length of jetting hose 1595 can be deployed and retrieved without any assistance from gravitational forces. This is because the propulsion forces used to both deploy and retrieve the jetting hose 1595, and to maintain its proper alignment while doing so, are either hydraulic or mechanical, as described more fully, below. Note also these propelling hydraulic and mechanical forces are available in more than sufficient quantities as to overcome any frictional forces from movement of the internal system 1500 (including, specifically, the jetting hose 1595) within the external system 2000 (including, specifically, the jetting hose conduit 420) induced by any non-vertical alignment, and to maintain the hose 1595 in a substantially taught state along the hose length within the external system 2000. Hence, these hydraulic and mechanical propulsion forces overcome the "can't-push-a-rope" limitation in its entirety.

Hydraulic force to advance the jetting hose 1595 within and subsequently out of the external system 2000 will be observed any time jetting fluid is being pumped; specifically, force in a plane parallel to the longitudinal axis of the jetting hose 1595, in an upstream-to-downstream direction, as hydraulic force is exerted against the upstream end-cap of the battery pack 1520, the fluid intake funnel 1570, the interior face of the jetting nozzle 1600, e.g., any internal system 1500 surface that is both: (a) exposed to the flow of jetting fluid; and, (b) having a directional component not parallel to the longitudinal axis of the parent wellbore. As these surfaces are rigidly attached to the jetting hose 1595 itself, this upstream-to-downstream force is conveyed directly to the jetting hose 1595 whenever jetting fluid is being pumped from the surface 1, down the coiled tubing conveyance medium 100 (seen in FIG. 2), and through the jetting fluid passage 345 within the main control valve 300 (described below in connection with FIG. 4C-1). Note the function of the only other valve in this system, the pressure regulator valve 610 located just upstream of the pack-off seal assembly 650 of pack-off section 600 (seen and described in connection with FIGS. 4E-1 and 4E-2), is simply to release pressure from the compression of hydraulic fluid within the jetting hose 1595/jetting hose conduit 420 annulus 1595.420 (seen in FIGS. 3D-1*a* and 4D-2) commensurate with the operator's desired rate of decent of the internal system 1500.

Conversely, hydraulic forces are operational in propelling the internal system 1500 in a downstream-to-upstream direction whenever hydraulic fluid is being pumped from the surface 1, down the coiled tubing conveyance medium 100, and through the hydraulic fluid passage 340 within the main control valve 300. In this configuration, the pressure regulator valve 610 allows the operator to direct injected fluids into the jetting hose 1595/jetting hose conduit 420 annulus 1595.420 commensurate with the operator's desired rate of ascent of the internal system 1500. Thus, hydraulic forces are available to assist in both conveyance and retrieval of the jetting hose 1595.

Similarly, mechanical forces applied by the internal tractor system 700 assist in conveyance, retrieval, and maintaining alignment of the jetting hose 1595. The close tolerance between the O.D. of the jetting hose 1595 and the I.D. of the jetting hose conduit 420 of jetting hose carrier system 400, thus defining annulus 1595.420, serves to provide confining axial forces that assist in maintaining the alignment of the hose 1595, such that the portion of the hose 1595 within the jetting hose carrier system 400 can never experience significant buckling forces. Direct mechanical (tensile) force for both deployment and retrieval of the jetting hose 1595 is applied by direct frictional attachment of grippers 756 of specially-designed gripper assemblies 750 of the internal tractor system 700 to the jetting hose 1595, discussed below in connection with FIGS. 4F-1 and 4F-2.

As described above, jetting hose conveyance is also assisted by the hydraulic forces emanating from the rearward thrusting jets 1613 of the jetting nozzle 1601, 1602 itself; and, if included, from the rearward thrust jets 1713 of any added jetting collar(s) 1700. These furthest downstream hydraulic forces serve to advance the jetting hose 1595 forward into the pay zone 3 simultaneously with the creation of the UDP 15 (FIG. 1B), maintaining the forward-aimed jetting fluid proximally to the rock face being excavated. The balance between deploying hydraulic energy forward proximate to the nozzle (for excavating new hole) versus rearward (for propulsion) requires balance. Too much rearward propulsion, and there is not enough residual hydraulic horsepower focused forward to excavate new hole. If there is too much forward propulsion, there is insufficient horsepower remaining to drag the jetting hose along the mini-lateral. Hence, the ability to redirect either rearward or forward focused hydraulic horsepower through the nozzle in situ as described herein is a major enhancement.

For presentation purposes, two configurations of rearward thrust jets 1613/1713 have been included herein—one for pulsating flow wherein eight rearward thrust jets, each inclined at 30° from the longitudinal axis and spaced equi-distant about the circumference, are grouped into two sets of four, with rearwards flow alternating (or 'pulsing') between the two sets; and one for continuous flow, wherein a single set of five jets, each inclined at 30° from the longitudinal axis and spaced equi-distant about the circumference, are shown. However, other jet numbers and angles may be employed.

The FIG. 3 series of drawings, and the preceding paragraphs discussing those drawings, are directed to the internal system 1500 for the hydraulic jetting assembly 50. The internal system 1500 provides a novel system for conveying the jetting hose 1595 into and out of a parent wellbore 4 for the subsequent steerable generation of multiple mini-lateral boreholes 15 in a single trip. The jetting hose 1595 may be as short as 10 feet or as long as 300 feet or even 500 feet, depending on the thickness of the formation, the compressive strength or the desired geo-trajectory of the mini-lateral boreholes.

As noted, the hydraulic jetting assembly 50 also provides an external system 2000, uniquely designed to convey, deploy, and retrieve the internal system 1500 previously described. The external system 2000 is conveyable on conventional coiled tubing 100; but, more preferably, is deployed on a "bundled" coiled tubing product (FIGS. 3D-1*a*, 4A-1 and 4A-1*a*) providing for real-time power and data transmission.

Consistent with the related and co-owned patent documents cited herein, the external system 2000 includes a jetting hose whipstock member 1000 including a whipstock 1050 having a curved face 1050.1 that preferably forms the bend radius for the jetting hose 1595 across the entire I.D. of the production casing 12. The external system 2000 may also include a conventional tool assembly comprised of mud motor(s) 1300, (external) coiled tubing tractor(s) 1350, logging tools 1400 and/or a packer or a bridge plug (preferably, retrievable) that facilitate well completion. In addition, the external system 2000 provides for power and data transmission throughout, so that real time control may be provided over the downhole assembly 50.

FIG. 4 is a longitudinal, cross-sectional view of an external system 2000 of the downhole hydraulic jetting assembly 50 of FIG. 2, in one embodiment. The external system 2000 is presented within the string of production casing 12. For clarification, FIG. 4 presents the external system 2000 as "empty"; that is, without containing the components of the internal system 1500 described in connection with the FIG. 3 series of drawings. For example, the jetting hose 1595 is not shown. However, it is understood that the jetting hose 1595 is largely contained in the external system during run-in and pull-out, before boring operations commence.

In presenting the components of the external system 2000, it is assumed that the system 2000 is run into production casing 12 having a standard 4.50" O.D. and approximate 4.0" I.D. In one embodiment, the external system 2000 has a maximum outer diameter constraint of 2.655" and a preferred maximum outer diameter of 2.500". This O.D. constraint provides for an annular (i.e., between the system 2000 O.D. and the surrounding production casing 12 I.D.) area open to flow equal to or greater than 7.0309 $in^2$, which is the equivalent of a 9.2#, 3.5" frac (tubing) string.

The external system 2000 is configured to allow the operator to optionally "frac" down the annulus between the coiled tubing conveyance medium 100 (with attached apparatus) and the surrounding production casing 12. Preserving a substantive annular region between the O.D. of the external system 2000 and the I.D. of the production casing 12 allows the operator to pump a fracturing (or other treatment) fluid down the subject annulus immediately after jetting the desired number of lateral bores and without having to trip the coiled tubing 100 with attached apparatus 2000 out of the parent wellbore 4. Thus, multiple stimulation treatments may be performed with only one trip of the assembly 50 in to and out of the parent wellbore 4. Of course, the operator may choose to trip out of the wellbore for each frac job, in which case the operator would utilize standard (mechanical) bridge plugs, frac plugs and/or sliding sleeves. However, this would impose a much greater time requirement (with commensurate expense), as well as much greater wear and fatigue of the coiled tubing-based conveyance medium 100.

In actuality, rigorous adherence to the (O.D.) constraint is perhaps only essential for the coiled tubing conveyance medium 100, which may comprise over 90% of the length of the system 50. Slight violations of the O.D. constraint over the comparatively minute lengths of the other components of the external system 2000 should not impose significant annular hydraulic pressure drops as to be prohibitive. If these outer diameter constraints can be satisfied, while maintaining sufficient inner diameters so as to accommodate the design functionality of each of the components (particularly of the external system 2000), and this can be accomplished for a system 50 that operates in the smaller of standard oilfield production casing 4 sizes of 4.5" O.D., then there should be no significant barriers to adapting the system 50 to any of the larger standard oilfield production casing sizes (5.5", 7.0", etc.).

Figures 1, 4I:
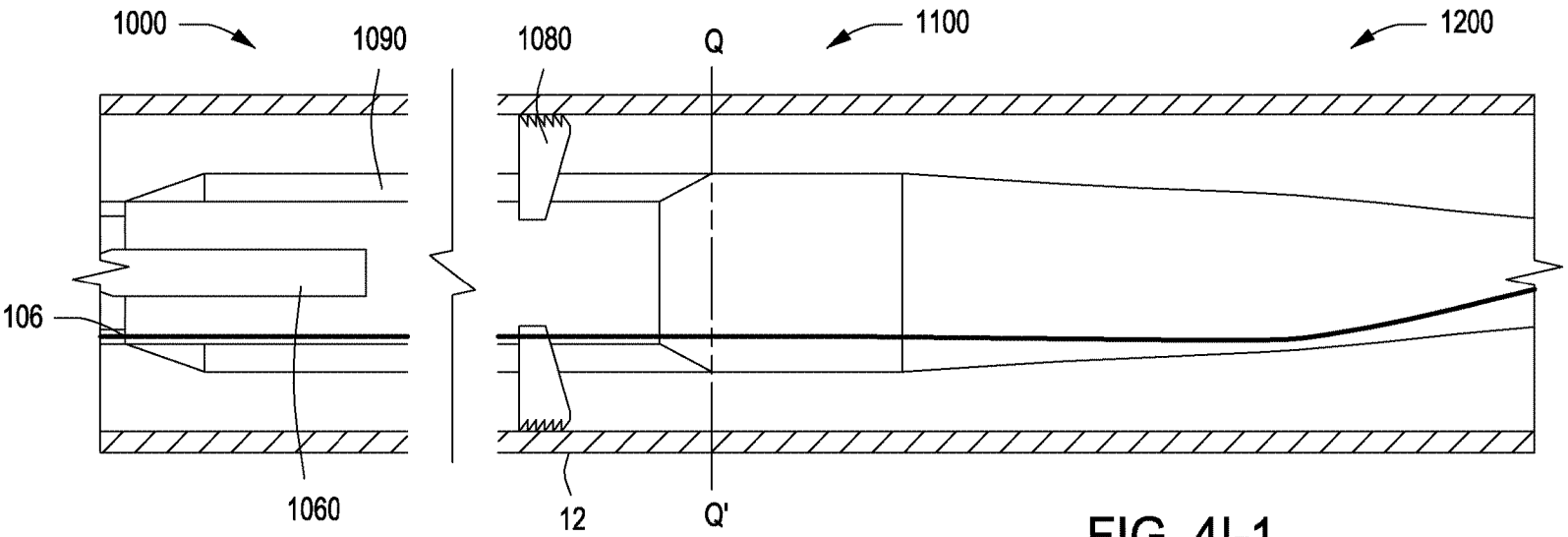
Figures 1A, 4I:
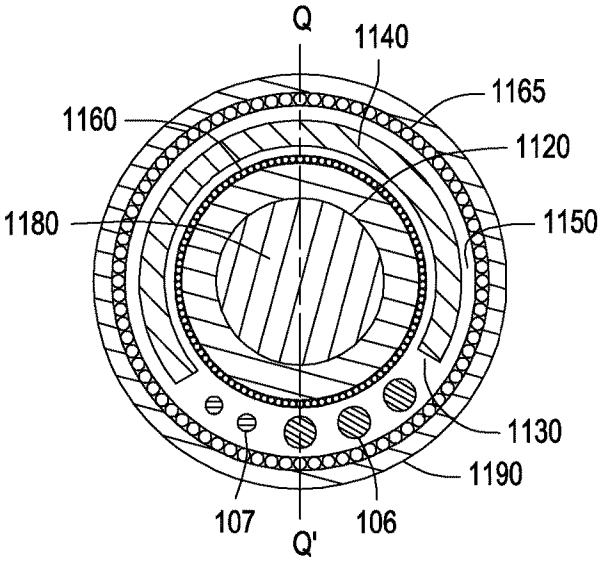
Figure 4J:
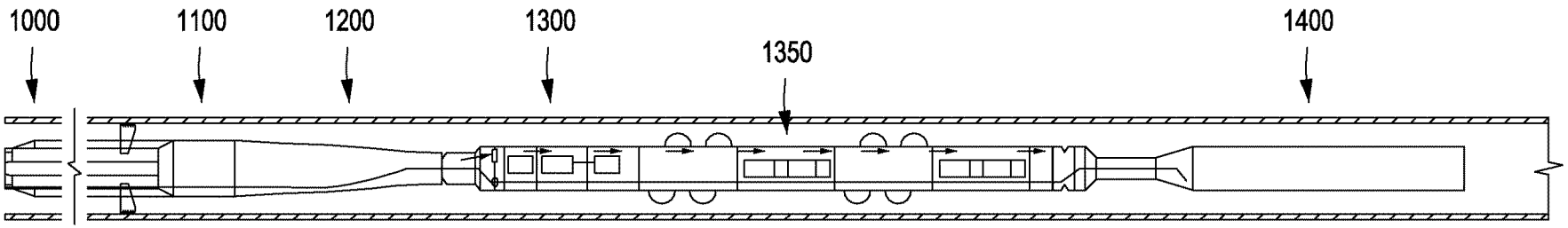
FIG. 4J is another longitudinal view of the bottom swivel of FIG. 4I-1. Here, the bottom swivel is connected to a transition section, which in turn is connected to a conventional mud motor, an external tractor, and a logging sonde, thus completing the entire downhole tool string. For simplification, neither a packer nor a retrievable bridge plug has been included in this configuration.

Presentation of each of the major components of the external system 2000, which follows below, will be in an upstream-to-downstream direction. Note in FIG. 4 the demarcation of the major components of the external system 2000, with the corresponding Figure(s) herein:

a. the coiled tubing conveyance medium 100, presented in FIGS. 4A-1 and 4A-2;
b. the first crossover connection (the coiled tubing transition) 200, presented in FIG. 4B-1;
c. the main control valve 300, presented in FIG. 4C.1;
d. the jetting hose carrier system, 400 with its docking station 325, presented in FIGS. 4D-1 and 4D-2;
e. the second crossover connection 500 (transitioning the outer body from circular to star-shaped) and the jetting hose pack-off section 600, presented in FIGS. 4E-1 and 4E-2;
f. the internal tractor system 700 and the third crossover connection 800, presented in FIGS. 4F-1 and 4F-2;
g. the third crossover connection 800 and the upper swivel 900, presented in FIG. 4G-1;
h. the whipstock member 1000, presented in FIG. 4H-1;
i. the lower swivel 1100, presented in FIG. 4I-1; and, lastly,
j. the transitional connection 1200 to the conventional coiled tubing mud motor 1300 and a conventional coiled tubing tractor 1350, coupled to a conventional logging sonde 1400, presented in FIG. 4J.

FIG. 4A-1 is a longitudinal, cross-sectional view of a "bundled" coiled tubing conveyance medium 100. The conveyance medium 100 serves as a conveyance system for the downhole hydraulic jetting assembly 50 of FIG. 2. The conveyance medium 100 is shown residing within the production casing 12 of a parent wellbore 4, and extending through a heel 4*b* and into the horizontal leg 4*c*.

FIG. 4A-1*a* is an axial, cross-sectional view of the coiled tubing conveyance medium 100 of FIG. 4A-1. It is seen that the conveyance medium 100 includes a core 105. In one aspect, the coiled tubing core 105 is comprised of a standard 2.000" O.D. (105.2) and 1.620" I.D. (105.1), 3.68 lbm/ft. HSt110 coiled tubing string, having a Minimum Yield Strength of 116,700 lbm and an Internal Minimum Yield Pressure of 19,000 psi. This standard sized coiled tubing provides for an inner cross-sectional area open to flow of 2.06 $in^2$. As shown, this "bundled" product 100 includes three electrical wire ports 106 of up to 0.20" in diameter, which can accommodate up to AWG #5 gauge wire, and 2 data cable ports 107 of up to 0.10" in diameter.

The coiled tubing conveyance medium 100 also has an outermost, or "wrap," layer 110. In one aspect, the outer layer 110 has an outer diameter of 2.500", and an inner diameter bonded to and exactly equal to that of the O.D. 105.2 of the core coiled tubing string 105 of 2.000".

Both the axial and longitudinal cross-sections presented in FIGS. 4A-1 and 4A-1*a* presume bundling the product 100 concentrically, when in actuality, an eccentric bundling may be preferred. An eccentric bundling provides more wrap layer protection for the electrical wiring 106 and data cables 107. Such a depiction is included as FIG. 4A-2 for an eccentrically bundled coiled tubing conveyance medium 101. Fortunately, eccentric bundling would have no practical ramifications on sizing pack-off rubbers or wellhead injector components for lubrication into and out of the parent wellbore, since the O.D. 105.2 and circularity of the outer wrap layer 110 of an eccentric conveyance medium 101 remain unaffected.

The conveyance medium 101 may have, for example, an internal flow area of 2.0612 $in^2$, a core wall thickness 105 of 0.190 $in^2$, and an average outer wall thickness of 0.25 $in^2$. The outer wall 110 may have a minimum thickness of 0.10 $in^2$.

Note the main design criteria of the conveyance medium, whether concentrically 100 or eccentrically 101 bundled, is to provide real-time power (via electrical wiring 106) and data (via data cabling 107) transmission capacities to an operator located at the surface 1 while deploying, operating, and retrieving apparatus 50 in the wellbore 4. For example, in a standard e-coil system, components 106 and 107 would be run within the coiled tubing core 105, thereby exposing them to any fluids being pumped via the I.D. 105.1 of the core 105. Given the subject method provides for pumping abrasives within a high-pressure jetting fluid (particularly, while eroding casing exit "W" from within production casing 12), it is preferred instead to locate components 106 and 107 at the O.D. 105.2 of the core 105.

Similarly, the subject method provides for pumping proppants within high pressure hydraulic fracturing fluids down the annulus between the coiled tubing conveyance medium 100 (or 101) and production casing 12. Hence, the protective coiled tubing wrap layer 110 is preferably of sufficient thickness, strength, and erosive resistance to isolate and protect components 106 and 107 during fracturing operations.

The present conveyance medium 100 (or 101) also maintains a sufficiently large inner diameter 105.1 of the core wall 105 such as to avoid appreciable friction losses (as compared to the losses incurred in the internal system 1500 and external system 2000) while pumping jetting and/or hydraulic fluids. At the same time, the system maintains a sufficiently small outer diameter 110.2 so as to avoid prohibitively large pressure losses while pumping hydraulic fracturing fluids down the annulus between the coiled tubing conveyance medium 100 (or 101) and the production casing 12. Further, the system 50 maintains a sufficient wall thickness for the outer wrap layer 110, whether it is concentrically or eccentrically wrapped about the inner coiled tubing core 105, so as to provide adequate insular protection and spacing for the electrical transmission wiring 106 and the data transmission cabling 107. It is understood that other dimensions and other tubular bodies may be used as the conveyance medium for the external system 2000.

Moving further down the external system 2000, FIG. 4B-1 presents a longitudinal, cross-sectional view of the first crossover connection, the coiled tubing crossover connection 200. FIG. 4B-1*a* shows a portion of the coiled tubing crossover connection 200 in perspective view. Specifically, the transition between lines E-E' and line F-F' is shown. In this arrangement, an outer profile transitions from circular to oval to bypass the main control valve 300.

The main functions of this crossover connection 200 are as follows:

(1) To connect the coiled tubing conveyance medium 100 (or 101) to the jetting assembly 50 and, specifically, to the main control valve 300. In FIG. 4B-1, this connection is depicted by the steel coiled tubing core 105 connected to the main control valve's outer wall 290 at connection point 210.

(2) To transition the electrical cables 106 and data cables 107 from the outside of the core 105 of the coiled tubing conveyance medium 100 (or 101) to the inside of the main control valve 300. This is accomplished with wiring port 220 facilitating the transition of wires/cables 106/107 inside outer wall 290.

(3) To provide an ease-of-access point, such as the threaded and coupled collars 235 and 250, for the splicing/connection of electrical cables 106 and data cables 107.

and (4) To provide separate, non-intersecting and non-interfering pathways for electrical cables 106 and data cables 107 through a pressure- and fluid-protected conduit, that is, a wiring chamber 230.

The next component in the external system 2000 is a main control valve 300. FIG. 4C-1 provides a longitudinal, cross-sectional view of the main control valve 300. FIG. 4C-1*a* provides an axial, cross-sectional view of the main control valve 300, taken across line G-G' of FIG. 4C-1. The main control valve 300 will be discussed in connection with both FIGS. 4C-1 and 4C-1*a* together.

The function of the main control valve 300 is to receive high pressure fluids pumped from within the coiled tubing 100, and to selectively direct them either to the internal system 1500 or to the external system 2000. The operator sends control signals to the main control valve 300 by means of the wires 106 and/or data cable ports 107.

The main control valve 300 includes two fluid passages. These comprise a hydraulic fluid passage 340 and a jetting fluid passage 345. Visible in FIGS. 4C-1, 4C-1*a* and 4C-1*b* (longitudinal cross-sectional, axial cross-sectional, and perspective view, respectively) is a sealing passage cover 320. The sealing passage cover 320 is fitted to form a fluid-tight seal against inlets of both the hydraulic fluid passage 340 and the jetting fluid passage 345. Of interest, FIG. 4C-1*b* presents a three dimensional depiction of the passage cover 320. This view illustrates how the cover 320 can be shaped to help minimize frictional and erosional effects.

The main control valve 300 also includes a cover pivot 350. The passage cover 320 rotates with rotation of the passage cover pivot 350. The cover pivot 350 is driven by a passage cover pivot motor 360. The sealing passage cover 320 is positioned by the passage cover pivot 350 (as driven by the passage cover pivot motor 360) to either: (1) seal the hydraulic fluid passage 340, thereby directing all of the fluid flow from the coiled tubing 100 into the jetting fluid passage 345, or (2) seal the jetting fluid passage 345, thereby directing all of the fluid flow from the coiled tubing 100 into the hydraulic fluid passage 340.

The main control valve 300 also includes a wiring conduit 310. The wiring conduit 310 carries the electrical wires 106 and data cables 107. The wiring conduit 310 is optionally elliptically shaped at the point of receipt (from the coiled tubing transition connection 200, and gradually transforms to a bent rectangular shape at the point of discharging the wires 106 and cables 107 into the jetting hose carrier system 400. Beneficially, this bent rectangular shape serves to cradle the jetting hose conduit 420 throughout the length of the jetting hose carrier system 400.

The next component of the external system 2000 is a jetting hose carrier system 400. FIG. 4D-1 is a longitudinal, cross-sectional view of the jetting hose carrier system 400. The jetting hose carrier system 400 is attached downstream of the main control valve 300. The jetting hose carrier system 400 is essentially an elongated tubular body that houses the docking station 325, the internal system's battery pack section 1550, the jetting fluid receiving funnel 1570, the seal assembly 1580 and connected jetting hose 1595. In the view of FIG. 4D-1, only the docking station 325 is visible so that the profile of the jetting hose carrier system 400 itself is more clearly seen.

FIG. 4D-1*a* is an axial, cross-sectional view of the jetting hose carrier system 400 of FIG. 4D.1, taken across line H-H' of FIG. 4D-1. FIG. 4D-1*b* is an enlarged view of a portion of the jetting hose carrier system 400 of FIG. 4D-1. Here, the docking station 325 is visible. The jetting hose carrier system 400 will be discussed with reference to each of FIGS. 4D-1, 4D-1*a* and 4D-1*b*, together.

The jetting hose carrier system 400 defines a pair of tubular bodies. The first tubular body is a jetting hose conduit 420. The jetting hose conduit 420 houses, protects, and stabilizes the internal system 1500 and, particularly, the jetting hose 1595. As previously presented in the discussion of the internal system 1500, it is the size (specifically, the I.D.), strength, and rigidity of this fluid-tight and pressure-sealing conduit 420 that provides the pathway and particularly, the micro-annulus (shown at 1595.420 in FIG. 3D-1*a*, FIG. 4D-2 and FIG. 4D-2*a*) for the jetting hose 1595 of internal system 1500 to be "pumped down" and reversibly "pumped up" the longitudinal axis of the external system 2000 as it operates within the production casing 12.

The jetting hose carrier section 400 also has an outer conduit 490. The outer conduit 490 resides along and circumscribes the inner conduit 420. In one aspect, the outer conduit 490 and the jetting hose conduit 420 are simply concentric strings of 2.500" O.D. and 1.500" O.D. HSt100 coiled tubing, respectively. The inner conduit, or jetting hose conduit 420, is sealed to and contiguous with the jetting fluid passage 345 of the main control valve 300. When high pressure jetting fluid is directed by the valve 300 into the jetting fluid passage 345, the fluid flows directly and only into the jetting hose conduit 420 and then into the jetting hose 1595.

An annular area 440 exists between the inner (jetting hose) conduit 420 and the surrounding outer conduit 490). The annular area 440 is also fluid tight, directly sealed to and contiguous with the hydraulic fluid passage 340 of the control valve 300. When high pressure hydraulic fluid is directed by the main control valve 300 into the hydraulic fluid passage 340, the fluid flows directly into the conduit-carrier annulus 440.

The jetting hose carrier section 400 also includes a wiring chamber 430. The wiring chamber 430 has an axial cross-section of an upwardly-bent rectangular shape, and receives the electrical wires 106 and data cables 107 from the main control valve's 300 wiring conduit 310. This fluid-tight chamber 430 not only separates, insulates, houses, and protects the electrical wires 106 and data cables 107 throughout the entire length of the jetting hose carrier section 400, but its cradle shape serves to support and stabilize the jetting hose conduit 420. Note the jetting hose carrier section 400 wiring chamber 430 and inner (jetting hose) conduit 420 may or may not be attached either to each other, and/or to the outer conduit 490.

In addition to housing and protecting wires 106 and data transmission cables 107, the wiring conduit 430 within the jetting hose carrier system 400 supports the jetting hose conduit's 420 horizontal axis at a position slightly above a horizontal axis that would bifurcate the outer conduit 490. Different types of materials may be utilized in its construction, given its design constraints are significantly less stringent than those for the outer layer(s) of the CT-based conveyance medium, particularly in regard to chemical and abrasion resistance, as the exterior of the wiring conduit 430 will only be exposed to hydraulic fluid—never jetting or fracturing fluids.

Additional design criteria for the wiring conduit 430 may be invoked if it is desired for it to be rigidly attached to either the jetting hose conduit 420, the outer conduit 490, or both. In one aspect, the wiring conduit 430 has a width of approximately 1.34", and provides three 0.20" diameter circular channels for electrical wiring, and two 0.10" diameter circular channels for data transmission cables. It is understood that other diameters and configurations for the wiring conduit 430 may vary, depending on design objectives, so long as an annular area 440 open to flow of hydraulic fluid is preserved.

Also visible in FIG. 4D-1 is the docking station 325. The docking station 325 resides immediately downstream of the connection between the main control valve 300 and the jetting hose carrier system 400. The docking station 325 is rigidly attached within the interior of the jetting hose conduit 420. The docking station 325 is held in the jetting hose conduit 420 by diagonal supports. The diagonal supports are hollow, the interior(s) of which serving as a fluid- and pressure-tight conduit(s) of leads of electrical wires 106 and data cables 107 into the communications/control/electronics systems of the docking station 325. This is similar to functions of the battery pack support conduits 1560 of the internal system 1500. Whether connected to a servo device, a transmitter, a receiver, or other device housed within the docking station 325, these devices are thereby "hard-wired" via electrical wires 106 and data cables 107 to an operator's control system (not shown) at the surface 1.

FIG. 4D-2 provides an enlarged, longitudinal cross-sectional view of a portion of the jetting hose carrier system 400 of external system 2000, depicting its operational hosting of a commensurate length of jetting hose 1595. FIG. 4D-2*a* provides an axial, cross-sectional view of the jetting hose carrier system 400 of FIG. 4D-2, taken across line H-H'.

Note that the cross-sectional view of FIG. 4D-2*a* matches the cross-sectional view of FIG. 4D-1*a*, except that the conduit 420 in FIG. 4D-1*a* is "empty," meaning that the jetting hose 1595 is not shown.

The length of the jetting hose conduit 420 is quite long, and should be approximately equivalent to the desired length of jetting hose 1595, and thereby defines the maximum reach of the jetting nozzle 1600 orthogonal to the wellbore 4, and the corresponding length of the mini-lateral 15. The inner diameter specification defines the size of the micro-annulus 1595.420 between the jetting hose 1595 and the surrounding jetting hose conduit 420. The I.D. should be close enough to the O.D. of the jetting hose 1595 so as to preclude the jetting hose 1595 from ever becoming buckled or kinked, yet it must be large enough to provide sufficient annular area for a robust set of seals 1580L by which hydraulic fluid can be pumped into the sealed micro-annulus 1595.420 to assist in controlling the rate of deployment of the jetting hose 1595, or assisting in hose retrieval.

It is the hydraulic forces within the sealed micro-annulus 1595.420 that keep the segment of jetting hose (above the internal tractor system 700) straight, and slightly in tension. The I.D. of jetting hose conduit 420 can likewise not be too close to the O.D. of the jetting hose 1595 so as to place unnecessarily high frictional forces between the two. The O.D. of the jetting hose conduit 420 (in conjunction with the I.D. of the outer conduit 490, less the external dimensions of the jetting hose carrier's wiring chamber 430) define the annular area 440 through which hydraulic fluid is pumped. Certainly, if the jetting hose carrier system's inner conduit 420 O.D. is too large, it thereby invokes undue frictional losses in pumping hydraulic fluid. However, if not large enough, then the inner conduit 420 will not have sufficient wall thickness to support either the inner or outer operating pressures required. Note, for the subject apparatus designed to be deployed in 4.5" wellbore casing, the inner string is comprised of 1.5" O.D. and 1.25" I.D. (i.e., 0.125" wall thickness) coiled tubing. If this were 1.84#/ft., HSt110, for example, it would provide for an Internal Minimum Yield Pressure rating of 16,700 psi. Similarly, the outer conduit 490 can be constructed of standard coiled tubing. In one aspect, the outer conduit 490 is comprised of 2.50" O.D. and 2.10" I.D., thereby providing for a wall thickness of 0.20".

Progressing again uphole-to-downhole, the external system 2000 next includes the second crossover connection 500, transitioning to the jetting hose pack-off section 600. FIG. 4E-1 provides an elongated, cross-sectional view of both the crossover connection (or transition) 500 and the jetting hose pack-off section 600. FIG. 4E-1*a* is an enlarged perspective view highlighting the transition's 500 outer body shape, transitioning from circular- to star-shaped. Axial cross-sectional lines I-I' and J-J' illustrate the profile of the transition 500 fittingly matching the dimensions of the outer wall 490 of jetting hose carrier system 400 at its beginning, and an outer wall 690 of the pack-off section 600 at its end.

FIG. 4E-2 shows an enlarged portion of the jetting hose pack-off section 600 of FIG. 4E-1, and particularly sealing assembly 650. The transition 500 and the jetting hose pack-off section 600 will be discussed with reference to each of these views together.

As its name implies, the main function of the jetting hose pack-off section 600 is to "pack-off", or seal, an annular space between the jetting hose 1595 and a surrounding inner conduit 620. The jetting hose pack-off section 600 is a stationary component of the external system 2000. Through transition 500, and partially through pack-off section 600, there is a direct extension of the micro-annulus 1595.420. This extension terminates at the pressure/fluid seal of the jetting hose 1595 against the inner faces of seal cups making up the pack-off seal assembly 650. Immediately prior to this terminus point is the location of the pressure regulator valve, shown schematically as component 610 in FIGS. 4E-1 and 4E-2. It is this valve 610 that serves to either communicate or segregate the annulus 1595.420 from the hydraulic fluid running throughout the external system 2000. The hydraulic fluid takes its feed from the inner diameter of the coiled tubing conveyance medium 100 (specifically, from the I.D. 105.1 of coiled tubing core 105) and proceeds through the continuum of hydraulic fluid passages 240, 340, 440, 540, 640, 740, 840, 940, 1040, and 1140, then through the transitional connection 1200 to the coiled tubing mud motor 1300, and eventually terminating at the tractor 1350. (Or, terminating at the operation of some other conventional downhole application, such as a hydraulically set retrievable bridge plug.)

The crossover connection 500 from the jetting hose carrier system 400 to the pack off section 600 is notable for several reasons:

First, within this transition 500, the free flow of hydraulic fluid from the conduit-carrier annulus 440 of the jetting hose carrier section 400 will be re-directed and re-compartmentalized within the upper (triangular-shaped) quadrant of the star-shaped outer conduit 690. Toward the upstream end of the inner conduit 620 is the pressure regulator valve 610. The pressure regulator valve 610 provides for increasing or decreasing the hydraulic fluid (and commensurately, the hydraulic pressure) in the micro-annulus 1595.420 between the jetting hose 1595 and the surrounding jetting hose conduit 420. It is the operation of this valve 610 that provides for the internal system 1500 (and specifically, the jetting hose 1595) to be "pumped down," and then reversibly "pumped up" the longitudinal axis of the production casing 12.

The upwardly bent, rectangular-shaped fluid-tight chamber 430 that separates, insulates, houses, and protects the electrical wires 106 and data cables 107 along the length of the jetting hose carrier body 400 is transitioned via wiring chamber 530 into a lower (triangular-shaped) quadrant 630 of the star-shaped outer body 690 of the pack-off section 600. This preserves the separation, insulation, housing, and protection of the electrical wires 106 and the data cables 107 in the jetting hose pack-off section 600. The star-shaped outer body 690 forms an annulus between itself and the I.D. of the surrounding production casing 12.

Given the prong-tip-to-opposite-prong-tip distances of the four-pronged star-shaped outer conduit 690 are just slightly less than the I.D. of the production casing 12, the pack-off section 600 also serves to nearly centralize the jetting hose 1595 in the parent wellbores production casing 12. As will be explained later, this near-centralization will translate through the internal tractor system 700 so as to beneficially centralize the upstream end of the whipstock member 1000.

Recall the outer diameter of the upstream end of the jetting hose 1595 is hydraulically sealed against the inner diameter of the inner conduit 420 of the jetting hose carrier system 400 by virtue of the jetting hose's upper 1580U and lower 1580L seals, forming a single seal assembly 1580. The seals 1580U and 1580L, being formably affixed to the jetting hose 1595, travel up and down the inner conduit 420. Similarly, the outer diameter of the downstream end of the jetting hose 1595 is hydraulically sealed against the inner diameter of the pack-off section's 600 inner conduit 620 by virtue of the seal assembly 650 of the pack-off section 600.

Thus, when the internal system 1500 is "docked" (i.e., when the upstream battery pack end cap 1520 is in contact with the external system's docking station 325) then the distance between the two seal assemblies 1580, 620 approximates the full length of the jetting hose 1595. Conversely, when the jetting hose 1595 and jetting nozzle 1600 have been fully extended into the maximum length lateral borehole (or UDP) 15 attainable by the jetting assembly 50, then the distance between the two seal assemblies 1580, 620 is negligible. This is because, though the internal system's jetting hose seal assembly 1580 essentially travels the entire length of the external system's 2000 jetting hose carrier system 400, the seal assembly 650 (of the pack-off section 600 in the external system 2000) is relatively stationary, as the seal cups comprising seal assembly 650 must reside between opposing seal cup stops 615.

Note further how the alignment of the two opposing sets of seal cups comprising seal assembly 650 (e.g., an upstream set facing upstream, placed back-to-back with a downstream set facing downstream) thereby provides a pressure/fluid seal against differential pressure from either the upstream direction or the downstream direction. These opposing sets of seal cups comprising seal assembly 650 are shown with a longitudinal cross section of jetting hose 1595 running concentrically through them, in the enlarged view of FIG. 4E-2.

As noted, the pressure maintained in the micro-annulus 1595.420 by the pressure regulator valve 610 provides for the hydraulic actions of "pumping the hose down the hole" or, reversibly, "pumping the hose up the hole". These annular hydraulic forces also serve to mitigate other, potentially harmful forces that could be imposed on the jetting hose 1595, such as buckling forces when advancing the hose 1595 downstream, or internal burst forces while jetting. Hence, combined with the upper hose seal assembly 1580 and the jetting hose conduit 420, the jetting hose pack-off section 600 serves to maintain the jetting hose 1595 in an essentially taut condition. Hence, the diameter of the hose 1595 that can be utilized will be limited only by the bend radius constraint imposed by the I.D. of the wellbore's production casing 12, and the commensurate pressure ratings of the hose 1595. At the same time, the length of the hose 1595 that may be utilized is certainly well into the hundreds of feet.

Note the most likely limiting constraint of hose 1595 length will not be anything imposed by the external system 2000, but instead will be the hydraulic horsepower distributable to the rearward thrust jets 1613/1713, such that sufficient horsepower can remain forward-focused for excavating rock. As one might expect, the length (and commensurate volume) of mini-laterals that can be jetted will ultimately be a function of rock strength in the subsurface formation. This length limitation is quite unlike the system posited in U.S. Pat. No. 6,915,853 (Bakke, et al.) that attempts to convey the entirety of the jetting hose downhole in a coiled state within the apparatus itself. That is, in Bakke, et al., the hose is stored and transported while in horizontally stacked, 360° coils contained within the interior of the device. In this case, the bend radius/pressure hose limitations are imposed by (among other constraints), not the I.D. of the casing, but by the I.D. of the device itself. This results in a much smaller hose I.D./O.D., and hence, geometrically less horsepower deliverable to Bakke's jetting nozzle.

In operation, after a UDP 15 has been formed and the main control valve 300 has been shifted to shut-off the flow of hydraulic jetting fluid to the internal system 1500 and is then providing flow of hydraulic fluid to the external system 2000, the pressure regulator valve 610 can feed flow into the micro-annulus 1595.420 in the opposite direction. This downstream-to-upstream force will "pump" the assembly back into the wellbore 4 and "up the hole," as the bottom, downwards facing cups 1580L of the seal assembly 1580 will trap flow (and pressure) below them.

The next component within the external system 2000 (again, progressing uphole-to-downhole) is an optional internal tractor system 700. FIG. 4F-1 provides an elongated, cross-sectional view of the tractor system 700, downstream from the jetting hose pack-off section 600. FIG. 4F-2 shows an enlarged portion of the tractor system 700 of FIG. 4F-1. FIG. 4F-2*a* is an axial, cross-sectional view of the internal tractor system 700, taken across line K-K' of FIGS. 4F-1 and 4F-2. Finally, FIG. 4F-2*b* is an enlarged half-view of a portion of the internal tractor system 700 of FIG. 4F-2*a*. The internal tractor system 700 will be discussed with reference to each of these four views together.

It is first observed that two types of tractor systems are known. These are the wheeled tractor systems and the so-called inch-worm tractor systems. Both of these tractor systems are "external" systems, meaning that they have grippers designed to engage the inner wall of the surrounding casing (or, if in an open hole, to engage the borehole wall). Tractor systems are used in the oil and gas industry primarily to advance either a wireline or a string of coiled tubing (and connected downhole tools) along a horizontal (or highly deviated) wellbore—either uphole or downhole.

In the present assembly 50, a unique tractor system has been developed which employs "internal," grippers. This means that gripper assemblies 750 are aimed inwardly, for the purpose of either advancing or retracting the jetting hose 1595 relative to the external system 2000. The result of this inversion is that the coiled tubing string 100 and attached external system 2000 can now be stationary while the somewhat flexible hose 1595 is being translated in the wellbore 4*c*. The outwardly-aimed electrically driven wheels of a conventional ("external") tractor are replaced with inwardly-aimed concave grippers 756. The result is the inwardly-aimed concave grippers 756 frictionally attach to the jetting hose 1595, with subsequent rotation of the grippers 756 propelling the jetting hose 1595 in a direction that corresponds with the direction of rotation.

Note specifically the following consequence of this inversion: In a conventional system, the relative movement that occurs is that of the rigidly gripper-attached body (i.e., the coiled tubing) relative to the stationary, frictionally attached body (i.e., the borehole wall). Conversely, the subject internal tractor system is rigidly attached to the stationary body (i.e., the external system 2000) and the grippers 756 rotate to move the jetting hose 1595. Accordingly, when the internal tractor system 700 is actuated, the whipstock member 1000 will already be in its set and operating position; e.g., the slips of the whipstock member 1000 will be engaged with the inner wall of the casing 12. Hence, all advancement/retraction of the jetting hose 1595 by the tractor system 700 takes place when the external system 2000 itself is set and is stationary within the production casing 12.

It is next observed that the internal tractor system 700 preferably maintains the star-shape profile of the jetting hose pack-off system 600. The star shape profile of the internal tractor system 700, with its four points, helps centralizes the tractor system 700 within the production casing 12. This is beneficial inasmuch as the slips of the whipstock member 1000 (located relatively close to tractor system 700, due to the short lengths of the third crossover connection (or transition) 800 and upper swivel 900 between them, discussed below) will be engaged when operating the tractor system 700, meaning that centralization of the tractor system 700 serves to align the defined path of the jetting hose 1595 and precludes any undo torque at the connection with the jetting hose whipstock device 1000. It is observed in FIGS. 4F-1 and 4F-2*a* that the position of the jetting hose 1595 is approximately centered, both within the tractor system 700 and, therefore, within the production casing 12. This places the hose 1595 in optimum position to be either fed into or retracted from the jetting hose whipstock device 1000.

In addition to centralizing the hose 1595, another function served by the star-shape profile of the tractor system 700 is that it accommodates interior room for placement of two opposing sets of gripper assemblies 750. Specifically, the gripper assemblies 750 reside inside the 'dry' working room of the two side chambers, while simultaneously providing for separate chambers for the electrical wires 106 and data cabling 107 (shown in lower chamber 730) and the hydraulic fluid (in upper chamber 740). At the same time, ample cross-sectional flow area is preserved between the tractor system 700 and the I.D. of the production casing 12 within their respective annular area 700.12 for conducting fracturing fluids.

As shown within the 4.5" production casing 12, the annular area 700.12 open to flow is approximately 10.74 $in^2$, equating to an equivalent pipe diameter (I.D.) of 3.69 in. Recall the design objective is to maintain an annular flow area greater than or equal to the interior area of a typical 3.5" O.D. (2.922" I.D., 10.2#/ft.) frac string, i.e. 6.706 $in^2$. Note then, if the tip-to-tip dimension of opposing prongs of the "star" is, for example, 3.95 in, and (to gain additional internal volume within the four chambers of the tractor system 700) the star shape were changed to a perfect square, then the external area of the square would be 7.801 $in^2$, and the remaining annular area (open to flow of frac fluid) inside the 4.00" I.D. production casing would be 4.765 $in^2$, which is equivalent to a 2.463" pipe I.D. Hence, though the base of each triangular chamber within the star shape could be somewhat expanded to provide additional internal volumes or wall thickness, the outer perimeter cannot be completely squared-off and still satisfy the preferred 3.5" frac string criteria. Note, however, there is no reason the triangular dimensions of each chamber must remain symmetrical; e.g., the dimensions could be varied individually in order to accommodate each chamber's internal volume requirements, just as long as the 3.5" frac string requirement is still preferably satisfied.

Each of the gripper assemblies 750 is comprised of a miniature electric motor 754, and a motor mount 755 securing the motor 754 to the outer wall 790. In addition, each of the gripper assemblies 750 includes a pair of axles. These represent a gripper axle 751 and a gripper motor axle 753. Finally, each of the gripper assemblies 750 includes gripper gears 752.

The tractor system 700 also includes bearing systems 760. The bearing systems 760 are placed along the length of inner walls 720. These bearing systems 760 isolate frictional forces against the jetting hose 1595 at the contact points of the grippers 756, and eliminate unwanted frictional drag against the inner walls 720.

Rearward rotation of the grippers 756 serve to advance the hose 1595, while forward rotation of the grippers 756 serves to retract the hose 1595. Propulsion forces provided by the grippers 756 help advance the jetting hose 1595 by pulling it through the jetting hose carrier system 400, transition 500, and pack-off section 600, and assist in advancing the jetting hose 1595 by pushing it into the lateral borehole 15 itself.

The view of FIG. 4F-1 depicts only two sets of opposing gripper assemblies 750. However, gripper assemblies 750 may be added to accommodate virtually any length and construction of jetting hose 1595, depending on compressional, torsional and horsepower constraints. Additional gripper assemblies 750 should add tractor force, which may be desirable for extended length lateral boreholes 15. Though it is presumed maximum grip force will be obtained when pairs of gripper assemblies 750 are placed axially opposing one another in the same plane (as shown in FIG. 4F-2.*a*), that is, maximizing a "pinch" force on the jetting hose 1595, other arrangements/placements of gripper systems 750 are within the scope of this aspect of the inventions.

Optionally, the internal tractor system 700 also includes a tensiometer. The tensiometer is used to provide real-time measurement of the pulling tension of the upstream section of hose 1595 and the pushing compression on the downstream section of hose 1595. Similarly, mechanisms could be included to individualize the applied compressional force of each set of grippers 756 upon the jetting hose 1595, so as to compensate for uneven wear of the grippers 756.

Again proceeding in presentation of the external system's 2000 main components from upstream-to-downstream, FIG. 4G-1 shows a longitudinal, cross-sectional view of the internal tractor-to-upper swivel (or third) crossover connection 800, and the upper swivel 900 itself. FIG. 4G-1*a* depicts a perspective view of the crossover connection 800 between its upstream and downstream ends, denoted by lines L-L' and M-M', respectively. FIG. 4G-1*b* presents an axial, cross-sectional view within the upper swivel 900 along line N-N'. The third transition 800 and upper swivel 900 are discussed in connection with FIGS. 4G-1, 4G-1*a* and 4G-1*b* together.

The transition 800 functions similarly to previous transitional sections (200, 500) of the external system 2000 discussed herein. For example, the transition 800 comprises an inner wall 820 and a surrounding outer wall 890 and defines a hydraulic fluid channel 840 there between. Chamber 830 transitions from lower chamber 730 and receives the electrical wires 106 and data cabling 107. Suffice it to say the main function of the transition 800 is to convert the axial profile of the star-shaped internal tractor system 700 back to a concentric circular profile as used for the swivel 900, and to do so within I.D. restrictions that meet the 3.5" frac string test.

The upper swivel 900 simultaneously accomplishes three important functions:

(1) First, it allows the indexing mechanism to rotate the connected whipstock member 1000 without torqueing any upstream components of the system 50.

(2) Second, it provides for rotation of the whipstock 1000 while yet maintaining a straight path for the electrical wiring 106 and data cabling 107 through wiring chamber 930 between the transition 800 and the whipstock member 1000; while simultaneously providing.

(3) Third, it provides a horseshoe-shaped hydraulic fluid chamber 940 that accommodates rotation of the whipstock member 1000 while yet maintaining a contiguous hydraulic flow path between the transition 800 and the whipstock member 1000.

Desirable for the simultaneous satisfaction of the above design criteria are the double sets of bearings 960 (the inner bearings) and 965 (the outer bearings). In one aspect, the upper swivel 900 has an O.D. of 2.6 in.

The outer wall 990 of the upper swivel 900 maintains the circular profile achieved by an outer wall 890 of transition 800. Similarly, concentric circular profiles are obtained in the upper swivel's 900 middle body 950 and inner wall 920. These three sequentially and concentrically smaller cylindrical bodies (990, 950, and 920) provide for placement of an inner set of circumferential bearings 960 (between the inner wall 920 and the middle body 950) and an outer set of circumferential bearings 965 (between the middle body 950 and the outer wall 990). The larger cross-sectional area of the middle body 950 allows it to host a horseshoe-shaped hydraulic fluid chamber 940, and an arc-shaped wiring chamber 930. The bearings 960, 965 facilitate relative rotation of the three sequentially and concentrically smaller cylindrical bodies 990, 950, and 920. The bearings 960, 965 also provide for rotatable translation of the whipstock member 1000 below the upper swivel 900 (also shown in FIG. 4G-1) while in its set and operating position. This, in turn, provides for a change in orientation of subsequent lateral boreholes jetted from a given setting depth in the parent wellbore 4. Stated another way, the upper swivel 900 allows an indexing mechanism (described in the related U.S. Pat. No. 8,991,522 and incorporated herein in its entirety) to rotate the whipstock member 1000 without torqueing any upstream components of the external system 2000.

It is also observed that the upper swivel 900 provides for rotation of the whipstock member 1000 while yet maintaining a straight path for the electrical wiring 106 and data cabling 107. The upper swivel 900 also permits the horseshoe-shaped hydraulic fluid chamber 940 to provide for rotation of the whipstock member 1000 while yet maintaining a contiguous hydraulic flow path down to the whipstock member 1000 and beyond.

Returning to FIG. 4, and as noted above, the external system 2000 includes a whipstock member 1000. The jetting hose whipstock member 1000 is a fully reorienting, resettable, and retrievable whipstock means similar to those described in the precedent works of U.S. Provisional Patent Application No. 61/308,060 filed Feb. 25, 2010, U.S. Pat. No. 8,752,651 filed Feb. 23, 2011, and U.S. Pat. No. 8,991,522 filed Aug. 5, 2011. Those applications are again referred to and incorporated herein for their discussions of setting, actuating and indexing the whipstock. Accordingly, detailed discussion of the jetting hose whipstock device 1000 will not be repeated herein.

FIG. 4H.1 provides a longitudinal cross-sectional view of a portion of the wellbore 4 from FIG. 2. Specifically, the jetting hose whipstock member 1000 is seen. The jetting hose whipstock member 1000 is in its set position, with the upper curved face 1050.1 of the whipstock 1050 receiving a jetting hose 1595. The jetting hose 1595 is bending across the hemispherically-shaped channel that defines the face 1050.1. The face 1050.1, combined with the inner wall of the production casing 12, forms the only possible pathway within which the jetting hose 1595 can be advanced through and later retracted from the casing exit "W" and lateral borehole 15.

A nozzle 1600 is also shown in FIG. 4H.1. The nozzle 1600 is disposed at the end of the jetting hose 1595. Jetting fluids are being dispersed through the nozzle 1600 to initiate formation of a mini-lateral borehole into the formation. The jetting hose 1595 extends down from the inner wall 1020 of the jetting hose whipstock member 1000 in order to deliver the nozzle 1600 to the whipstock member 1050.

As discussed in U.S. Pat. No. 8,991,522, the jetting hose whipstock member 1000 is set utilizing hydraulically controlled manipulations. In one aspect, hydraulic pulse technology is used for hydraulic control. Release of the slips is achieved by pulling tension on the tool. These manipulations were designed into the whipstock member 1000 to accommodate the general limitations of the conveyance medium (conventional coiled tubing) 100, which can only convey forces hydraulically (e.g., by manipulating surface and hence, downhole hydraulic pressure) and mechanically (i.e., tensile force by pulling on the coiled tubing, or compressive force by utilizing the coiled tubing's own set-down weight).

The jetting hose whipstock member 1000 is herein designed to accommodate the delivery of wires 106 and data cables 107 further downhole. To this end, a wiring chamber 1030 (conducting electrical wires 106 and data cables 107) is provided. Power and data are provided from the external system 2000 to conventional logging equipment 1400, such as a Gamma Ray—Casing Collar Locator logging tool, in conjunction with a gyroscopic tool. This would be attached immediately below a conventional mud motor 1300 and coiled tubing tractor 1350. Hence, for this embodiment, hydraulic conductance through the whipstock 1000 is desirable to operate a conventional ("external") hydraulic-over-electric coiled tubing tractor 1350 immediately below, and electrical (and preferably, fiber optic) conductance to operate the logging sonde 1400 below the coiled tubing tractor 1350. The wiring chamber 1030 is shown in the cross-sectional views of FIGS. 4H-1*a* and 4H-1*b*, along lines O-O' and P-P', respectively, of FIG. 4H-1.

Note that this tractor 1350 is placed below the point of operation of the jetting nozzle 1600, and therefore will never need to conduct either the jetting hose 1595 or high pressure jetting fluids to generate either the casing exit "W" or subsequent lateral borehole. Hence, there are no I.D. constraints for this (bottom) coiled tubing tractor 1350 other than the wellbore itself. The coiled tubing tractor 1350 may be either of the conventional wheel ("external roller") type, or the gripper (inch worm) type.

A hydraulic fluid chamber 1040 is also provided along the jetting hose whipstock member 1000. The wiring chamber 1030 and the fluid chamber 1040 become bifurcated while transitioning from semi-circular profiles (approximately matching their respective counterparts 930 and 940 of the upper swivel 900) to a profile whereby each chamber occupies separate end sections of a rounded rectangle (straddling the whipstock member 1050). Once sufficiently downstream of the whipstock member 1050, the chambers can be recombined into their original circular pattern, in preparation to mirror their respective dimensions and alignments in a lower swivel 1100. This enables the transport of power, data, and high pressure hydraulic fluid through the whipstock member 1000 (via their respective wiring chamber 1030 and hydraulic fluid chamber 1040) down to the mud motor 1300.

Below the whipstock member 1000 and the nozzle 1600 but above the tractor 1350 is an optional lower swivel 1100. FIG. 4I-1 is a longitudinal cross-sectional view of the lower swivel 1100, as it resides between the jetting hose whipstock member 1000 and crossover connection 1200, and within the production casing 12. A slip 1080 is shown set within the casing 12. FIG. 4I-1*a* is an axial cross-sectional view of the lower swivel 1100, taken across line Q-Q' of FIG. 4I.1. The lower swivel 1100 will be discussed with reference to FIGS. 4I-1 and 4I-1*a* together.

The lower swivel 1100 is essentially a mirror-image of the upper swivel 900. As with the upper swivel 900, the lower swivel 1100 includes an inner wall 1120, a middle body 1150, and an outer wall 1190. In a preferred embodiment, the outer conduit has an O.D. of 2.60", or slightly less. The constraint of the O.D. outer conduit 1190 is the self-imposed 3.5" frac string equivalency test.

The middle body 1150 further houses wiring chamber 1130 and a hydraulic fluid chamber 1140. The fluid chamber 1140 transports hydraulic fluid to crossover connection 1200 and eventually to the mud motor 1300.

The lower swivel 1100 also includes a wiring chamber 1130 that houses electrical wires 106 and data cables 107. Continuous electrical and/or fiber optic conductance may be desired when real time conveyance of logging data (gamma ray and casing collar locator, "CCL" data, for example) or orientation data (gyroscopic data, for example) is desired. Additionally, continuous electrical and/or fiber optic conductance capacity enables direct downhole assembly manipulation from the surface 1 in response to the real time data received.

It is noted that while the inner conduit 920 of the upper swivel 900 defines a hollow core of sufficient dimensions to receive and conduct the jetting hose 1595, the lower swivel 1100 has no such requirement. This is because in the design of the assembly 50 and the methods of usage thereof, the jetting hose 1595 is never intended to proceed downstream to a point beyond the whipstock member 1050. Accordingly, the innermost diameter of the lower swivel 1100 may in fact be comprised of a solid core, as depicted in FIG. 4I-1*a*, thereby adding additional strength qualities.

The lower swivel 1100 resides between the jetting hose whipstock member 1000 and any necessary crossover connections 1200 and downhole tools, such as a mud motor 1300 and the coiled tubing tractor 1350. Logging tools 1400, a packer, or a bridge plug (preferably retrievable, not shown) may also be provided. Note that, depending on the length of the horizontal portion 4*c* of the wellbore 4, the respective sizes of the conveyance medium 100 and production casing 12, and hence the frictional forces to be encountered, more than one mud motor 1300 and/or CT tractor 1350 may be needed.

The final figure presented is FIG. 4J. FIG. 4J depicts the final transitional component 1200, the conventional mud motor 1300, and the (external) coiled tubing tractor 1350. Along with the tools listed above, the operator may also choose to use a logging sonde 1400 comprised of, for example, a Gamma Ray—Casing Collar Locator and gyroscopic logging tools. The gyroscopic logging tools provide real-time data describing not only the precise downhole location, but the initial alignment of the whipstock face 1050.1 of the preceding jetting hose whipstock member 1000. This data is useful in determining:

(1) how many degrees of re-alignment, via the whipstock face 1050.1 alignment, are desired to direct the initial lateral borehole along its preferred azimuth; and (2) subsequent to jetting the first lateral borehole, how many degrees of re-alignment are required to direct subsequent lateral borehole(s) along their respective preferred azimuth(s).

It is anticipated that, in preparation for a subsequent hydraulic fracturing treatment in a horizontal parent wellbore 4*c*, an initial borehole 15 will be jetted substantially perpendicular to and at or near the same horizontal plane as the parent wellbore 4*c*, and a second lateral borehole will be jetted at an azimuth of 180° rotation from the first (again, perpendicular to and at or near the same horizontal plane as the parent wellbore). In thicker formations, however, and particularly given the ability to steer the jetting nozzle 1600 in a desired direction, more complex lateral bores may be desired. Similarly, multiple lateral boreholes (from multiple setting points typically close together) may be desired within a given "perforation cluster" that is designed to receive a single hydraulic fracturing treatment. The complexity of design for each of the lateral boreholes will typically be a reflection of the hydraulic fracturing characteristics of the host reservoir rock for the pay zone 3. For example, an operator may design individually contoured lateral boreholes within a given "cluster" to help retain a hydraulic fracture treatment predominantly "in zone."

It can be seen that an improved downhole hydraulic jetting assembly 50 is provided herein. The assembly 50 includes an internal system 1500 comprised of a guidable jetting hose and rotating jetting nozzle that can jet both a casing exit and a subsequent lateral borehole in a single step. The assembly 50 further includes an external system 2000 containing, among other components, a carrier apparatus that can house, transport, deploy, and retract the internal system to repeatably construct the requisite lateral boreholes during a single trip into and out of a parent wellbore 4, and regardless of its inclination. The external system 2000 provides for annular frac treatments (that is, pumping fracturing fluids down the annulus between the coiled tubing deployment string and the production casing 12) to treat newly jetted lateral boreholes. When combined with stage isolation provided by a packer and/or spotting temporary or retrievable plugs, thus providing for repetitive sequences of plug-and-UDP-and-frac, completion of the entire horizontal section 4*c* can be accomplished in a single trip.

In one aspect, the assembly 50 is able to utilize the full I.D. of the production casing 12 in forming the bend radius 1599 of the jetting hose 1595, thereby allowing the operator to use a jetting hose 1595 having a maximum diameter. This, in turn, allows the operator to pump jetting fluid at higher pump rates, thereby generating higher hydraulic horsepower at the jetting nozzle 1600 at a given pump pressure. This will provide for substantially more power output at the jetting nozzle, which will enable:

(1) optionally, jetting larger diameter lateral boreholes within the target formation;

(2) optionally, achieving longer lateral lengths;

(3) optionally, achieving greater erosional penetration rates; and (4) achieving erosional penetration of higher strength and threshold pressure ($\sigma_M$ and $P_{Th}$) oil/gas formations heretofore considered impenetrable by existing hydraulic jetting technology.

Also of significance, the internal system 1500 allows the jetting hose 1595 and connected jetting nozzle 1600 to be propelled independently of a mechanical downhole conveyance medium. The jetting hose 1595 is not attached to a rigid working string that "pushes" the hose and connected nozzle 1600, but instead uses a hydraulic system that allows the hose and nozzle to travel longitudinally (in both upstream and downstream directions) within the external system 2000. It is this transformation that enables the subject system 1500 to overcome the "can't-push-a-rope" limitation inherent to all other hydraulic jetting systems to date. Further, because the subject system does not rely on gravitational force for either propulsion or alignment of the jetting hose/nozzle, system deployment and hydraulic jetting can occur at any angle and at any point within the host parent wellbore 4 to which the assembly 50 can be "tractored" in.

The downhole hydraulic jetting assembly allows for the formation of multiple mini-laterals, or bore holes, of an extended length and controlled direction, from a single parent wellbore. Each mini-lateral may extend from 10 to 500 feet, or greater, from the parent wellbore. As applied to horizontal wellbore completions in preparation for subsequent hydraulic fracturing ("frac") treatments in certain geologic formations, these small lateral wellbores may yield significant benefits to optimization and enhancement of fracture (or fracture network) geometry and subsequent hydrocarbon production rates and reserves recovery. By enabling: (1) better extension of the propped fracture length; (2) better confinement of the fracture height within the pay zone; (3) better placement of proppant within the pay zone; and (4) further extension of a fracture network prior to cross-stage breakthrough, the lateral boreholes may yield significant reductions of the requisite fracturing fluids, fluid additives, proppants, hydraulic horsepower, and hence related fracturing costs previously required to obtain a desired fracture geometry, if it was even attainable at all. Further, for a fixed input of fracturing fluids, additives, proppants, and horsepower, preparation of the pay zone with lateral boreholes prior to fracturing could yield significantly greater Stimulated Reservoir Volume, to the degree that well spacing within a given field may be increased. Stated another way, fewer wells may be needed in a given field, providing a significance of cost savings. Further, in conventional reservoirs, the drainage enhancement obtained from the lateral boreholes themselves may be sufficient as to preclude the need for subsequent hydraulic fracturing altogether.

As an additional benefit, the downhole hydraulic jetting assembly 50 and the methods herein permit the operator to apply radial hydraulic jetting technology without "killing" the parent wellbore. In addition, the operator may jet radial lateral boreholes from a horizontal parent wellbore as part of a new well completion. Still further, the jetting hose may take advantage of the entire I.D. of the production casing. Further yet, the reservoir engineer or field operator may analyze geo-mechanical properties of a subject reservoir, and then design a fracture network emanating from a customized configuration of directionally-drilled lateral boreholes.

The hydraulic jetting of lateral boreholes may be conducted to enhance fracture and acidization operations during completion. As noted, in a fracturing operation, fluid is injected into the formation at pressures sufficient to separate or part the rock matrix. In contrast, in an acidization treatment, an acid solution is pumped at bottom-hole pressures less than the pressure required to break down, or fracture, a given pay zone. (In an acid frac, however, pump pressure intentionally exceeds formation parting pressure.) Examples where the pre-stimulation jetting of lateral boreholes may be beneficial include:

(a) prior to hydraulic fracturing (or prior to acid fracturing) in order to help confine fracture (or fracture network) propagation within a pay zone and to develop fracture (network) lengths a significant distance from the parent wellbore before any boundary beds are ruptured, or before any cross-stage fracturing can occur; and (b) using lateral boreholes to place stimulation from a matrix acid treatment far beyond the near-wellbore area before the acid can be "spent," and before pumping pressures approach the formation parting pressure.

The downhole hydraulic jetting assembly 50 and the methods herein also permit the operator to pre-determine a path for the jetting of lateral boreholes. Such boreholes may be controlled in terms of length, direction or even shape. For example, a curved borehole or each "cluster" of curved boreholes may be intentionally formed to further increase SRV exposure of the formation 3 to the wellbore 4*c*.

The downhole hydraulic jetting assembly 50 and the methods herein also permit the operator to re-enter an existing wellbore that has been completed in an unconventional formation, and "re-frac" the wellbore by forming one or more lateral boreholes using hydraulic jetting technology. The hydraulic jetting process would use the hydraulic jetting assembly 50 of the present invention in any of its embodiments. There will be no need for a workover rig, a ball dropper/ball catcher, drillable seats or sliding sleeve assemblies.

What is claimed is:

1. A guidance system for a downhole boring device, the boring device being configured to excavate rock to form an elongated borehole, and the guidance system, comprising:

at least three longitudinally-oriented and electrically-conductive actuator wires, with each of the actuator wires being secured to a distal end of a flexible tubular body, and with each of the actuator wires being configured to contract in response to receiving electrical current; and a boring device secured to the distal end of the flexible tubular body;

and wherein each of the actuator wires is configured to contract in proportion to an amount of the received electrical current such that a differing amount of electrical current directed through one or more of the actuator wires will thereby induce a bending moment to the boring device, said bending moment being sufficient to re-orient a body of the boring device and thereby change a trajectory of the boring device relative to the flexible tubular body.

2. The guidance system of claim 1, wherein:

the flexible tubular body is a jetting hose;

the at least three actuator wires are equi-distantly spaced about a circumference of the distal end of the jetting hose;

the boring device is a hydraulic nozzle having a forward discharge port;

the body of the hydraulic nozzle comprises a tubular stator body, and a tubular rotor body residing within the bore of the stator body, and forming a bore along a longitudinal axis of the nozzle; and the hydraulic nozzle further comprises:

one or more bearings residing between the rotor body and the surrounding stator body to accommodate relative rotational movement between the rotor body and the stator body;

electro-magnetic coils designed to induce the relative rotational movement between the rotor body and the stator body in response to electrical current;

a proximal end configured to sealingly connect to the distal end of the jetting hose, and to receive a jetting fluid; and a discharge slot at a distal end of the rotor body configured to deliver high pressure jetting fluid for erosion of a rock matrix downhole.

3. The guidance system of claim 2, further comprising:

an electrical power wire associated with each of the at least three actuator wires, with each power wire delivering current to its associated actuator wire, wherein each of the power wires resides along a chamber or sheath within the jetting hose;

a battery pack for generating the electrical current downhole;

a micro-processor for distributing the electrical current according to a determined geo-trajectory for the borehole; and at least one geo-spatial chip disposed on the body of the boring device, the at least one geo-spatial chip being configured to transmit geo-location data signals back along the jetting hose.

4. The guidance system of claim 3, further comprising:

one or more current regulators configured to regulate current into the electrical wires of the jetting hose in response to signals from the micro-processor;

and wherein the jetting hose is dimensioned to generate an elongated borehole of up to 50 feet in length.

5. The guidance system of claim 4, wherein:

the jetting hose and hydraulic nozzle are part of a hydraulic jetting assembly for forming lateral boreholes within a subsurface formation from a parent wellbore, the jetting hose and the hydraulic nozzle forming an internal system for the hydraulic jetting assembly;

the hydraulic jetting assembly further comprising an external system comprising:

a first elongated tubular body defining an outer conduit, the outer conduit having an upper end configured to be operatively attached to a tubing conveyance medium for running the assembly into wellbore, a lower end, and an internal bore there between;

a second elongated tubular body residing within the internal bore of the outer conduit and defining a jetting hose carrier, the jetting hose carrier being dimensioned to slidably receive the jetting hose and forming a micro-annulus between the jetting hose and the surrounding jetting hose carrier, the micro-annulus being sized to prevent buckling of the jetting hose as it slides within the jetting hose carrier during operation of the hydraulic jetting assembly;

an upper seal assembly connected to the jetting hose at an upper end and sealing the micro-annulus; and a whipstock member disposed below the lower end of the outer conduit, the whipstock member having an arcuate whipstock face;

wherein the assembly is configured to (i) translate the jetting hose out of the jetting hose carrier and against the whipstock face by a translation force to a desired point of wellbore exit, (ii) upon reaching the desired point of wellbore exit, direct jetting fluid through the jetting hose and the connected jetting nozzle until an exit is formed, (iii) continue jetting forming a lateral borehole into the rock matrix within the pay zone, and then (iv) pull the jetting hose back into the jetting hose carrier after a lateral borehole has been formed.

* * * * *